US005175535A

United States Patent [19]

Yamazaki et al.

[11] Patent Number: 5,175,535

[45] Date of Patent: * Dec. 29, 1992

[54] CIRCUIT FOR DRIVING A LIQUID CRYSTAL DISPLAY DEVICE

[75] Inventors: Katsunori Yamazaki; Mitsuo Nagato, both of Suwa, Japan

[73] Assignee: Seiko Epson Corporation, Tokyo, Japan

[ * ] Notice: The portion of the term of this patent subsequent to Apr. 23, 2008 has been disclaimed.

[21] Appl. No.: 588,119

[22] Filed: Sep. 25, 1990

Related U.S. Application Data

[63] Continuation of Ser. No. 232,750, Aug. 15, 1988, Pat. No. 5,010,326.

[30] Foreign Application Priority Data

| | | | |
|---|---|---|---|
| Aug. 13, 1987 | [JP] | Japan | 62-202154 |
| Feb. 9, 1988 | [JP] | Japan | 63-27922 |
| Feb. 9, 1988 | [JP] | Japan | 63-27923 |
| Feb. 9, 1988 | [JP] | Japan | 63-27924 |

[51] Int. Cl.[5] ..... G09G 3/36

[52] U.S. Cl. ..... 340/784; 340/805

[58] Field of Search ..... 340/784, 765, 805; 350/332, 333

[56] References Cited

U.S. PATENT DOCUMENTS

| | | | |
|---|---|---|---|
| 3,995,942 | 12/1976 | Kawakami et al. | 340/784 |
| 4,045,791 | 8/1977 | Fukai et al. . | |
| 4,485,380 | 11/1984 | Soneda et al. | 340/784 |
| 4,630,122 | 12/1986 | Morokawa . | |
| 4,679,043 | 1/1987 | Morokawa . | |
| 4,702,560 | 10/1987 | Endo . | |
| 4,801,933 | 1/1989 | Yamamoto . | |
| 4,845,482 | 7/1989 | Howard et al. | 340/784 |
| 4,864,290 | 9/1989 | Waters | 340/784 |
| 5,012,274 | 12/1988 | Dolgoff . | |

FOREIGN PATENT DOCUMENTS

| | | |
|---|---|---|
| 0162969 | 12/1985 | European Pat. Off. . |
| 0175417 | 3/1986 | European Pat. Off. . |
| 19195 | 1/1985 | Japan . |
| 19196 | 1/1985 | Japan . |
| 31825 | 2/1987 | Japan . |

*Primary Examiner*—Jeffery A. Brier
*Attorney, Agent, or Firm*—Blum Kaplan

[57] ABSTRACT

A liquid crystal display device for displaying characters or a pattern without crosstalk interference includes a first substrate, a second substrate and a liquid crystal layer sandwiched therebetween. A plurality of common electrodes are formed on the first substrate and a plurality of segment electrodes are formed on the second substrate. A driver provides a common voltage waveform of either a selected or non-selected voltage to each of the plurality of common electrodes and provides a segment voltage waveform of either an ON voltage or an OFF voltage to the plurality of segment electrodes. A compensating circuit compensates at least one of the common voltage and the segmented voltage based upon the pattern of characters displayed by the liquid crystal display device.

2 Claims, 75 Drawing Sheets

CIRCUIT FOR DRIVING A LIQUID CRYSTAL DISPLAY DEVICE

This is a continuation of application Ser. No. 07/232,750 filed on Aug. 15, 1988 now U.S. Pat. No. 5,010,326.

BACKGROUND OF THE INVENTION

The present invention relates to a liquid crystal display device, and in particular, to a circuit for driving a matrix liquid crystal display device.

Matrix liquid crystal displays are known in the art Reference is made to FIGS. 1 through 3 in which a conventional matrix liquid crystal display is provided. A liquid crystal panel generally indicated as 1 is composed of a liquid crystal layer 5, a first substrate 2 and a second substrate 3 for sandwiching the liquid crystal layer 5 therebetween A plurality of common electrodes Y1 through Y6 are oriented on substrate 2 in the horizontal direction and a plurality of segment electrodes X1 through X6 are formed on substrate 3 in substantially the vertical direction to form a matrix. Each intersection of common electrodes Y1 through Y6 and segment electrodes X1 through X6 forms a display dot 7. Display dots 7 marked by the hatching indicate an ON state, and the blank dots 7 indicate an OFF state. The dot structure of liquid crystal panel 1 is limited to a six by six matrix for simplicity however, in exemplary embodiments the number of dots of liquid crystal panel 1 may be much greater.

The voltage standard method is conventionally used for driving the prior art matrix liquid crystal display device. A selected voltage or non-selected voltage is sequentially applied to each of common electrodes Y1 through Y6. The period required to apply the successive selected voltage or non-selected voltage to all the common electrodes Y1 to Y6 is one frame.

Simultaneous to the successive application of the selected voltage or non-selected voltage to each common electrodes Y1 through Y6, an ON voltage or OFF voltage is applied to each segment electrode X1 through X6. Accordingly, to turn a display dot 7, the area in which one common electrode intersects one segment electrode, to the ON state, an ON voltage is applied to a desired segment electrode when the common electrode is selected by providing a selected voltage to the desired common electrode. Similarly if the display dot is turned OFF, the OFF voltage is applied to the desired segment electrode.

Reference is now also made to FIGS. 2 and 3 in which examples of the actual driving waveforms (waveform of the applied voltage) applied at the electrodes are provided. FIG. 2A shows the segment voltage waveform applied to segment electrode X5 over time. FIG. 2B shows the common electrode waveform applied to common electrode Y3 over time. FIG. 2C shows the voltage waveform applied for producing the ON state at display dot 8, the intersection of segment electrode X5 and common electrode Y3.

FIG. 3A shows the segment voltage waveform applied to segment electrode X5 over time. FIG. 3B shows the common voltage waveform applied to common electrode Y4 over time. FIG. 3C shows the voltage waveform applied to the display dot at the intersection of segment electrode X5 and common electrode Y4 to produce the OFF state.

In FIGS. 2 and 3, F1 and F2 indicate the frame period. During frame period F1,

| | | | | | |
|---|---|---|---|---|---|
| selected voltage | = | $V0$, | non-selected voltage | = | $V4$ |
| ON voltage | = | $V5$, | OFF voltage | = | $V3$ |

During frame period F2,

| | | | | | |
|---|---|---|---|---|---|
| selected voltage | = | $V5$, | non-selected voltage | = | $V1$ |
| ON voltage | = | $V0$, | OFF voltage | = | $V2$, |

wherein;

$$V0-V1=V1-V2=V$$

$$V3-V4=V4-V5=V$$

$$V0-V5=nV \text{ (n is a constant).}$$

Accordingly, by changing the polarity of the voltage which is applied to display dots 7 during frame periods F1 and F2, alternating driving is accomplished It follows that whether the display dot 7 is ON or OFF depends on whether the ON voltage or OFF voltage is applied to the desired segment electrode when the selected voltage is applied to the intersecting common electrode corresponding to the desired display dot. This diving method is the voltage standard means used in the prior art.

The prior art structure and driving method has been less than satisfactory. When matrix liquid crystal display 1 is driven by the above conventional voltage standard method, the uniform rectangular waveforms illustrated in FIGS. 2 and 3 are not actually applied to display dots 7. Distortions in the applied waveforms occur. A first reason for the distortion is that each display dot 7 has an inherent electrical capacity based on the area of each dot 7, the thickness of the liquid crystal layers, the dielectric constant of the liquid crystal materials and so on. Secondly, both the common electrode and segment electrode are formed of a transparent conductive film having a surface resistance of about several tens of ohms as well as fixed electrical resistance. Therefore, even if the uniform rectangular waveforms as shown in FIGS. 2 and 3 are applied by the driving circuit, the waveform which is actually applied to the display dots becomes deformed and cross talk results. As a result, it becomes necessary to generate the difference of the effective voltage of the waveform which is applied to each display dot, resulting in the generation of contrast cross talk.

Observation has demonstrated that deformation of the voltage waveform being applied to the display dots occurs based upon relationship dependent on the pattern of the characters or drawings which is displayed by the liquid crystal display device. Secondly, the change of the effective voltage based on the deformation of the voltage waveform which is applied to the display dots causes the contrast crosstalk.

1. The first mode (zebra crosstalk)

Reference is now made to FIGS. 1, 4, 5, and 6A through 6C wherein zebra crosstalk is depicted For simplicity of explanation, the common electrodes Y1 through Y6 are sequentially selected from the first common electrode Y1 to the sixth common electrode Y6, again returning to the first common electrode Y1. Additionally, liquid crystal panel 1 is a positive display wherein the greater the effective voltage applied to the display dots 7, the darker the display dot. A scale is provided in FIG. 4 to indicate relative darkness. This type of display is used for each explanation unless otherwise indicated.

If the display of FIG. 1 is desired and the inputs of FIGS. 2 and 3 are provided, the crosstalk of the display contrast as shown in FIG. 4 actually occurs in the liquid crystal display device 1. As can be seen, segment electrodes X1 through X4 receive identical inputs The segment voltage waveform at the display dots portion of segment electrodes X1 through X4 is shown in FIG. 5A, the common voltage waveform applied at the display dot portion of the common electrode Y3 is shown in FIG. 5B. The voltage waveform applied at r1 the display dots located at the intersections of segment electrodes X1 through X4 and common electrode Y3 is shown in FIG. 5C. The voltage waveforms applied to the four display dots will differ from each other slightly. However, this slight difference can be ignored here.

A spike shaped deformation of the voltage waveform occurs at the non-selected voltage level of the common voltage waveform as shown in FIG. 5B. The relationship between the direction and the size of the spike shaped voltage and the display pattern is as follows. Generally, when the selection of the successive common electrode moves from the nth common electrode to the (n+1)th common electrode, the number of segment electrodes to which the ON voltage is successively added is a, the number of segment electrodes to which the OFF voltage is successively applied is b, the number of segment electrodes to which a voltage is applied by switching from the ON voltage to OFF voltage is c and the number of segment electrodes to which the voltage is added by switching from the OFF voltage to ON voltage is d. The number of ON dots 7 on the nth common electrode is $N_{ON}$. The number of OFF dots 7 on the nth common electrode is $N_{OFF}$ and the number of ON dots 7 on the (n+1)th common electrode is $M_{ON}$ while the number OFF dots on the (n+1)th common electrode is $M_{OFF}$. The relationship between the segmented electrodes and common electrodes is as follows:

$$N_{ON} = a + c, \qquad N_{OFF} = b + d$$
$$M_{ON} = a + d, \qquad M_{OFF} = b + c$$
$$N_{ON} + N_{OFF} = M_{ON} + M_{OFF} = K$$

K is a constant and equal to the total number display dots on each common electrode Y.

A value of I equal to the difference in ON dots between successive segment electrodes is defined as follows:

$$I = c - d = N_{ON} - M_{ON},$$

so, when the value of I is negative, the direction of the spike shaped voltage is in the direction of the ON voltage. On the other hand, where the value of I is positive, the direction of the spiked shaped voltage is in the direction of the OFF voltage. The size of the spike increases in accordance with the absolute value of I.

In other words, when the number d of segment electrodes in which the applied voltage switches from the OFF voltage to ON voltage is larger than the number c of segment electrodes in which the applied voltage switches from the ON voltages to OFF voltage, the spike shaped voltage occurs on the common voltage waveform in the direction of the ON voltage. In contrast thereto, when the sign of I, which is the difference between c and d, changes the spike shaped voltage occurs in the direction of the OFF voltage. Additionally, the value of the spike shaped voltage corresponds to the absolute value of I.

As shown in FIGS. 5A and 5B, when the relationship between the change of the segment voltage waveform and the direction of the spike shaped voltage of the common voltage waveform on the non-selected voltage are in-phase, a rounded corner occurs in the voltage waveform of the voltage applied at the display dots (FIG. 5C). The longer the in-phase period, the smaller the effective voltage value of the applied waveform, resulting in the displayed color becoming very light.

Reference is now made to FIG. 6 which illustrates the change of the segment voltage waveform and the direction of the spike on the common voltage waveform when the waveforms are out of phase. FIG. 6A shows the segment voltage waveform applied at the display dot portion of the segment electrode X5 of display 10. FIG. 6B shows the common voltage waveform applied at the display dot 7 portion of the common electrode Y3. FIG. 6C shows the combined voltage waveform which is applied to the display dot at the intersection of segment electrode X5 and common electrode Y3. As shown, where the relationship between the change in the segment voltage waveform (FIG. 6A) and the direction of the spike shaped voltage of the common voltage waveform of the non-selected voltage (FIG. 6B) are out of phase, a spike shaped voltage is generated in the combined voltage waveform applied to the display dots 7 (FIG. 6B), thereby increasing the effective value of the applied voltage. The longer the out of phase period, the larger the effective value, resulting in a darkening of the displayed color. Therefore, display dots 7 on segment electrodes X1 to X4 become light, and the display dots on the segment electrode X5 become dark regardless of the applied ON state or OFF state voltages. The darkness of display dots 7 on segment electrode X6 become a color of intermediate degree between the above on segment electrodes X1 to X4 and those on X5.

2. The second mode (horizontal crosstalk)

Reference is now made to FIGS. 7 through 10 in which a desired pattern is illustrated. FIG. 7 illustrates a display 11 on which a horizontal crosstalk pattern is displayed. Display 11 is the same as liquid crystal panel 1. The actual contrast crosstalk generated by display 11 is shown by display 12 of FIG. 8.

Display dot 7 acts as a capacitor. The capacity of this capacitor has a different value in the ON state than in the OFF state. The value of the capacitance in the ON state is larger than the capacitance in the OFF state. This occurs because the liquid crystal 5 acts as an anistropic dielectric and the resulting alignment change occus between the ON state and OFF state. Accordingly, the capacitance of all dots 7 on common electrode Y2 having many ON dots 13 is larger than that on common electrode Y4 having a few ON dots 13. Since common electrodes have the same circuit resistance, the rounded waveform generated in the voltage waveform of common electrode Y2 becomes larger.

FIG. 9A shows the segment voltage waveform over time applied at the display dot portion on the segment electrode X1 of display 11. FIG. 10B shows the common electrode waveform over time applied at the display dot portion on the common electrode Y2. FIG. 9C shows the combined voltage waveform over time applied to dot 7 at the intersection of segment electrode X1 and common electrode Y2.

FIG. 10A shows the segment voltage waveform over time applied at the display dot portion on the segment electrode X1 of display 11. FIG. 10B shows the common voltage waverform over time applied at the display dot portion on the common electrode Y4. FIG. 10C shows the combined voltage waveform over time which is applied to the dot at the intersection of segment electrode X1 and common electrode Y4.

As can be seen from a comparison of FIG. 9B and FIG. 10B, the waveform of common electrode Y2 which has many ON dots is more rounded when a change from the non-selected voltage to selected voltage occurs. This area is marked by the hatched area. As can be seen by comparing FIG. 9C with FIG. 10C the voltage effective value of the waveform which is applied to dots 13 on common electrode Y2 also decreases by the hatched area. Accordingly, the color produced at each display dot 7 of common electrode Y2 having many ON dots 13 becomes very light. Thus, if the number of ON dots on each common electrode is represented by Z, the larger the value of Z of the common electrode, the lighter the displayed color.

3. The third mode (vertical crosstalk)

Reference is now made to FIGS. 12 through 17C in which vertical crosstalk is illustrated. The pattern of display 14 is actually displayed as display 15 due to vertical crosstalk. the segment voltage waveform applied at the display dot portion on segment electrode X6 is shown in FIG. 13A. The common voltage waveform applied to the display dot portion on the common electrode Y2 is shown in FIG. 13B. The combined voltage waveform which is applied at the display dot at the intersection of segment electrode X6 and common electrode Y2 is shown in FIG. 13C. Further, FIGS. 14A through 14C show each voltage waveform on segment electrode X5 and common electrode Y2 and the voltage waveforms which are combined to form the actual waveform at the display dot at the intersection of segment electrode X5 and common electrode Y2.

A second example of vertical crosstalk is now described. The segment voltage waveform applied at the display dot portion of segment electrode X6 is shown in FIG. 17A. A desired pattern is input to produce the pattern on display 15. However, due to vertical crosstalk a pattern such as that of display 16 results. The common voltage waveform applied at the display dot portion of common electrode Y3 is shown in FIG. 17B. FIG. 17C shows the combined voltage waveform which is applied to the display dot at the intersection of segment electrode X6 and common electrode Y3. Similarly, FIGS. 18A through 18C show each voltage waveform applied at segment electrode X5, common electrode Y2 and the combined voltage waveform applied at display dot 7 at the intersection of segment electrode X5 and common electrode Y2.

The non-selected voltage level of the common voltage waveform during the displaying of the pattern of display 14 having many ON dots varies in the ON voltage direction as shown in FIG. 13B. Conversely, the non-selected voltage level of the common voltage waveform of display 15 having few ON dots varies in the OFF voltage direction as shown in FIG. 17B.

Where there are many ON dots, the variation is caused because each of common electrodes Y1 through Y6 is electrically connected to the segment electrode to which the ON voltage is applied through the condenser of display dots to a greater extent than to the segment electrode to which the OFF voltage is applied. The reason for this phenomenon is unclear, but it may occur due to a lack of sufficient output impedance of the power circuit relative to the load of the liquid crystal panel. The relationship for the generated voltage shift is described below.

For all display dots 7 of displays 14 and 15 T is the number of ON dots and L is the number of OFF dots. A value T' is defined as $T'=T-L$ when T' is positive, the non-selected voltage level varies in the ON voltage direction. On the other hand, when T' is negative the non-selected voltage level varies in the OFF voltage direction. The size of the variation increases in accordance with the absolute value of T'.

Where the pattern includes many ON dots 13 as shown in display 14, the difference between the OFF voltage and the non-selected voltage becomes large and the difference between the ON voltage and the non-selected voltage becomes small. Therefore, comparing the voltage waveform (FIG. 14A) which is added to display dots 7 on segment electrode X5 of display 15 (FIG. 12) having no ON dot 13, with the voltage waveform FIG. 13A which is added to display dots 7 on segment electrode X6 having ON dot 13, illustrates that the effective combined voltage which is applied to display dot 7 on the segment electrode X5 is larger for the portion marked by the hatched area (FIG. 14C), thereby making the display dots on the segment electrode X5 dark when they should be blank.

Similarly, where the display has few ON dots 13 such as display 15, the difference between the ON voltage and the non-selected voltage becomes large, and the difference between the OFF voltage and the non-selected voltage becomes small. Therefore, comparing the voltage waveform which is provided to display dots 7 by segment electrode X6 including ON dot 13, and the voltage waveform which is provided to display dots 7 on the segment electrode X5 having no ON dot 13, the effective voltage which is provided to the display dots on the segment electrode X6 is larger than that of electrode X5 for the period marked by the hatched area (FIG. 17C) resulting in a dark display dot on segment electrode X6.

4. The fourth mode (inversion crosstalk)

Reference is made to FIGS. 18 through 21 in which inversion crosstalk is illustrated. A desired pattern is input to a display 17 (FIG. 19), but in reality appears as the pattern on a display 18 (FIG. 20) due to inversion crosstalk. FIG. 21A shows a segment voltage waveform provided at the display dot portion on segment electrode X6. FIG. 21B shows a common voltage waveform provided at the display dot portion on common electrode Y2. FIG. 21C shows a combined voltage waveform which is provided to display dot 7 at the intersection of segment electrode X6 and the common electrode Y2. FIG. 22 shows the combined voltage waveform provided to display dot 7 at the intersection of segment electrode X5 and common electrode Y2.

Reference is now made to FIGS. 23 through 26 wherein a second example of inversion crosstalk is provided. A pattern is input to appear as display 20 (FIG. 23), but in reality appears as the pattern of display 19 (FIG. 24) due to inversion crosstalk. FIG. 25A shows a segment voltage waveform provided at the display dot portion of segment electrode Y6. FIG. 25B shows a common voltage waveform provided at the display dot portion of common electrode Y2. FIG. 25C shows the combined voltage waveform which is provided at display dot 7 at the intersection of segment electrode X6 and common electrode Y2. FIG. 26 shows a combined voltage waveform provided by electrodes Y2 and X5 to display dot 7 at the intersection of segment electrode X5 and common electrode Y2.

The time period of switching between frame periods, i.e. before or after the switching from F1 to F2 of FIG. 21 and FIG. 25 is known as the inversion. As shown in FIG. 19 when the number of segment electrodes in which the voltage applied to the segment electrode is an ON voltage before and after the inversion (only the 6th segment electrode X6 in FIG. 19) is less than the number of segment electrodes in which the voltage applied to the segment electrode is an OFF voltage before and after the inversion (the five segment electrodes X1 to X5 in FIG. 19), a rounded waveform is as shown in FIG. 21B occurs at the time of inversion.

Therefore, when the pattern as shown in FIG. 19 is displayed, the rounded waveform occurs in the common voltage waveform as shown in FIG. 21B at the time of inversion.

Simultaneously, the voltage waveform applied to the segment electrode X6 (FIG. 21A) applied to display dots 7 on segment electrode X6 for changing from an ON voltage to an ON voltage before and after the inversion, generates a spike shaped voltage as shown in FIG. 21C, thereby increasing the effective voltage making the display dark. On the other hand, for the voltage waveform which is applied to display dots 7 of segment electrodes X1 through X5 for changing from an OFF voltage to an OFF voltage before and after the inversion, the rounded portion of the waveform as shown in FIG. 22 occurs, thereby decreasing the effective voltage, thus lightening the display.

Conversely, in display 20 (FIG. 23) the spike shaped voltage is generated in the common voltage waveform as shown in FIG. 25B at the time of inversion. Simultaneously, when the applied waveform changes from an ON voltage to an OFF voltage before and after the inversion, a rounded section (FIG. 25C) is generated in the voltage waveform which is applied to display dots 7 on segment electrodes X1, X2, X3, X4 and X6, thereby decreasing the effective voltage and further lightening the displayed color. Additionally, when the voltage applied to the display dots on the segment electrode X5, switches from an OFF voltage to an OFF voltage before and after the inversion, a spike shaped voltage (FIG. 26) is generated thereby increasing the effective voltage, darkening the displayed color.

The above relationship is defined as follows. The number of segment electrodes switching from an ON voltage to an ON voltage at the time of inversion is a. The number of segment electrodes switching from an OFF voltage to an OFF voltage at the time of inversion is b. The number of segment electrodes for switching from an ON voltage to an OFF voltage is c. The number of segment electrodes for switching from an OFF to an ON voltage is d. Further, the number of ON dots on the common electrode (Y6, FIGS. 19 and 23) which is selected just before the inversion is $N_{ON}$ and the number of OFF dots on the common electrode is $N_{OFF}$ while the number of ON dots on the common electrode (Y1, FIGS. 19 and 23) which is selected just after the inversion is $M_{ON}$ and the number of OFF dots on the common electrode is $M_{OFF}$.

$$N_{ON} = a + c, \qquad N_{OFF} = b + d$$
$$M_{ON} = a + d, \qquad M_{OFF} = b + c$$
$$N_{ON} + N_{OFF} = M_{ON} + M_{OFF} = K$$

K is a constant representing the number of display dots on each common electrode. Wherein, $$\begin{aligned} F &= a - b \\ &= N_{ON} - M_{OFF} \\ &= N_{ON} + M_{ON} - K. \end{aligned}$$

If the value of F is negative, at the time of the inversion, the rounded waveform occurs when the non-selected voltage changes on the common electrode. Conversely, if the value of F is positive, the spike shaped voltage occurs in the direction of the ON voltage. The value the applied voltage increases in accordance with the absolute value of F. This introduces the display crosstalk as mentioned above.

The general crosstalk problem has been well known in the art. A method for correcting crosstalk is also known in the art and is illustrated in Japanese Laid-open Patent Nos. 31825/87, 19195/85 and 19196/85. The method consists of reversing the polarity of the voltage which is applied to the liquid crystal panel a predetermined number of times per frame. This method is known as the line reverse driving method.

However, this method has been less than satisfactory. The line reverse driving method corrects only one mode of crosstalk (zebra crosstalk) of the plurality of cross talk modes. As mentioned above, there are four modes of crosstalk in the display relating to the mechanism which arise due to changes of the voltage waveform. Accordingly, the cross talk of the display contrast is not completely removed.

Accordingly, a mechanism for driving a liquid crystal display which overcomes the limitations of the prior art is desired.

SUMMARY OF THE INVENTION

A mechanism for driving a matrix liquid crystal display having two substrates and a liquid crystal layer formed therebetween in accordance with the invention is provided. A group of common electrodes is formed on one substrate. A group of segment electrodes is formed on the other substrate. The common electrodes intersect the segment electrodes, providing display dots on the liquid crystal display at each intersection. A common voltage waveform comprising a selected voltage state and a non-selected voltage state is applied to the group of common electrodes. A segment voltage waveform having an ON voltage state and an OFF voltage state is applied to the group of segment electrodes. Changing at least one of the common voltage waveform and the segment voltage waveform in accordance with the pattern of drawings or characters to be displayed in the liquid crystal display device produce the desired display. The liquid crystal display device is driven by a multiplex driver using the voltage standard driving technique.

A waveform compensation circuit receives a data signal representative of a character or pattern to be displayed and compensates at least one of the common voltage waveform and segment voltage waveform based thereon. The period, voltage or a combination thereof of a portion of the non-selected voltage and/or the segment voltage waveform, or the value of the selected voltage may be compensated. By compensating for the shift of the combined effective voltage applied to each display dot, an improved display with less crosstalk is provided.

Accordingly, it is an object of the present invention to provide an improved circuit for driving a liquid crystal display.

Another object of the present invention is to provide a circuit for driving a liquid crystal display which eliminates at least four modes of crosstalk.

A further object of this invention is to provide a circuit for driving a liquid crystal display in which the relationships of the voltage inputs and the display output are quantized and the input display voltage is compensated in accordance with the quantized value.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
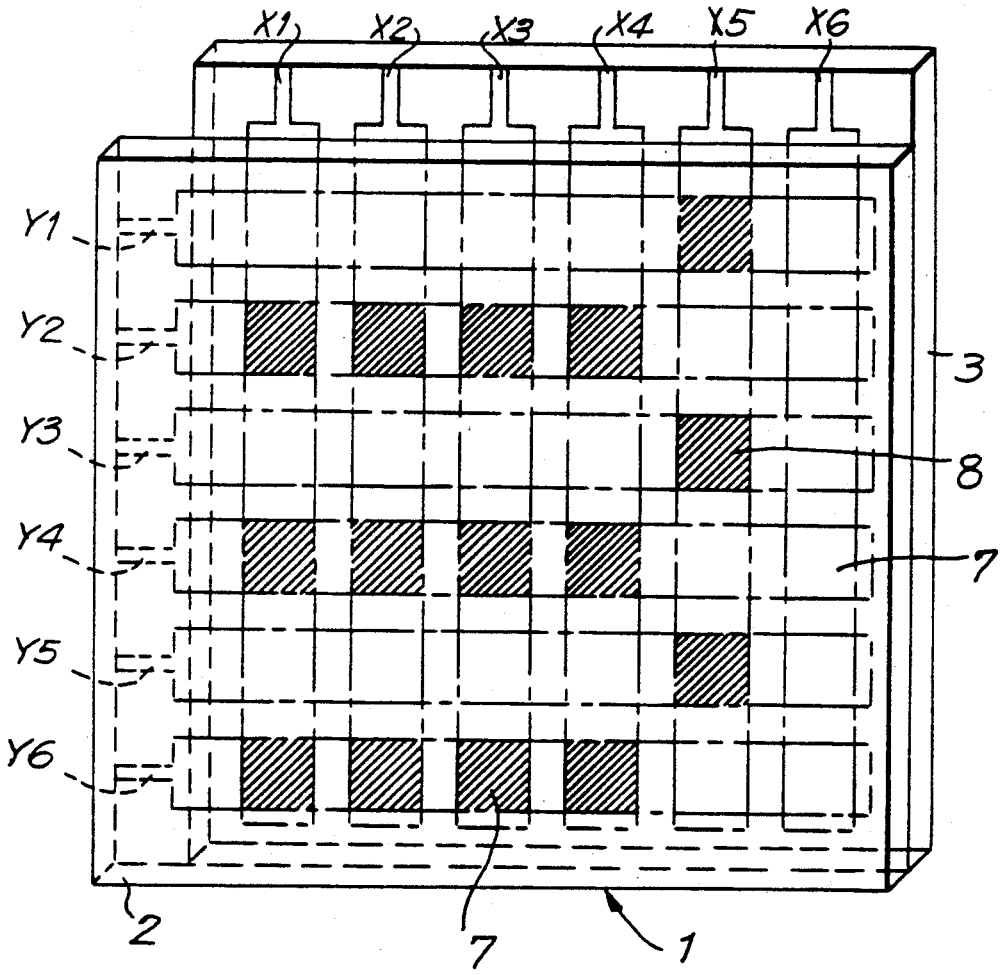
FIG. 1 PRIOR ART
FIG. 1 is a perspective view of a liquid crystal display and pattern in accordance with the prior art.
Figure 2A:
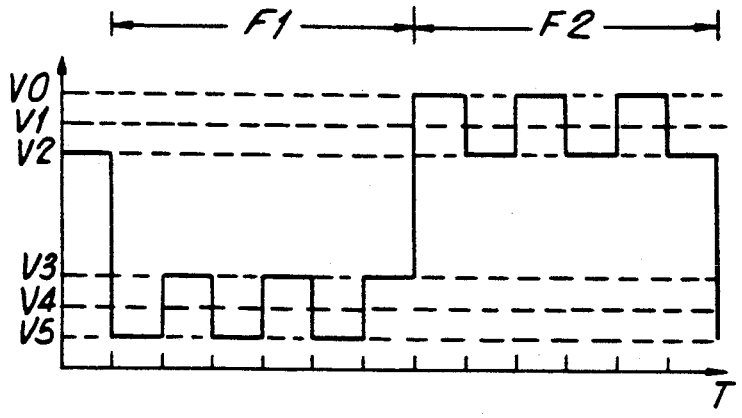
FIG. 2A PRIOR ART
FIGS. 2A–2C and 3A–3C are graphs of ideal waveforms of the voltage applied to the liquid crystal panel for forming the display pattern of FIG. 1.
Figure 2B:
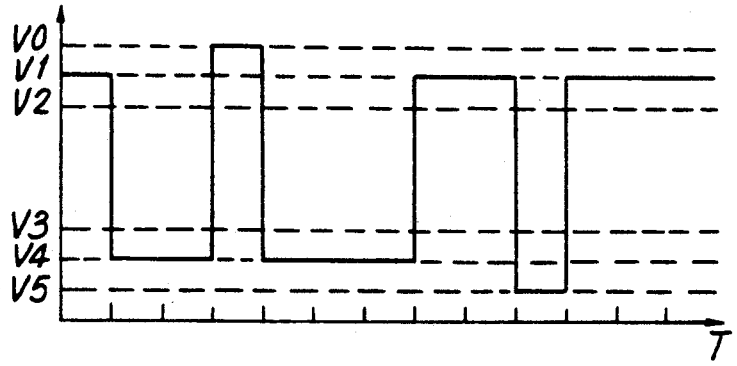
FIG. 2B PRIOR ART
Figure 2C:
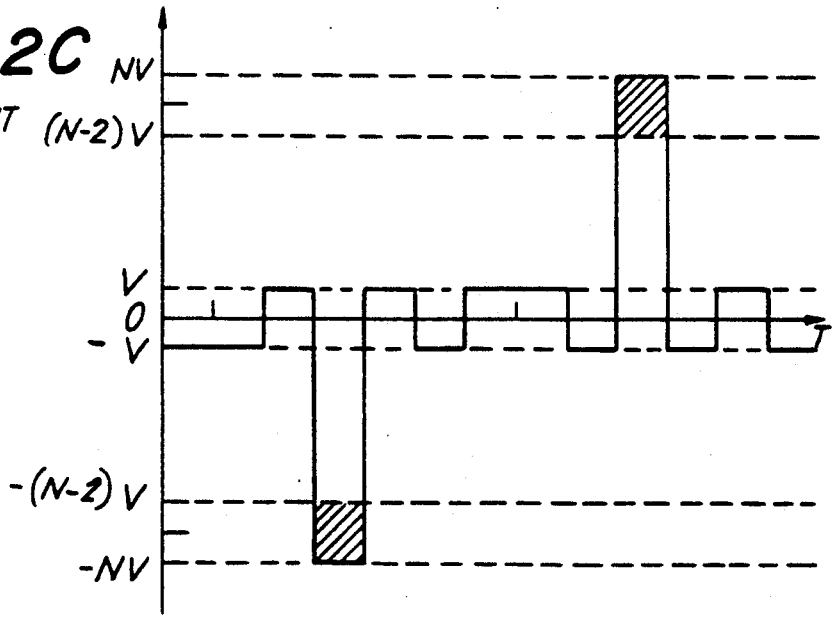
FIG. 2C PRIOR ART
Figure 3A:
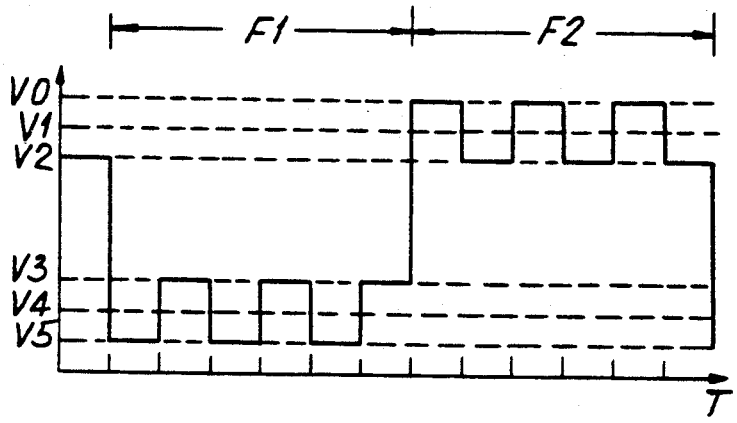
FIG. 3A PRIOR ART
Figure 3B:
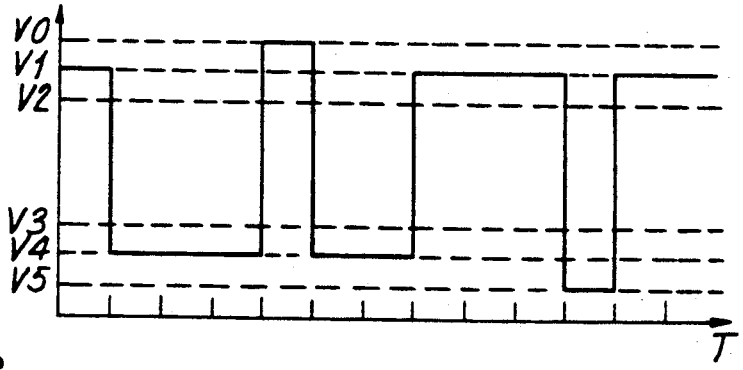
FIG. 3B PRIOR ART
Figure 3C:
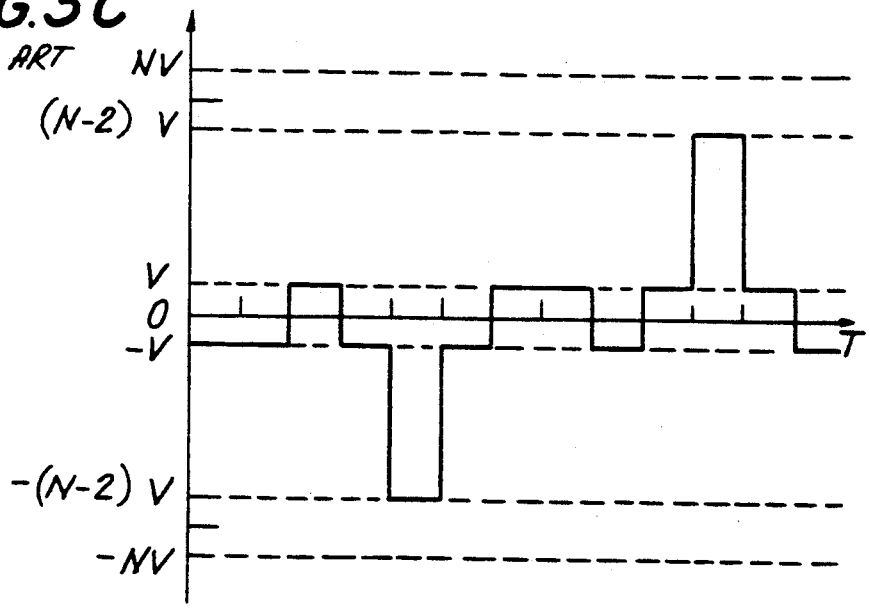
FIG. 3C PRIOR ART
Figure 4:
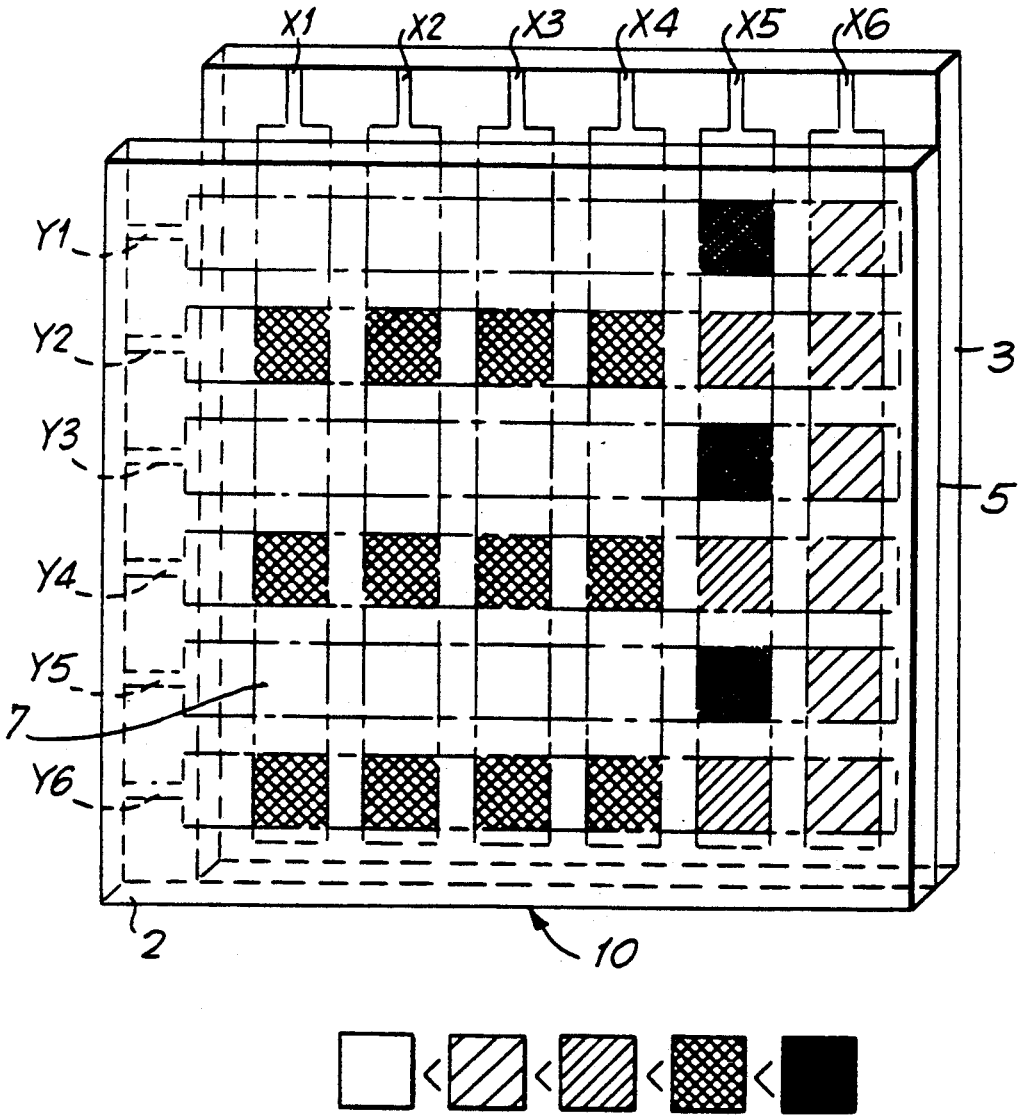
FIG. 4 PRIOR ART
FIG. 4 is a perspective view of the liquid crystal panel and actual display pattern of FIG. 1.
Figure 5A:
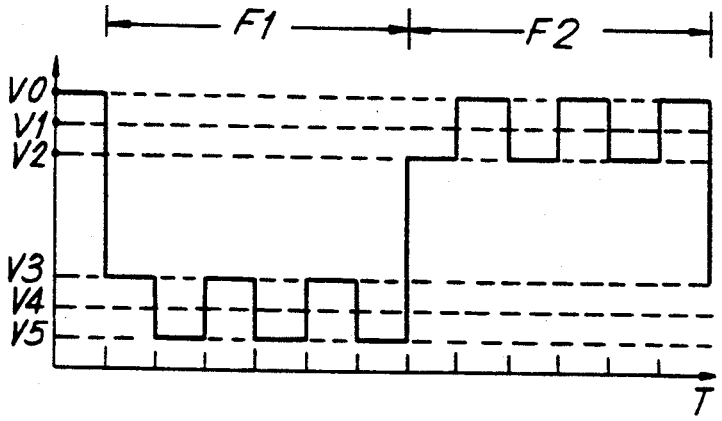
FIG. 5A PRIOR ART
FIGS. 5A–5C and 6A–6C are graphs of waveforms of the voltage actually applied to the liquid crystal panel when forming the display pattern of FIG. 1.
Figure 5B:
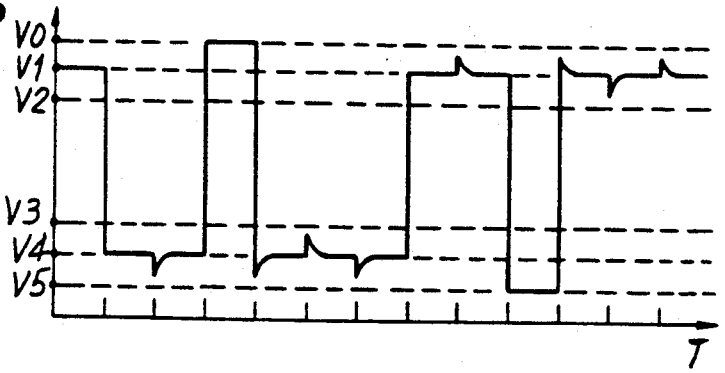
FIG. 5B PRIOR ART
Figure 5C:
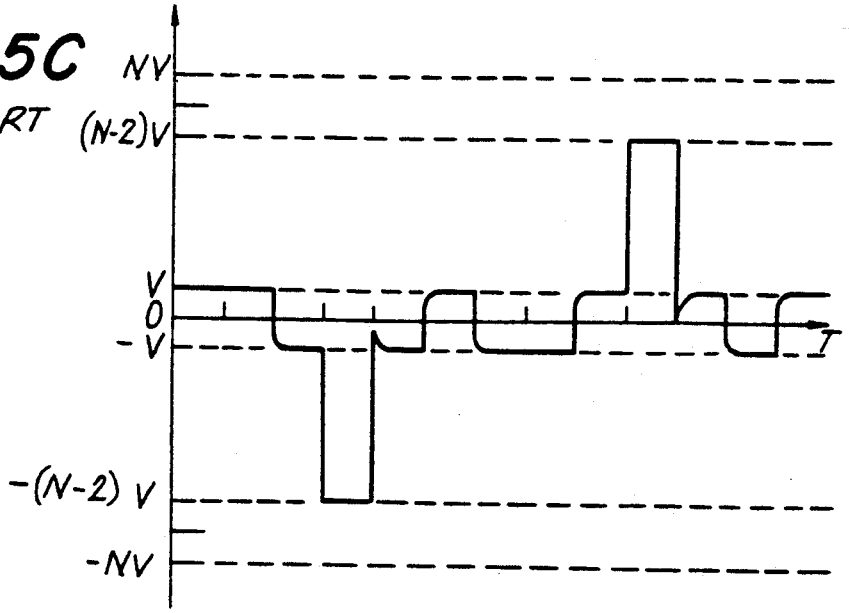
FIG. 5C PRIOR ART
Figure 6A:
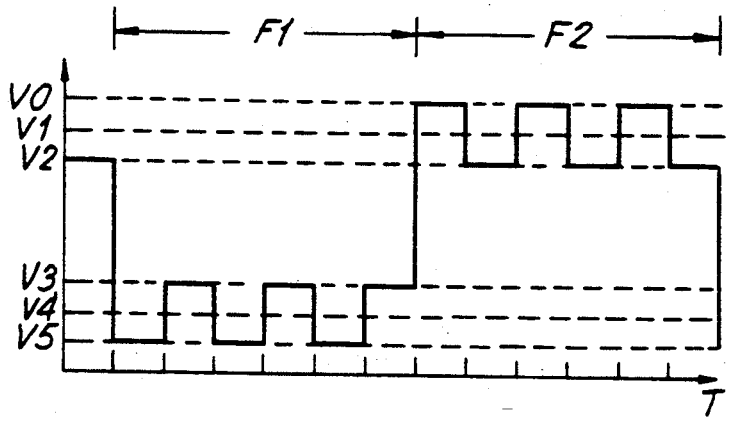
FIG. 6A PRIOR ART
Figure 6B:
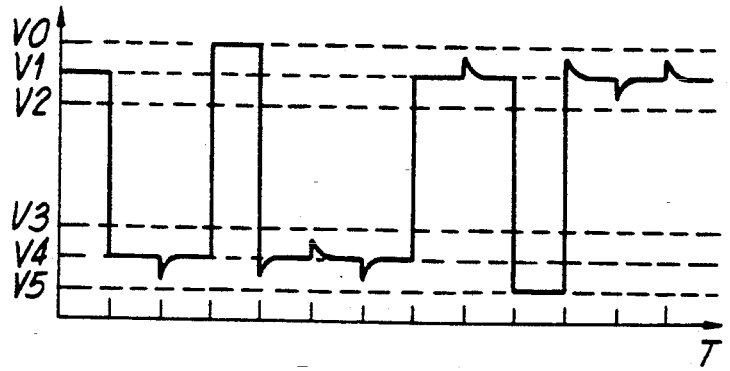
FIG. 6B PRIOR ART
Figure 6C:
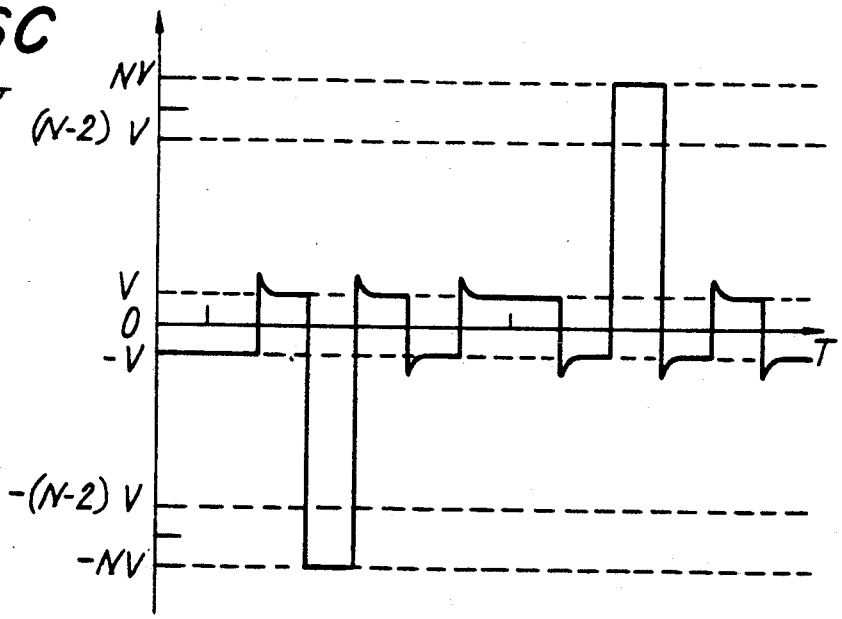
FIG. 6C PRIOR ART
Figure 7:
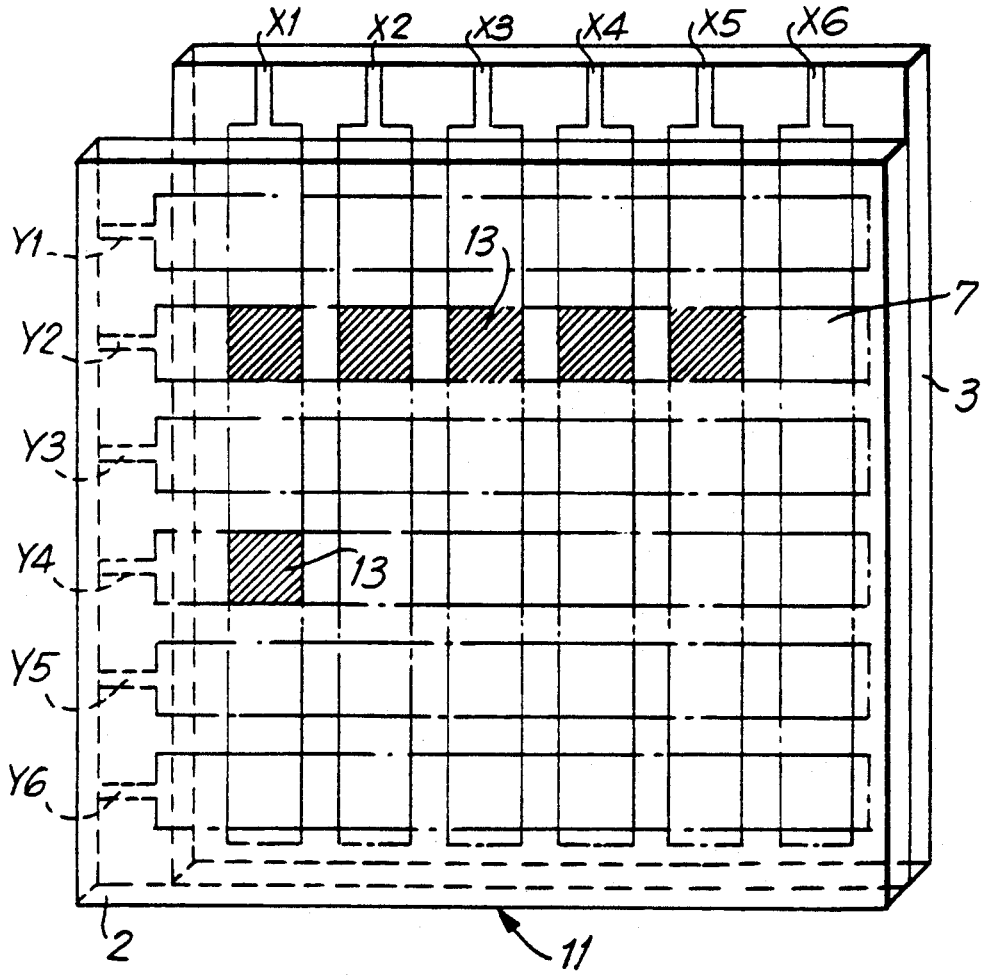
FIG. 7 PRIOR ART
FIG. 7 is a perspective view of a liquid crystal panel having another ideal display pattern.
Figure 8:
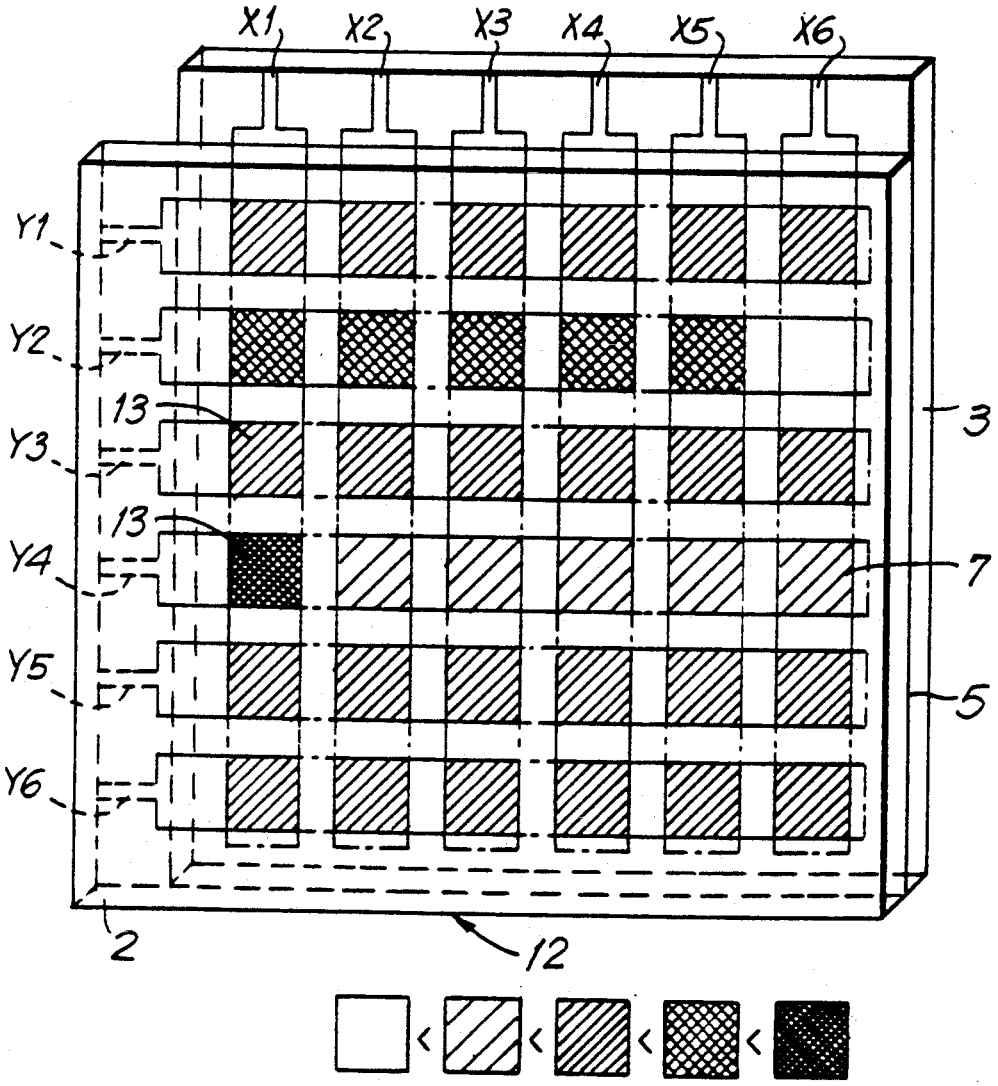
FIG. 8 PRIOR ART
FIG. 8 is a perspective view of a liquid crystal panel showing the actual display condition when the display pattern of FIG. 7 is formed.
Figure 9A:
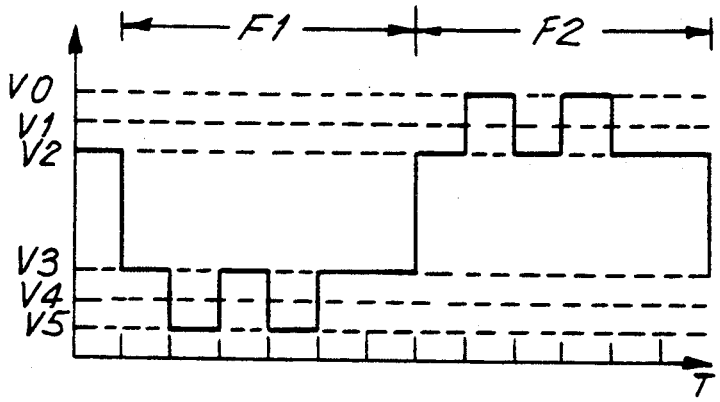
FIG. 9A PRIOR ART
FIGS. 9A–9C and 10A–10C are graphs of waveforms of the voltage actually applied to the liquid crystal panel when forming the display pattern of FIG. 7.
Figure 9B:
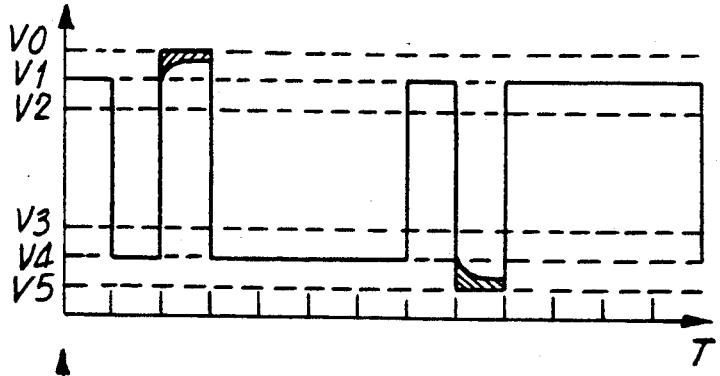
FIG. 9B PRIOR ART
Figure 9C:
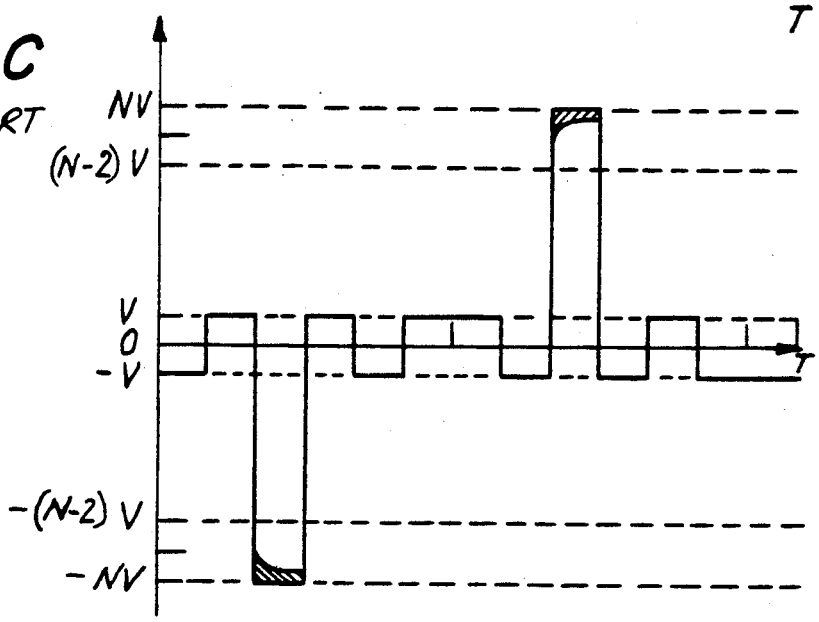
FIG. 9C PRIOR ART
Figure 10A:
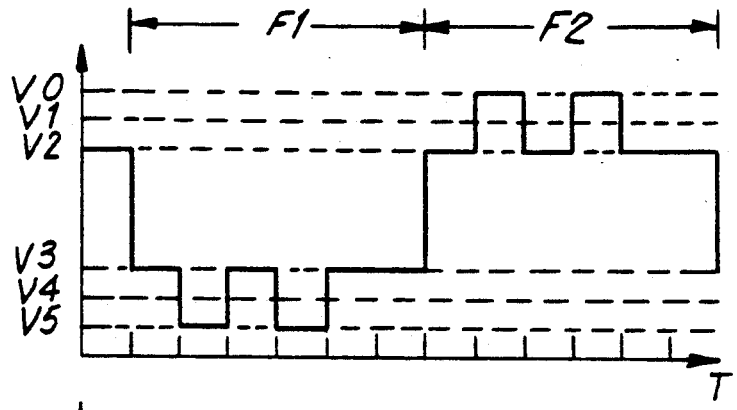
FIG. 10A PRIOR ART
Figure 10B:
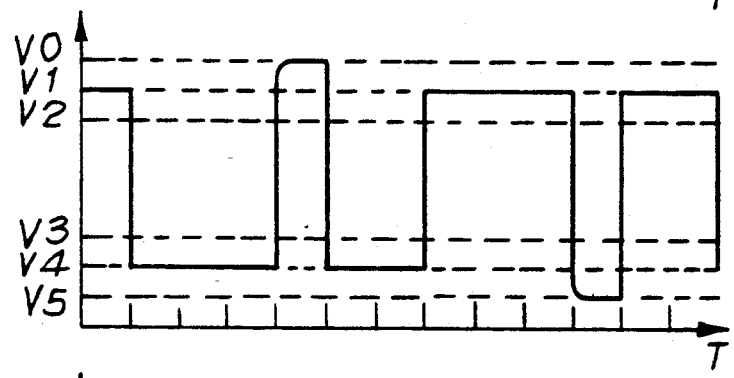
FIG. 10B PRIOR ART
Figure 10C:
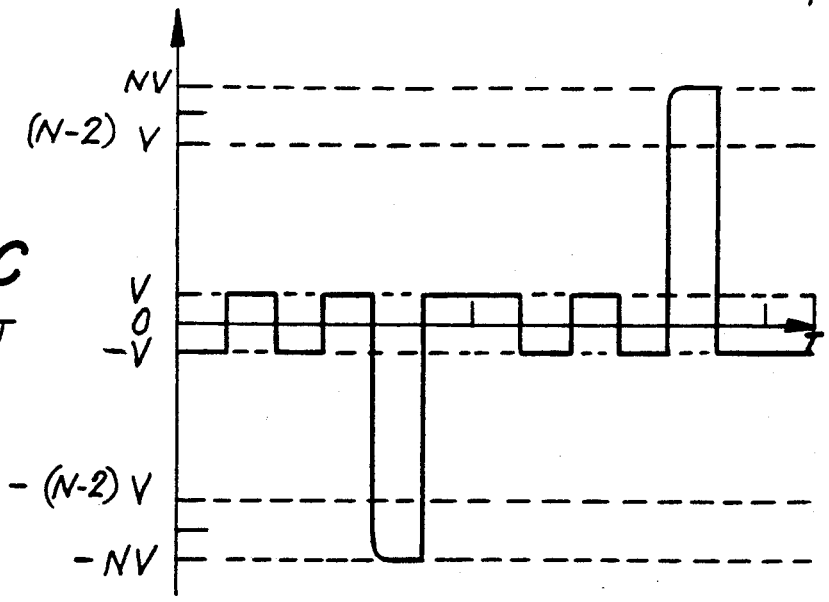
FIG. 10C PRIOR ART
Figure 11:
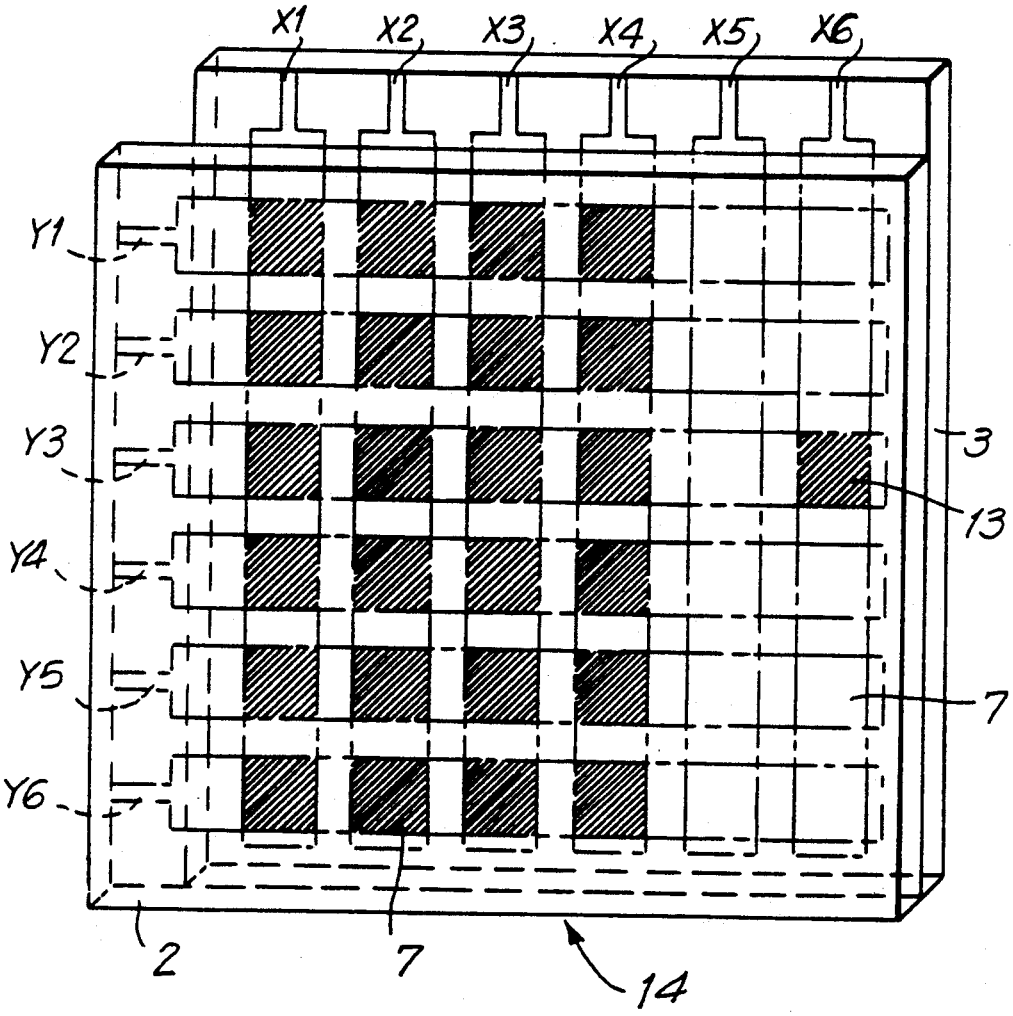
FIG. 11 PRIOR ART
FIG. 11 is a perspective view of a liquid crystal panel wherein another ideal display pattern is formed.
Figure 12:
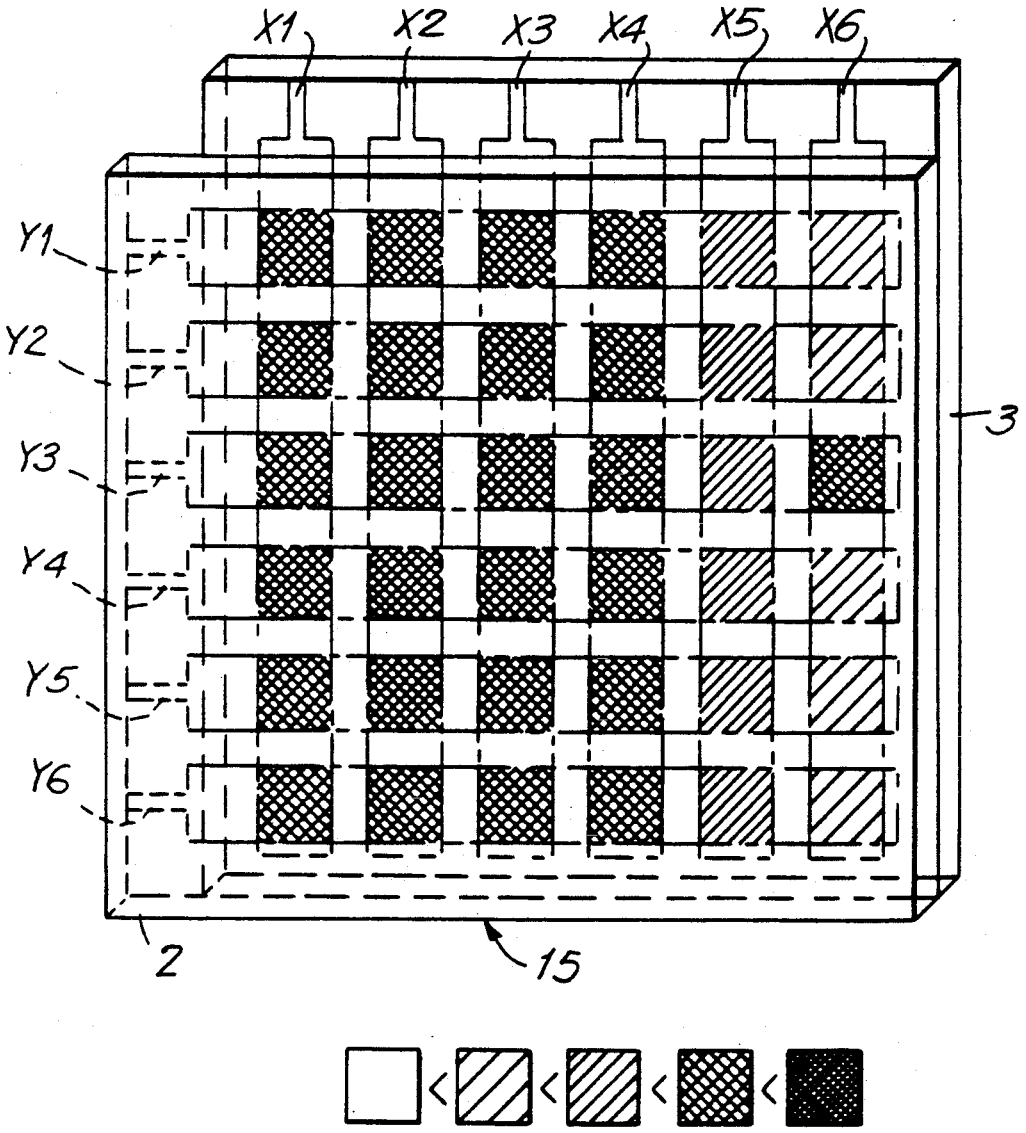
FIG. 12 PRIOR ART
FIG. 12 is a perspective view of the actual display when the display pattern of FIG. 11 is formed.
Figure 13A:
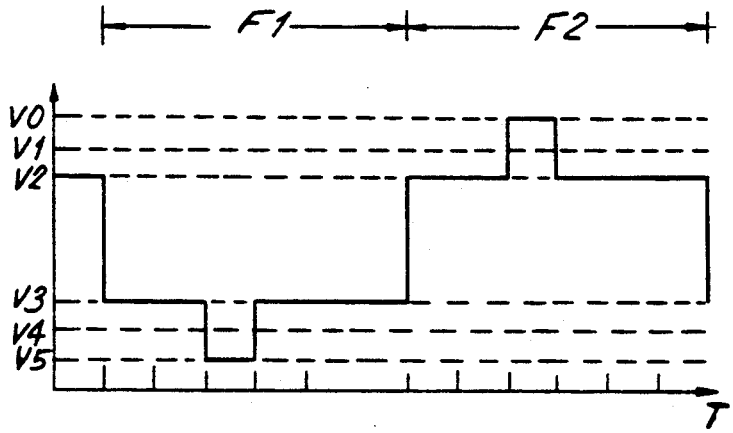
FIG. 13A PRIOR ART
FIGS. 13A–13C and 14A–14C are graphs of waveforms of the voltage actually applied to the liquid crystal panel for forming the display pattern of FIG. 11.
Figure 13B:
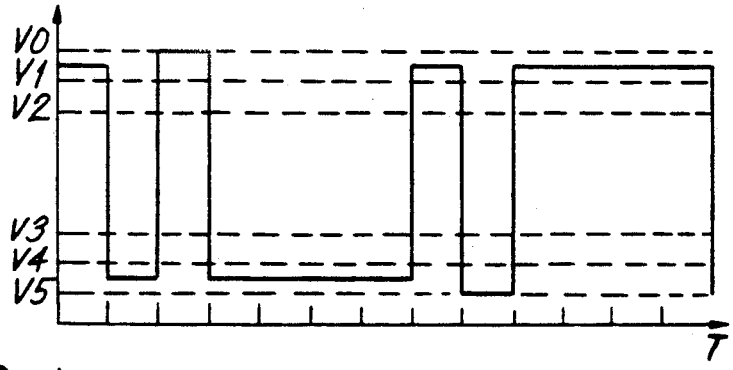
FIG. 13B PRIOR ART
Figure 13C:
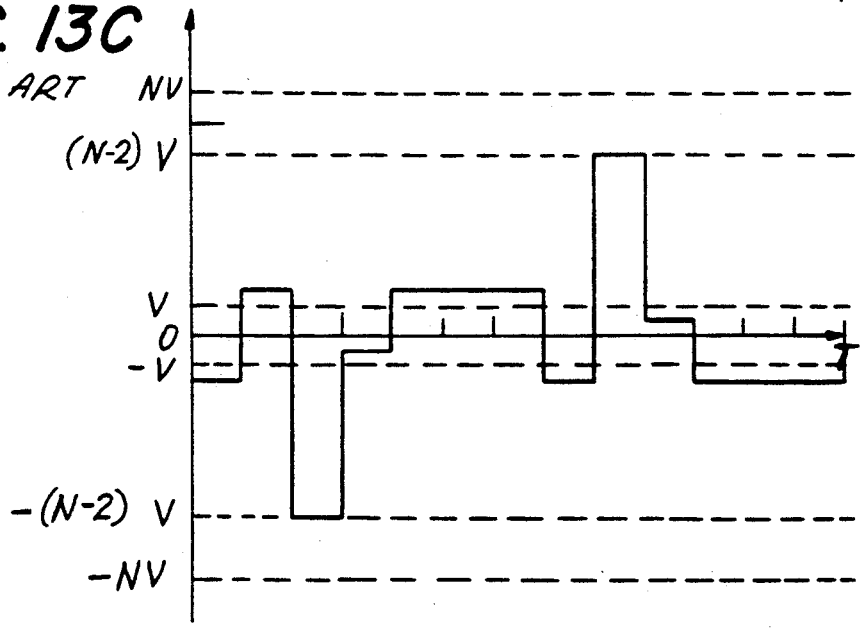
FIG. 13C PRIOR ART
Figure 14A:
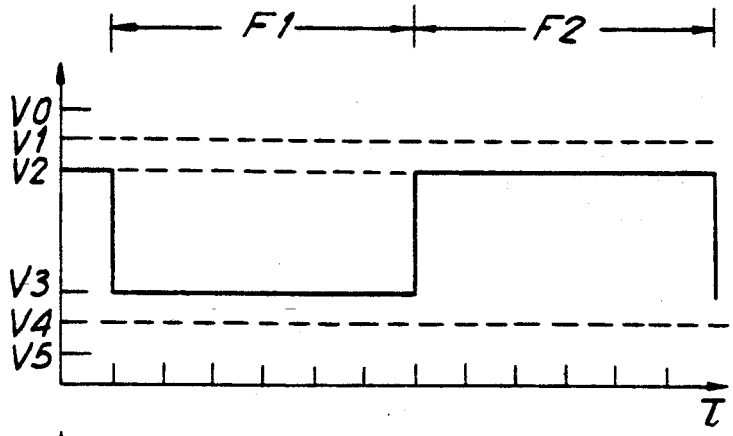
FIG. 14A PRIOR ART
Figure 14B:
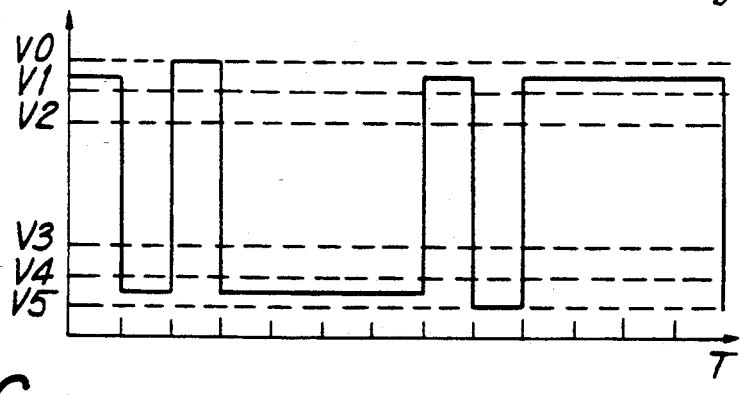
FIG. 14B PRIOR ART
Figure 14C:
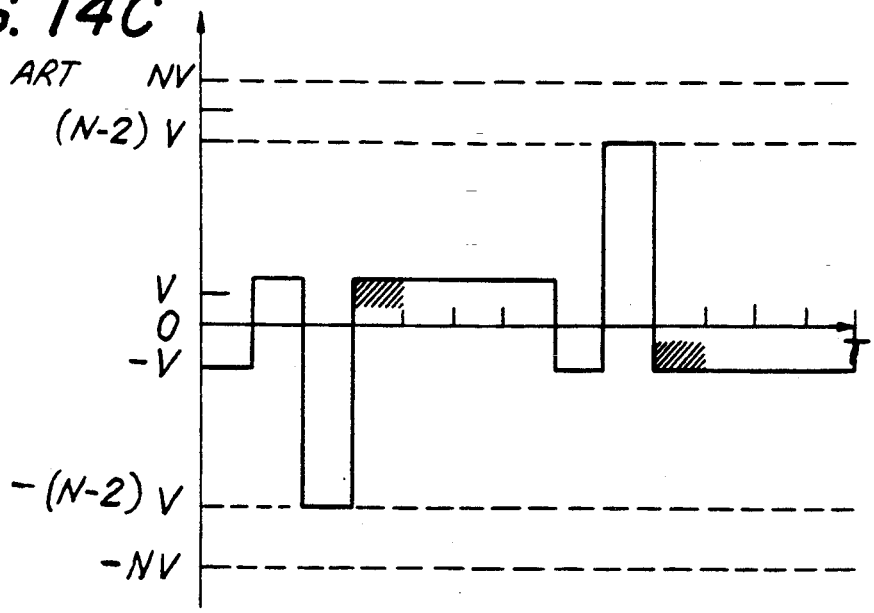
FIG. 14C PRIOR ART
Figure 15:
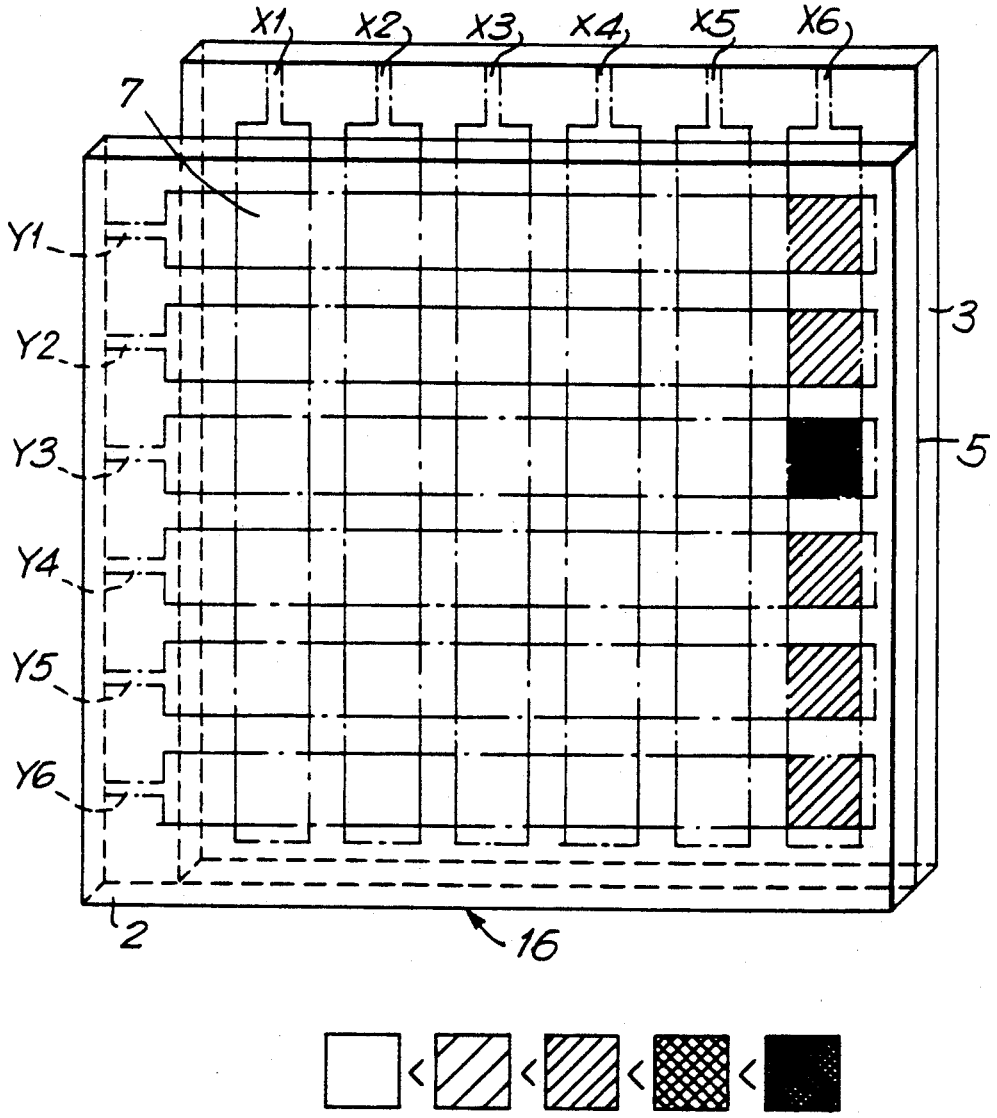
FIG. 15 PRIOR ART
FIG. 15 is a view showing the actual display when the display pattern of FIG. 16 is formed.
Figure 16:
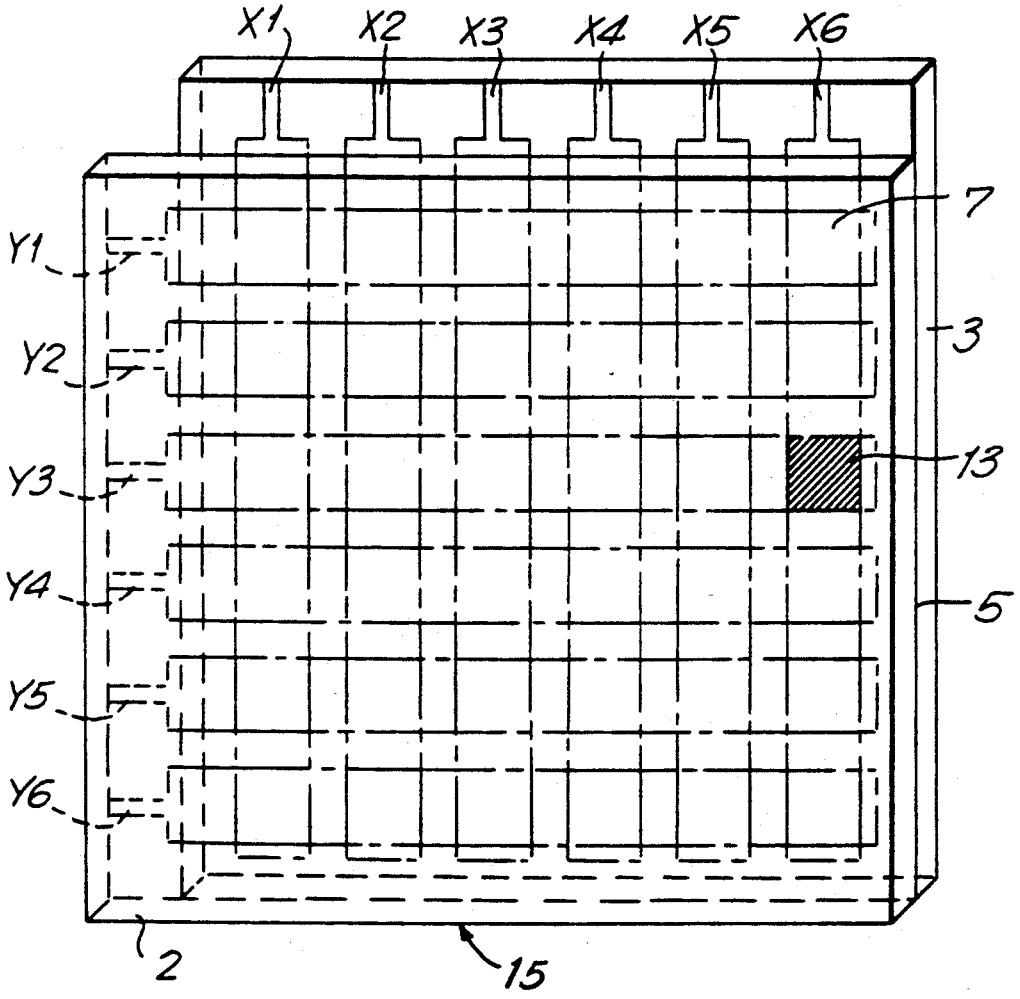
FIG. 16 PRIOR ART
FIG. 16 is a perspective view of a liquid crystal panel wherein another ideal display pattern is formed.
Figure 17A:
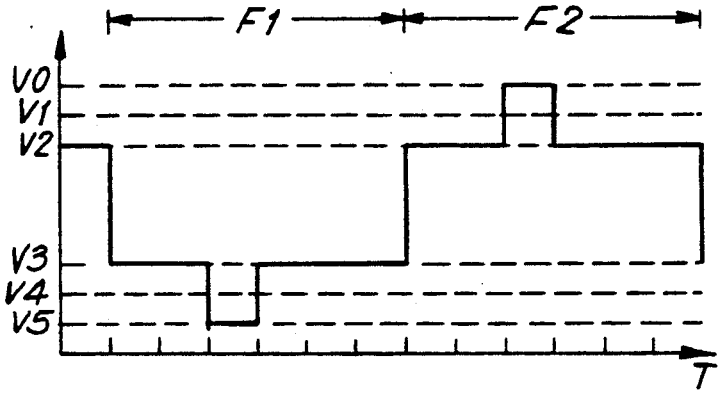
FIG. 17A PRIOR ART
FIGS. 17A–17C and 18A–18C are graphs of waveforms of the actual voltage applied to the liquid crystal panel for forming the display pattern of FIG. 16.
Figure 17B:
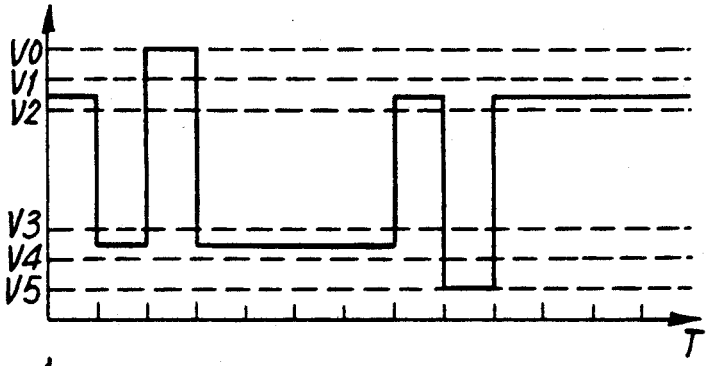
FIG. 17B PRIOR ART
Figure 17C:
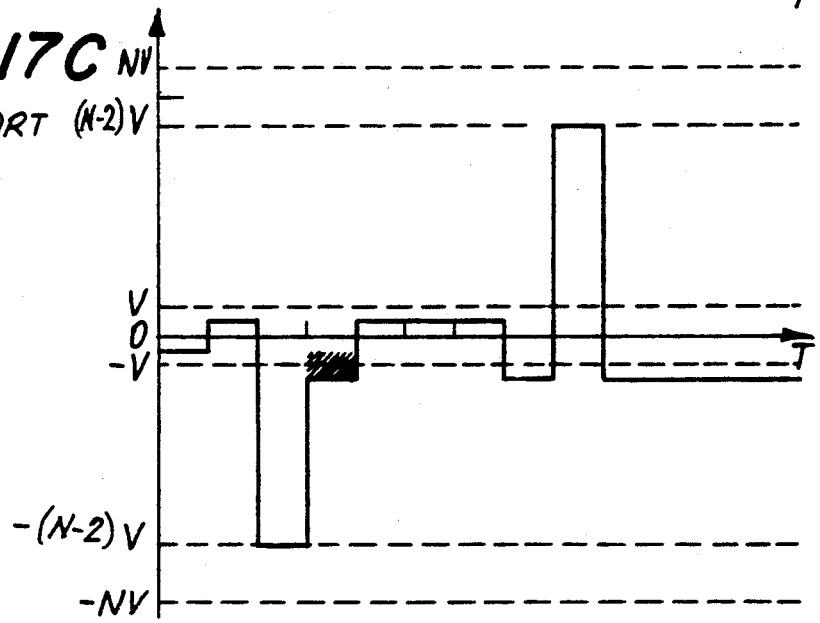
FIG. 17C PRIOR ART
Figure 18A:
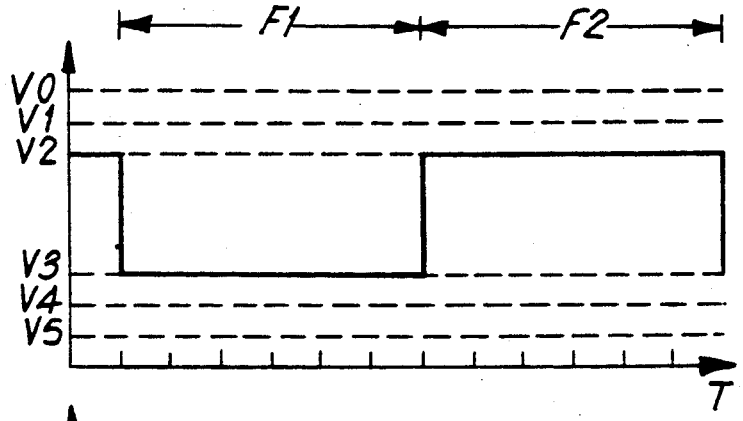
FIG. 18A PRIOR ART
Figure 18B:
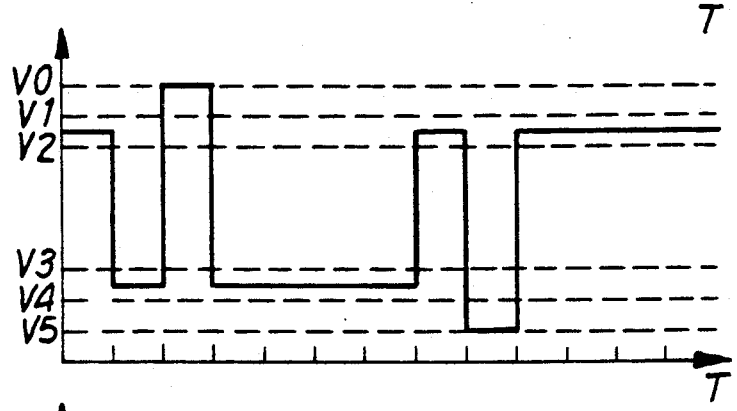
FIG. 18B PRIOR ART
Figure 18C:
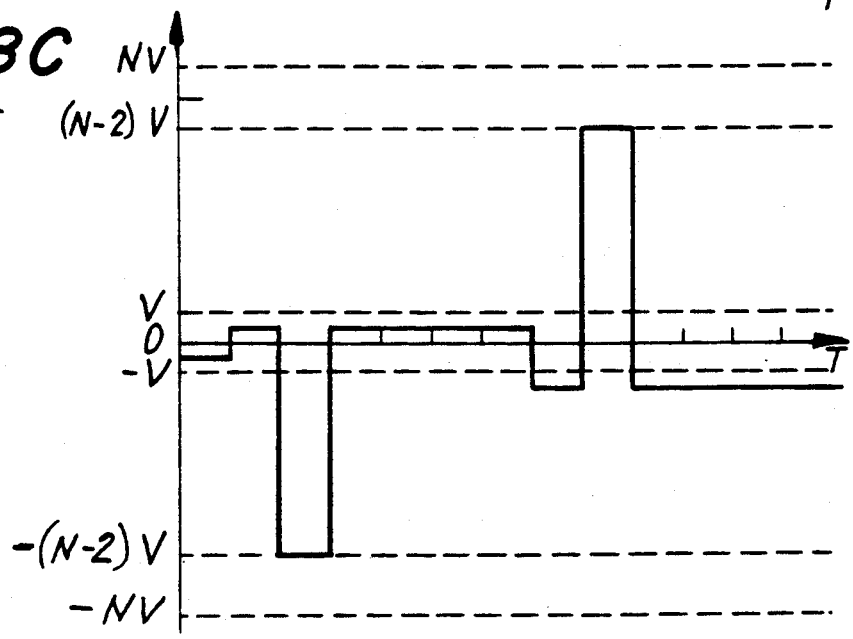
FIG. 18C PRIOR ART
Figure 19:
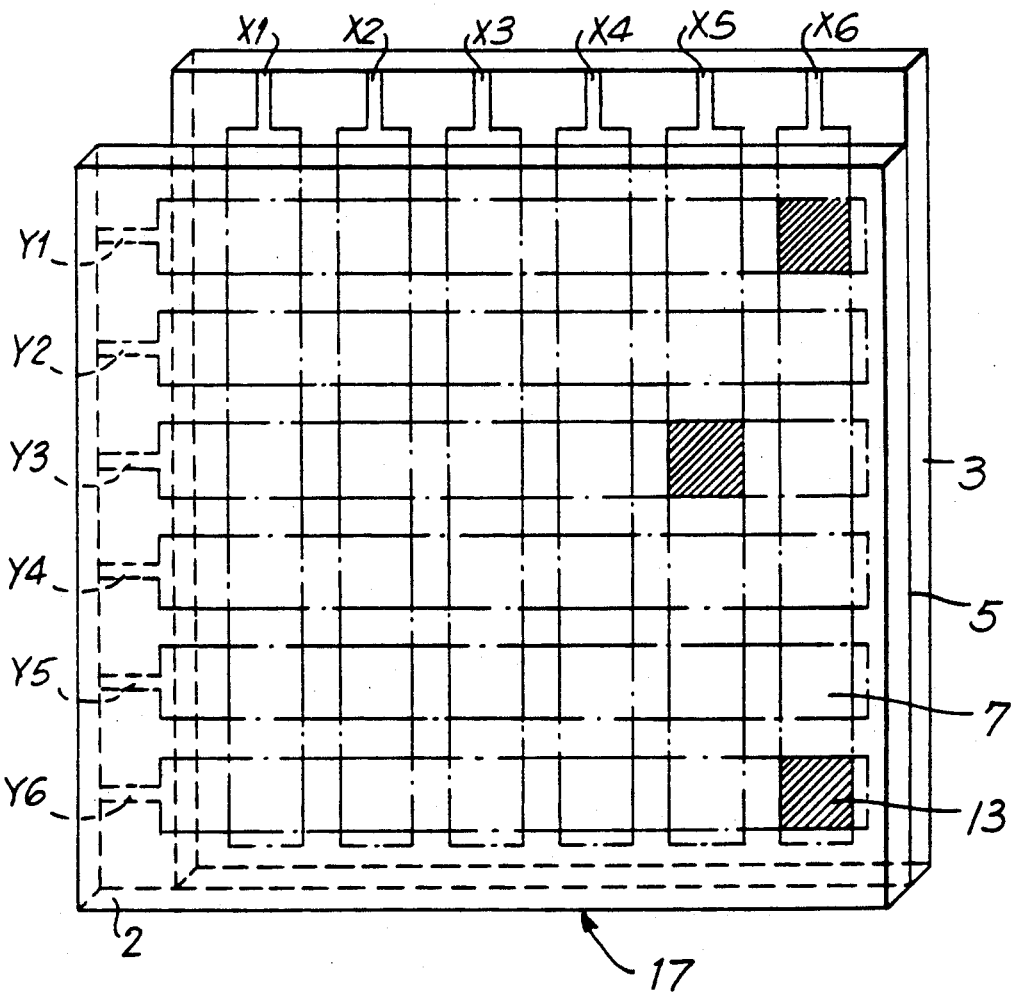
FIG. 19 PRIOR ART
FIG. 19 is a perspective view of the liquid crystal panel wherein another ideal display pattern is formed.
Figure 20:
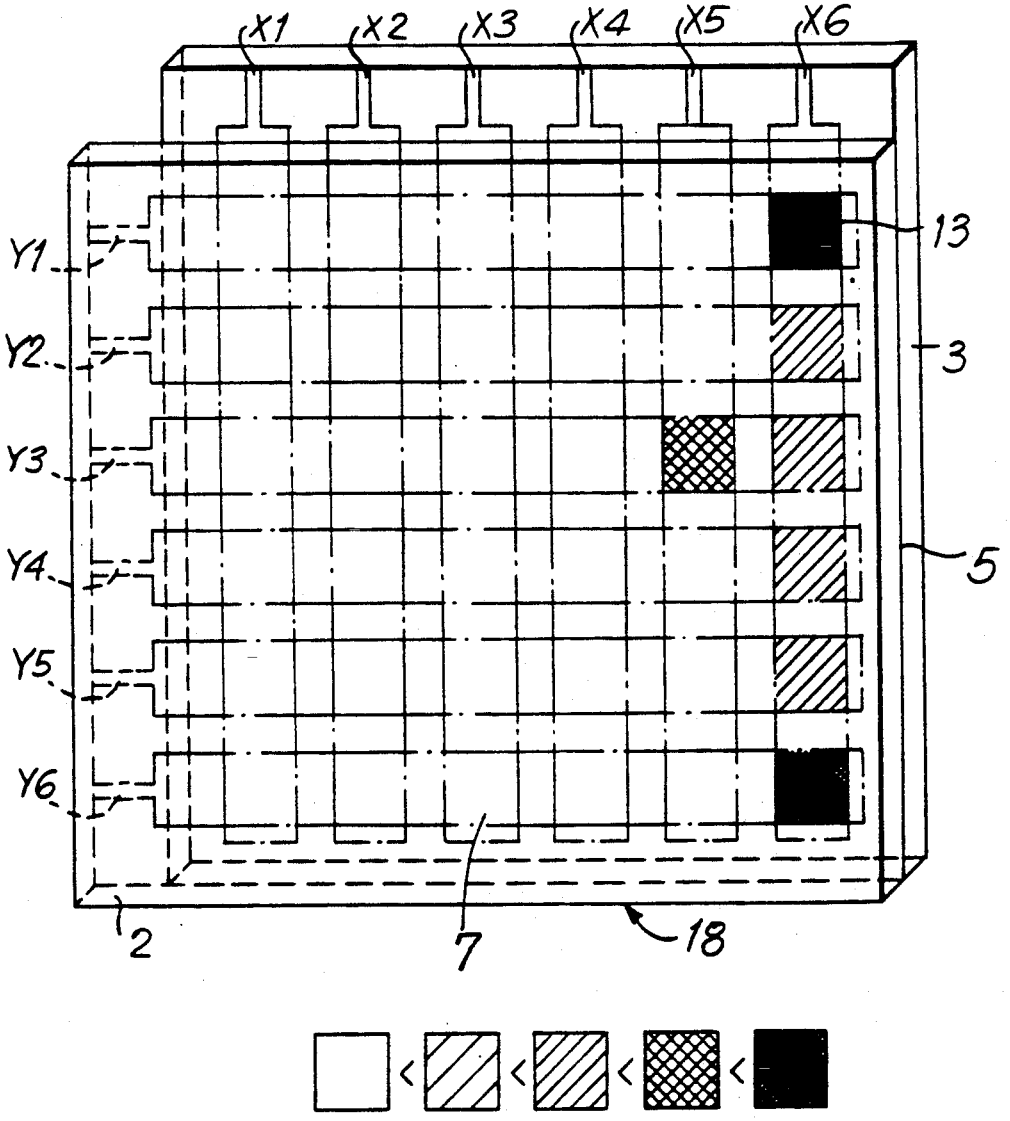
FIG. 20 PRIOR ART
FIG. 20 is a perspective view of the actual display condition when the display pattern of FIG. 19 is formed.
Figure 21A:
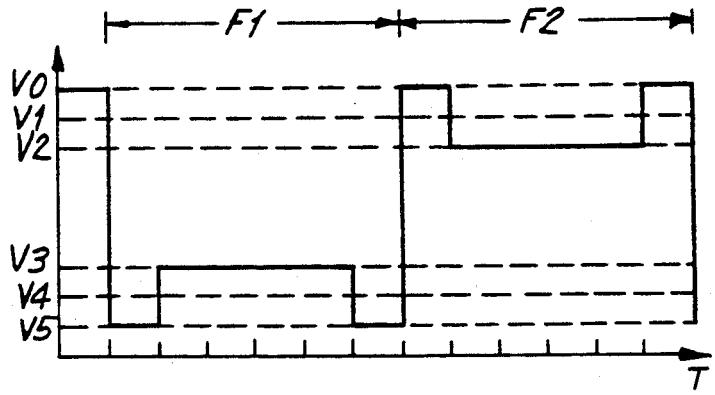
FIG. 21A PRIOR ART
FIGS. 21A–21C and 22 are graphs of waveforms of the voltage actually applied to the liquid crystal panel at the time of forming the display pattern of FIG. 19.
Figure 21B:
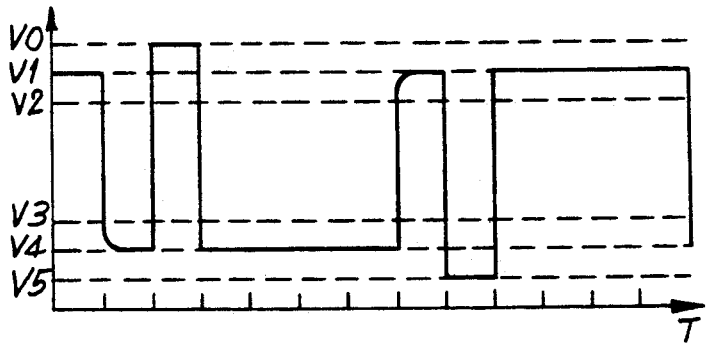
FIG. 21B PRIOR ART
Figure 21C:
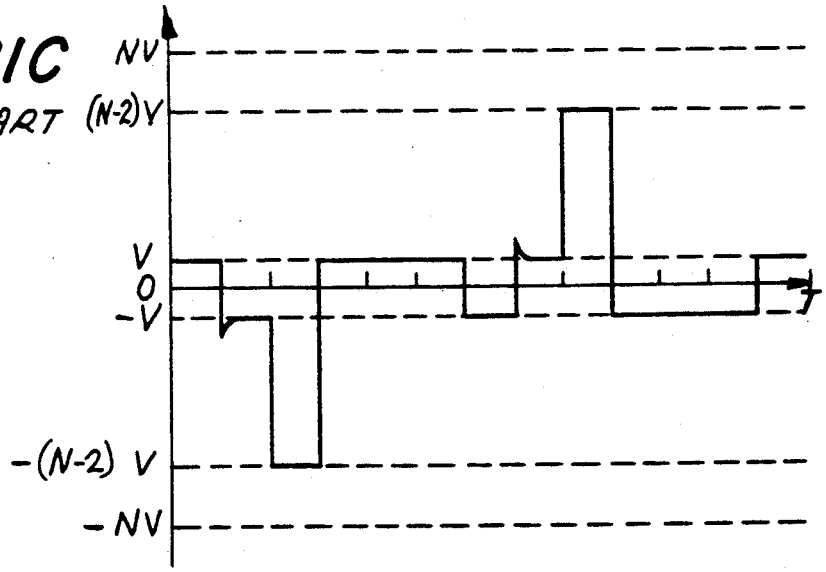
FIG. 21C PRIOR ART
Figure 22:
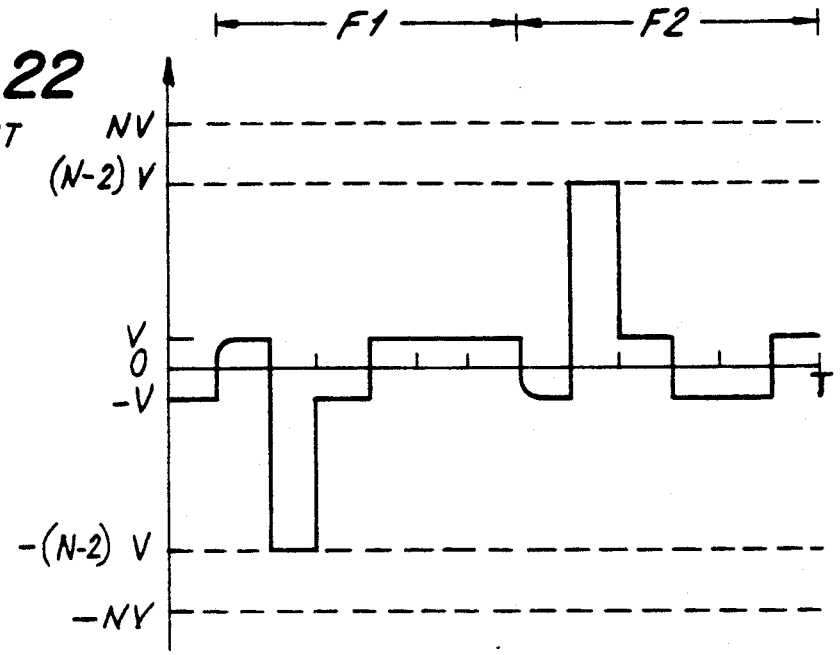
FIG. 22 PRIOR ART
Figure 26:
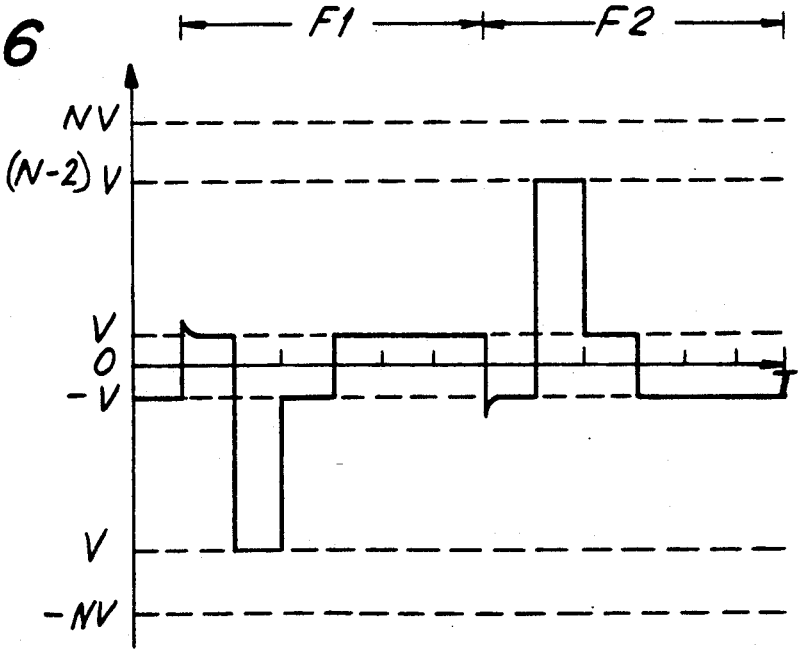
FIG. 26 PRIOR ART
FIGS. 25A–25C and 26 are waveforms of the voltage actually applied to the liquid crystal panel at the time of forming the display pattern of FIG. 23.
Figure 23:
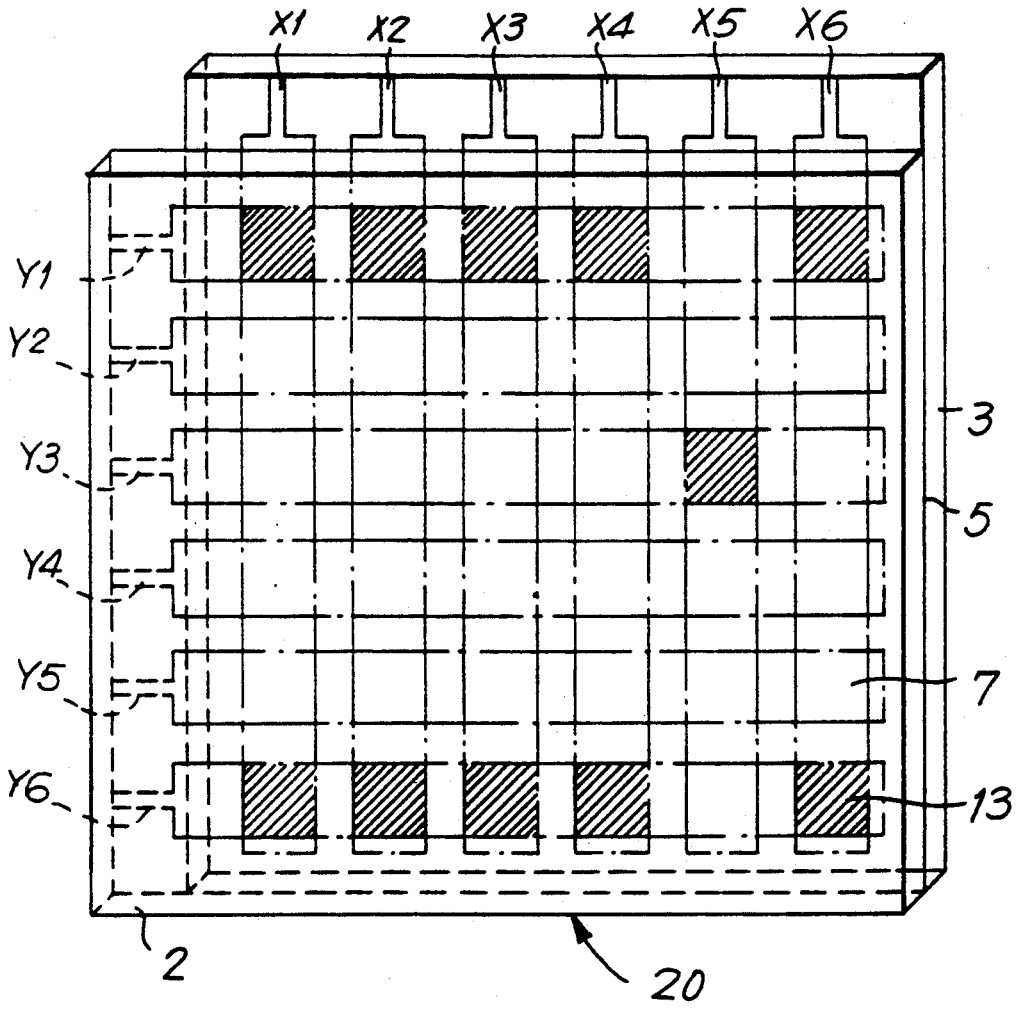
FIG. 23 PRIOR ART
FIG. 23 is a perspective view of a liquid crystal panel wherein another ideal display pattern is formed.
Figure 24:
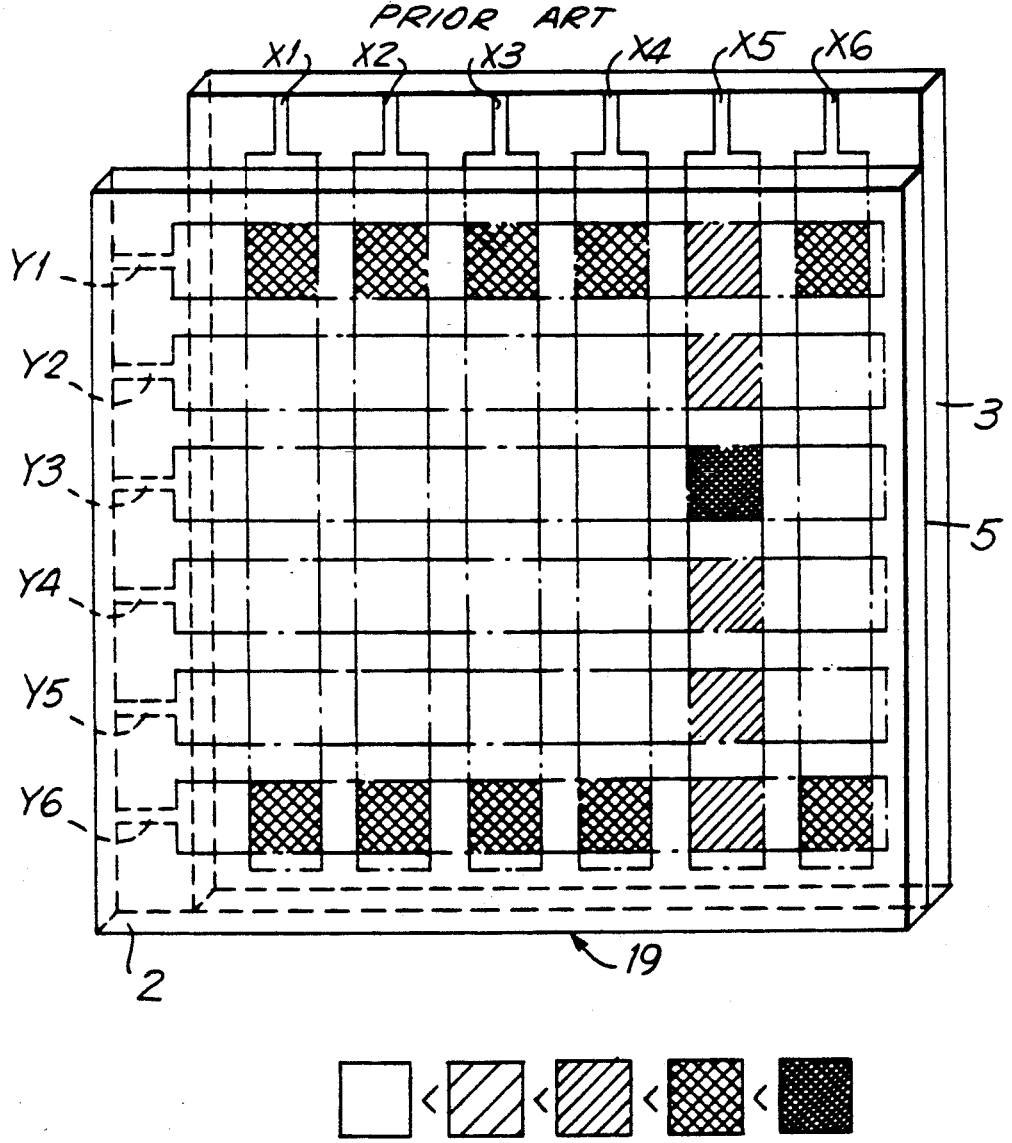
FIG. 24 PRIOR ART
FIG. 24 is a view showing the actual display condition when the display pattern of FIG. 23 is formed.
Figure 25A:
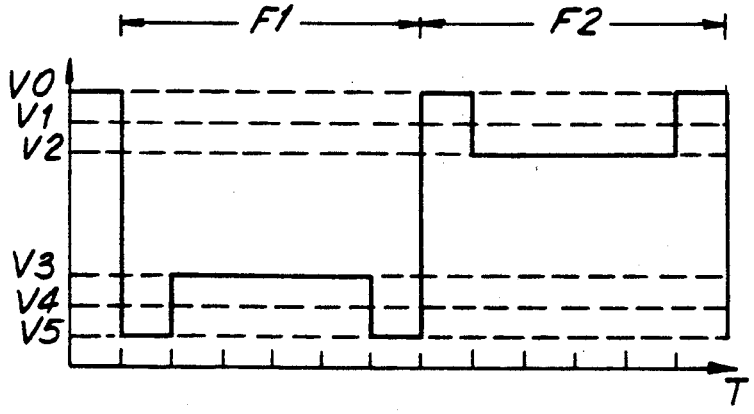
FIG. 25A PRIOR ART
Figure 25B:
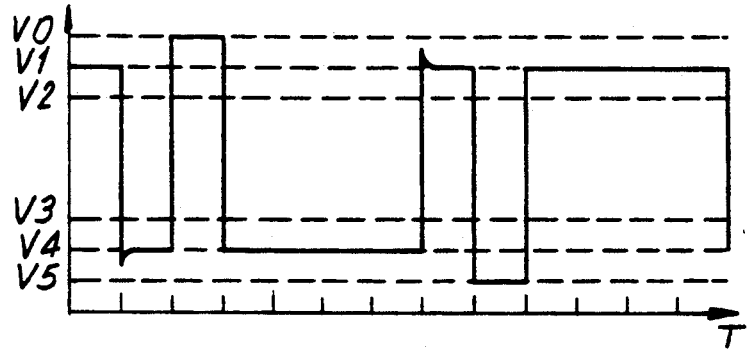
FIG. 25B PRIOR ART
Figure 25C:
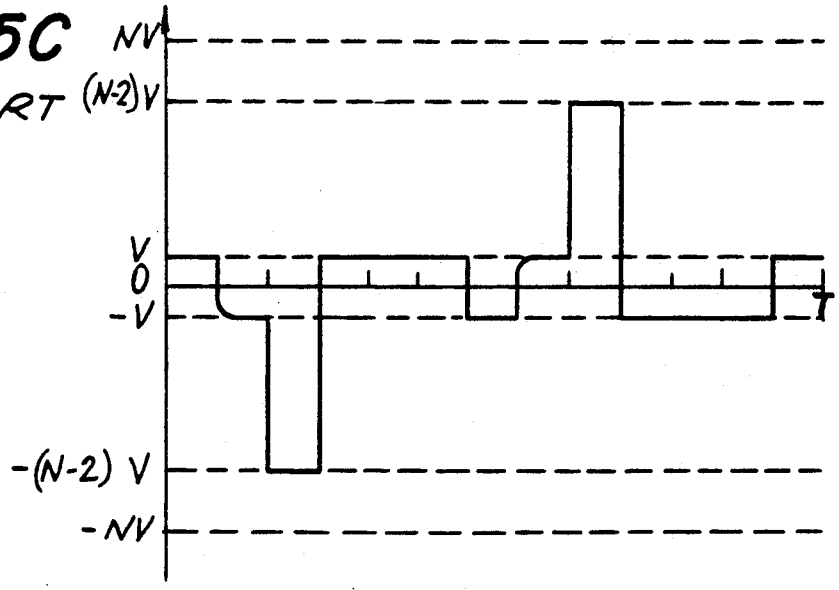
FIG. 25C PRIOR ART
Figure 27:
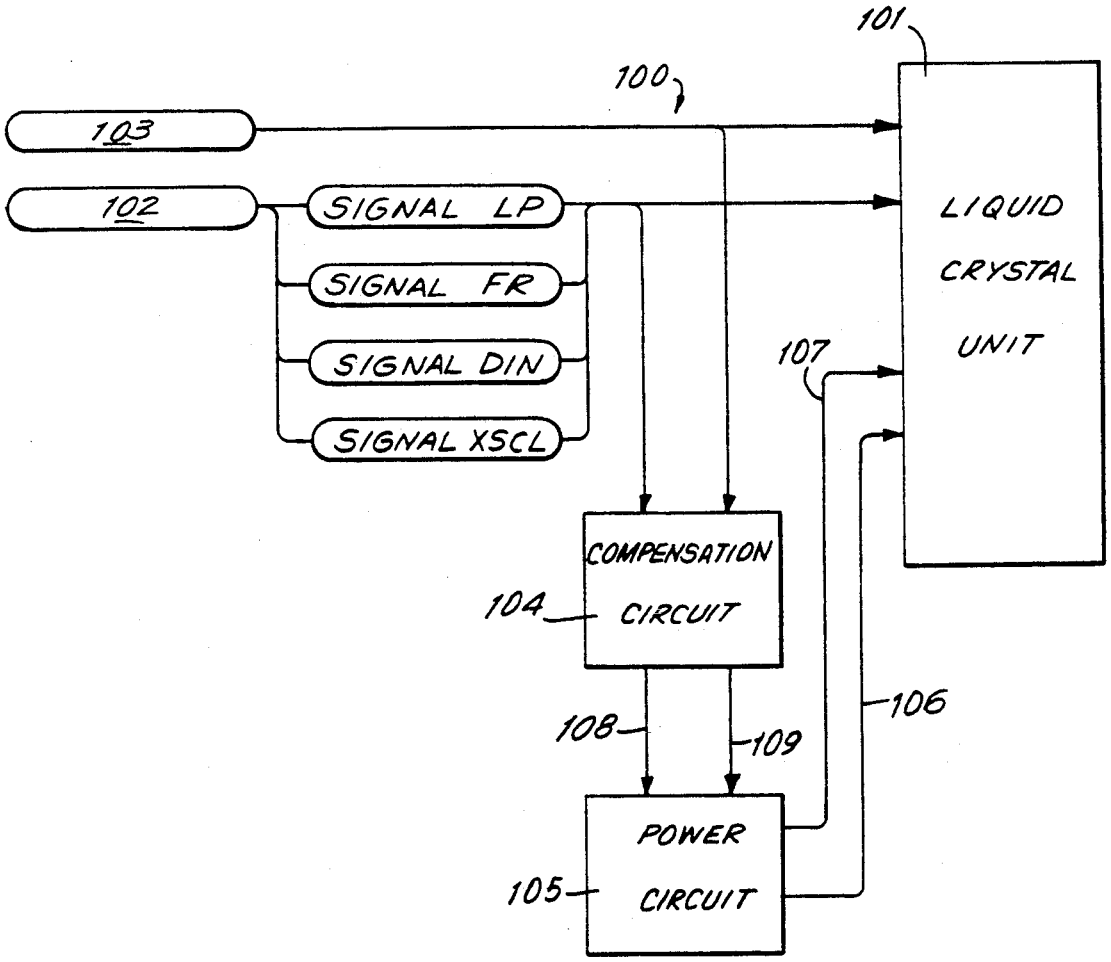
FIG. 27 is a block diagram of the liquid crystal display device constructed in accordance with the present invention.

Reference is made to FIGS. 27 through 34 in which a liquid crystal display device (LCD), generally indicated as 100, for eliminating zebra crosstalk is provided. As mentioned above, the degree of zebra crosstalk is based upon the difference I ($I=N_{ON}-M_{ON}$) between the number of ON dots $N_{ON}$ on the common electrode which is to be selected next and the number of ON dots $M_{ON}$ on the common electrode which is presently selected. Accordingly, during operation of the liquid crystal display device, a waveform compensation value based upon the value of I must be calculated to eliminate zebra crosstalk.

To make this compensation LCD 100 includes a liquid crystal unit 101 having a liquid crystal panel and corresponding driving circuit. A combined control signal 102 for controlling the liquid crystal display device composed of a plurality of signals include a latch signal LP, a frame signal FR, a data-in signal DIN, an X driver shift clock signal XSCL and others (not shown) is input into liquid crystal unit 101. A data signal 103 is also input in liquid crystal unit 101.

LCD 100 also includes a waveform compensation signal generating compensation circuit 104 which receives control signal 102 and data signal 103. Compensation circuit 104 calculates the value of I and transmits a sign signal 108 indicating the sign of I and a strength signal 109 indicating the absolute value of I. Strength signal 109 is in an active condition during the period corresponding to the absolute value of I.

A power circuit 105 receives strength signal 109. Power circuit 105 produces a common electrode driving power source (Y power source) 106, supplying voltage to liquid crystal unit 101 in accordance with sign signal 108 and the strength signal 109. Simultaneously, power source 105 produces a segment electrode driving power source (X power source) 107. Power circuit 105 also performs the voltage compensation of Y power source 106.

The operation of LCD 101 is now explained below. Compensation circuit 104 first receives data signal 103 during the period when a common electrode is selected. Compensation circuit 104 calculates the number of ON dots $N_{ON}$ on the common electrodes presently selected and the number of ON dots $M_{ON}$ on the common electrode which is to be selected next, and the difference between the number of ON dots $N_{ON}$ on the common electrode which is presently selected and the number of ON dots $M_{ON}$ on the common electrode, the value of I. When the switch is made between successive selected common electrodes, the resulting sign and absolute value of I are output as sign signal 108 and strength signal 109, respectively. At the same time, the received $M_{ON}$ value is stored as the number of ON dots, $N_{ON}$, on the common electrode which is presently selected. Power circuit 105 compensates the voltage of Y power source 106 in accordance with sign signal 108 and strength signal 109.

Due to the above operation, the display unevenness resulting from the zebra crosstalk on the liquid crystal panel can be prevented. To compensate the applied voltage, a predetermined voltage is applied to the spike shaped noise generated in the driving waveform applied to the liquid crystal panel in a direction which cancels the noise for a period corresponding to the strength of the noise. The direction of the predetermined voltage is determined by sign signal 108, while the period for using the predetermined voltage is determined by strength signal 109.

Figure 28:
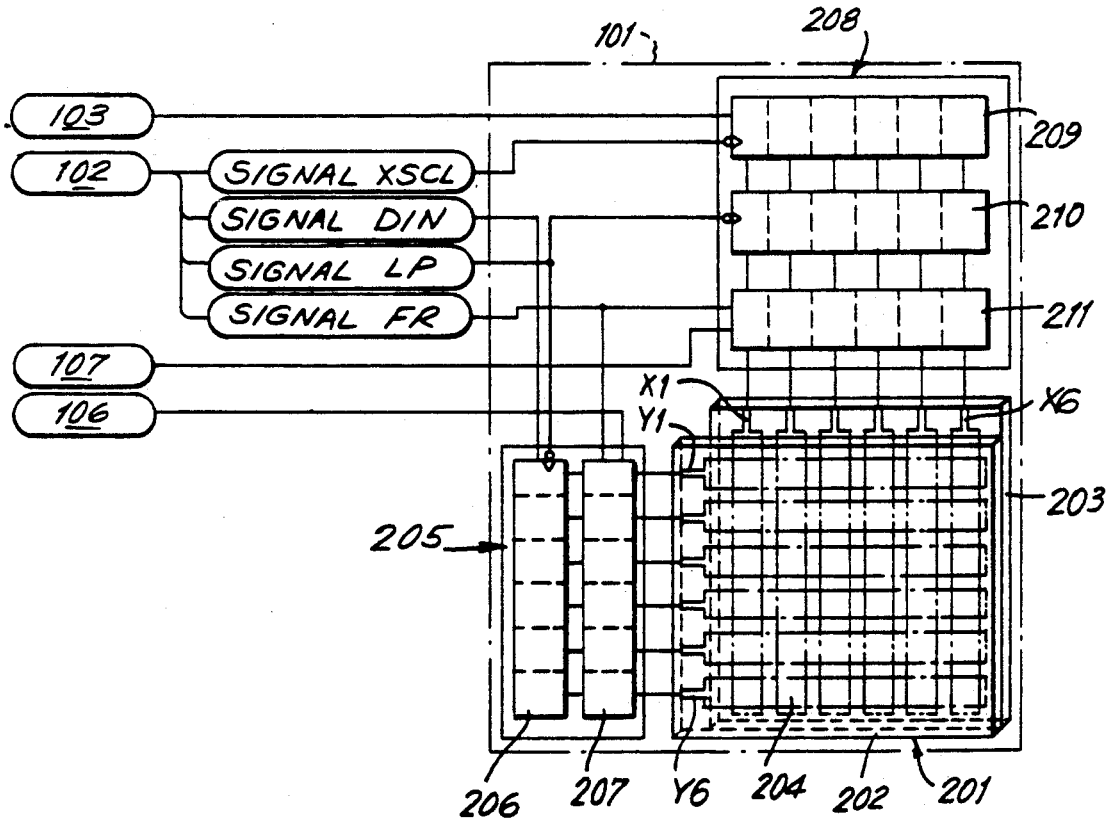
FIG. 28 is a schematic diagram of a liquid crystal unit constructed in accordance with the invention.

As seen from FIG. 28 liquid crystal unit 101 includes a liquid crystal panel 201, having a plurality of common electrodes Y1 through Y6 horizontally oriented on substrate 202 and a plurality of segment electrodes X1 through X6 vertically oriented on a substrate 203. A liquid crystal layer 215 is sandwiched between substrates 202 and 203. Common electrodes Y1 through Y6 and segment electrodes X1 through X6 intersect each other, forming a display dot 204 at each intersection, forming a crystal panel having a 6×6 dot structure. This size is by way of example only for ease of explanation, the size of liquid crystal panel 201 may be larger or smaller.

A common electrode driving circuit 205 comprises a shift register circuit 206 and a level shifter circuit 207. Shift register circuit 206 receives signal DIN and provides an output to level shifter circuit 207. Level shifter 207 also receives signal FR and power signal 106 as inputs. The output from level shifter circuit 207 is introduced to each common electrode Y1 through Y6 of the liquid crystal panel 201.

A segment electrode driving circuit 208 comprises a shift register circuit 209, a latch circuit 210 and a level shifter circuit 211. Shift register circuit 209 receives signal XSCL and data signal 103 and provides an output to latch circuit 210. Latch circuit 210 also receives signal DIN and provides an output to level shifter circuit 211. Level shifter circuit 211 also receives signal FR and power signal 107 as inputs. The output from level shifter circuit 211 is introduced to each segment electrode X1 through X6 of liquid crystal panel 201.

Figure 29:
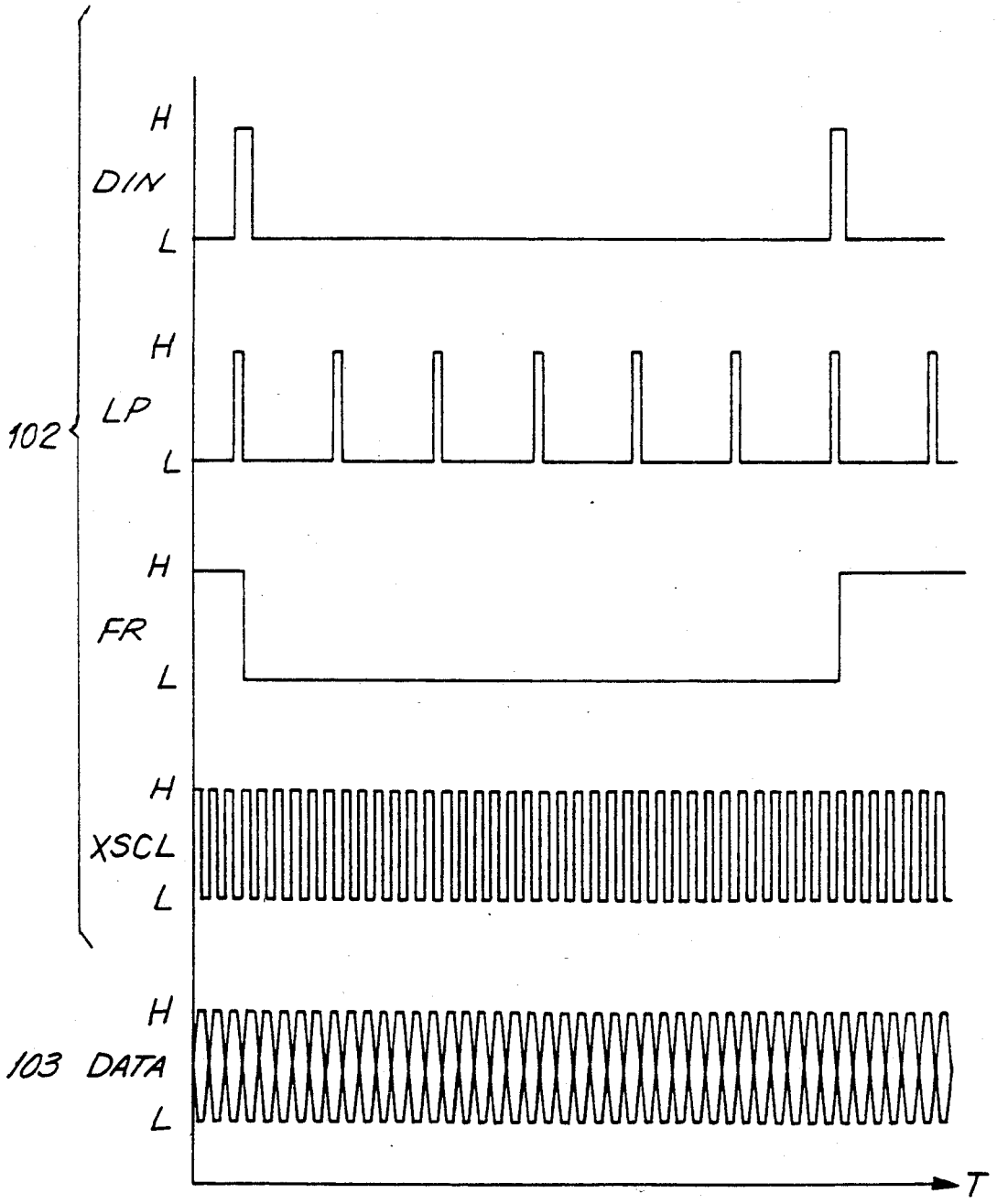
FIG. 29 is a timing chart for the control signal and the data signal in accordance with the present invention.

Reference is made to FIG. 29 wherein a timing chart showing each signal DIN, LP, FR, XSCL of the control signal 102 and the data signal 103 is provided. Signals DIN and LP act as the data clock and shift clock, respectively, for shift register circuit 206 of common electrode driving circuit 205. Signal DIN is input to shift register circuit 206 at the falling edge of signal LP triggering the transmission of signal DIN.

Signal DIN has "H" as an active element, i.e., when signal DIN is generated. Signal DIN is sequentially output over an interval corresponding to the number of common electrodes Y1 through Y6 of liquid crystal panel 201 or a number of occurrences of the signal LP larger than the number of common electrodes Y1 through Y6 in the normal case. The "H" data passes through shift register circuit 206, while the "L" data passes through the others. Depending upon the content of shift register circuit 206, the selected voltage is supplied to common electrodes Y1 through Y6 by level shifter circuit 207 during an active period and the non-selected voltage is supplied to common electrodes Y1 through Y6 during the passive period. The selected voltage and the non-selected voltage are supplied from Y power source 106.

Data signal 103 and signals XSCL and LP act as the data and shift clock of shift register circuit 209 of segment electrode driving circuit 208, and the latch clock of latch circuit 210. Data signal 103 acts as a signal for determining whether display dot 204 on the next common electrode to be selected is ON or OFF during the period when the common electrode of the liquid crystal panel 201 is selected. Data signal 103 indicates the ON state. Data signal 103 is received in shift register circuit 209 at the falling edge of signal XSCL. Data signal 103 thus corresponds to the display dots on the common electrode which is next to be selected during the period when a common electrode is presently selected. When the receipt of data signal 103 in accordance with the signal XSCL is terminated, the contents of shift register circuit 209 is received in latch circuit 210 at the falling edge of signal LP. Then, in the active case, the ON voltage is supplied to segment electrodes X1 through X6 by shift register circuit 211. Conversely, in the passive case, the OFF voltage is supplied to the segment electrodes X1 through X6. The ON voltage and OFF voltage are supplied by X power source 107.

Additionally, signal FR (frame signal) is input to driving circuits 205, 208 to achieve alternating driving of liquid crystal panel 201. Signal FR switches in response to the falling edge of signal LP, and switches the selection of the potential of the driving voltage. Namely, the driving voltage includes two sets of selected and non-selected voltages, and ON and OFF voltages, which are switched by frame signal FR.

The above structure of the liquid crystal unit 101 and the driving method therefor is only by way of example for explaining the present invention. The structure of liquid crystal unit 101 is not limited to the structure.

Figure 30:
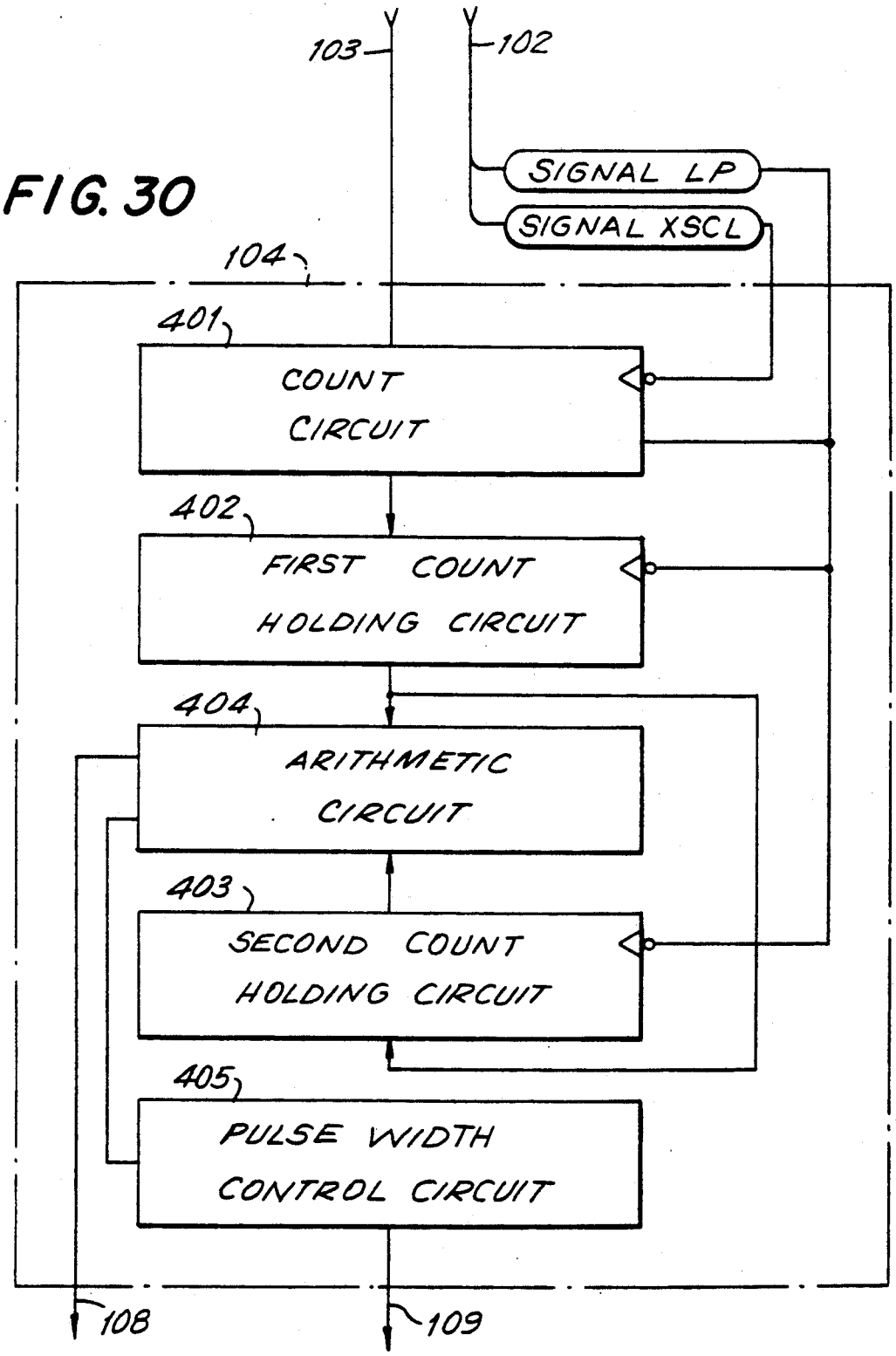
FIG. 30 is a block diagram of a compensation circuit in accordance with the present invention.

Reference is now specifically made to FIG. 30 in which a block diagram of compensation circuit 104 is provided. A count circuit 401 receives data signal 103 and counts the number of ON dots within the display dots 204 on the (n+1)th common electrode during the period when the nth common electrode of the liquid crystal panel 201 is selected. Counter circuit 401 counts the number of ON dots on the (N+1)th common electrode by counting the number of dots from the falling edge of signal LP of control signal 102 to the falling edge of the next signal LP when data signal 103 is active at the falling edge of signal XSCL. The count value of the counter circuit 401 is reset to zero, while the discrete counted value is output to a first counter holding circuit 402 at the time of falling edge of signal LP. The counting is begun again and repeats successively. It is not always necessary to count every dot unit if circumstances require, for example, if the number of segment electrodes X1 through X6 were as high as 640, there is no noticeable loss in performance even with a counting error set as high as ±16 dots.

First counter holding circuit 402 receives the count value just before the count value of counter circuit 401 becomes zero at the falling edge of signal LP. At the same time, a second counter holding circuit 403 receives the count value from first counter holding circuit 402, wherein the discrete value is transferred just before first counter holding circuit 402 receives the next count value from counter circuit 401, at the falling edge of the signal LP. Accordingly, when first counter holding circuit 402 receives the number of ON dots $M_{ON}$ of display dots 204 on the (n+1)th common electrode, second counter holding circuit 103 receives the number of ON dots $N_{ON}$ of display dots 204 on the nth common electrode.

First counter holding circuit 402 and second holding counter circuit 403 output their respective $M_{ON}$ and $N_{ON}$ values to an arithmetic circuit 404. Arithmetic circuit 404 calculates the difference between the value of $M_{ON}$ and $N_{ON}$ produced from first and second counter holding circuits 402 and 403, namely $I = N_{ON} - M_{ON}$, and outputs the sign of I as sign signal 108, and at the same time, the absolute value of I is output to a pulse width control circuit 405.

Pulse width control circuit 405 outputs the active signal for a period corresponding to the absolute value of I, which is input from the arithmetic circuit 404, as strength signal 109. Pulse width control circuit 405 outputs strength signal 109 at the falling edge of signal LP. However, the above signal is not output at the falling edge of signal LP when the signal FR is changing.

The width W of strength signal 109 is related to the absolute value of I through an increment function: $W = a_k \times I^k + b_k \times I^k$, where $a_k$ and $b_k$ are constants and K is 0, 1, 2, 3 . . . . The above width W can be differentiated for both positive and negative values of I. In this embodiment, $W = a_l \times I$ and is defined regardless of whether the value of I is positive or negative.

Figure 31:
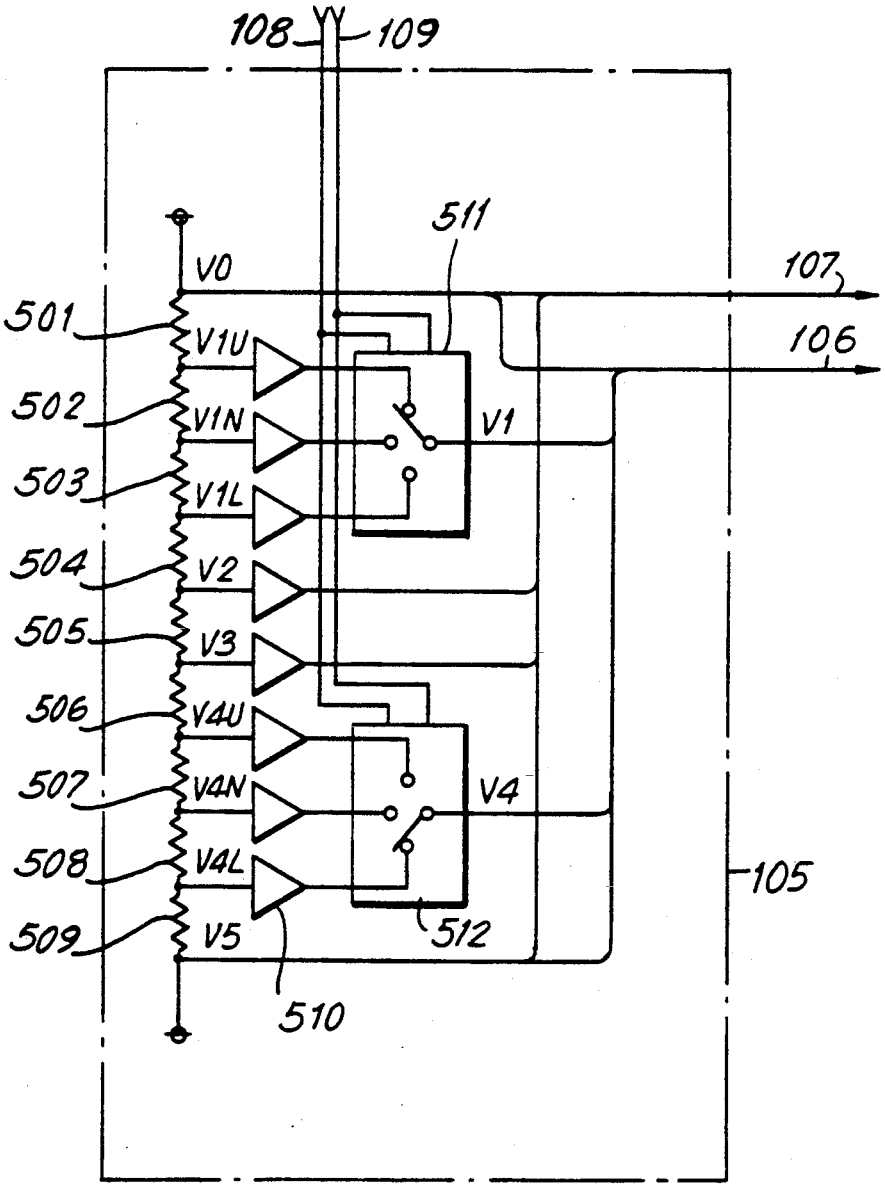
FIG. 31 is a circuit diagram of the power circuit in accordance with the present invention.

Reference is now specifically had to FIG. 31 in which a circuit diagram of the voltage power circuit 105 is provided. A plurality of resistors 501 through 509 are serially connected and a voltage V0 and a voltage V5 are supplied at the ends of the resistors providing a series of voltage dividers thereof. If the resistance value of each resistor 501 through 509 are defined as R1 through R9, respectively, the relation is $$R1 = R9 \quad R2 = R8$$
$$R3 = R7. \quad R4 = R6$$
and:
$$R1 + R2 = R3 + R4 = R9 + R8 = R7 + R6 = R5/(n - 4).$$
($n$ is a constant)

Therefore, if the voltage at the end of each respective resistor 501 through 509 is defined as V0, V1U, V1N, V1L, V2, V3, V4U, V4N, V4L, and V5, the following relationships occur.

$$V0 - V1N = V1N - V2 = V4N - V5 = V3 - V4N = (V2 - V3)/(n - 4)$$
$$K1 = (V1U - V1N)/(V0 - V1N) = (V4N - V4L)/(V4N - V5)$$
$$K_2 = (V1N - V1L)/(V0 - V1N) = (V4U - V4N)/(V4N - V5)$$
($n$ is a constant).

Wherein, the resistance value of each resistors 501 through is set so that the relation of K1 and K2 satisfies the condition of $0 < K2, K1 \leqq 1$.

A respective voltage circuit 510 for stablizing divided voltages V1U, V1N, V1L, V2, V3, V4U, V4N, and V4L formed by each resistor 501 through 509, is provided at the junction of the respective resistors, having the same voltage as the input voltage but having a low impedance. In an exemplary embodiment stabilizing circuit 510 includes an operational amplifier having a voltage follower circuit construction.

A switch 511 and a switch 512 are provided. Both receive sign signal 108 and strength signal 109 as inputs. Switches 511 and are switched in accordance with the inputs of sign signal 108 and strength signal 109. Switch 511 selects between voltage inputs V1U, V1N and V1L, while switch 512 selects between V4U, V4N and V4L.

Where strength signal 109 is active and sign signal 108 is positive, switches 511 and 512 are switched to the voltage V1U and the voltage V4L, respectively. When strength signal 109 is active and sign signal 108 is positive, switches 511 and 512 are switched to the voltage V1L and the voltage V4U, respectively. When strength signal 109 is passive, switches 511 and 512 are switched to the voltage V1N and the voltage V4N, respectively. Each voltage is output from switches 511 and 512 as the output voltages V1 and V4 respectively. Voltages V1 and V4, and the voltages V0 and V5 are output as Y power source 106. Additionally, the voltages V0, V2, V3, and V5 are output as the X power source 107. Accordingly, Y power source 106 is comprised of the voltages V0, V1, V4, and V5; the X power source is comprised of the voltages V0, V2, V3, and V5. The voltages are output to liquid crystal unit 101 as a combination of two groups of voltages.

Namely, one set of voltage is as follows.

The voltage V0 of Y power source 106 (selected voltage)

The voltage of V4 of Y power source 106 (non-selected voltage)

The voltage V5 of X power source 107 (ON voltage)

The voltage V3 of X power source 107 (OFF voltage)

The other set of voltage is as follows.

The voltage V5 of Y power source 106 (selected voltage)

The voltage V1 of Y power source 106 (non-selected voltage)

The voltage V0 of X power source 107 (ON voltage)

The voltage V2 of X power source 107 (OFF voltage)

Switching between the two sets of voltages is periodically controlled by signal FR of control signal 102 in the common electrode driving circuit 205 and the segment electrode driving circuit 208.

According to the above structure, when I has a positive value and the selection between common electrodes Y1 through Y6 changes from nth electrode to the (n+1)th electrode, Y power source 106 outputs voltages V1U and V4L during the period corresponding to absolute value of I. When the value of I is negative, Y power source 106 outputs voltages of V1L and V4U to the liquid crystal unit 101 during the period corresponding to the absolute value of I. Further, the voltages V1N and V4N are output as voltages V1 and V4 when strength signal 109 is passive including when I equals zero.

Reference is now made to FIGS. 32 through 35 in which a display and input waveforms for forming the display are provided. FIGS. 33A–33C show one example of the voltage waveform applied to form the displayed pattern of FIG. 32. The waveform of FIG. 33A is the voltage waveform which is applied to segment electrode X4 for forming display dot 601. FIG. 33B is the voltage waveform which is applied to common electrode Y3 for forming display dot 601. FIG. 33C shows the combination voltage waveform derived from FIGS. 33A, 33B which is applied to display dot 601.

Figure 33A:
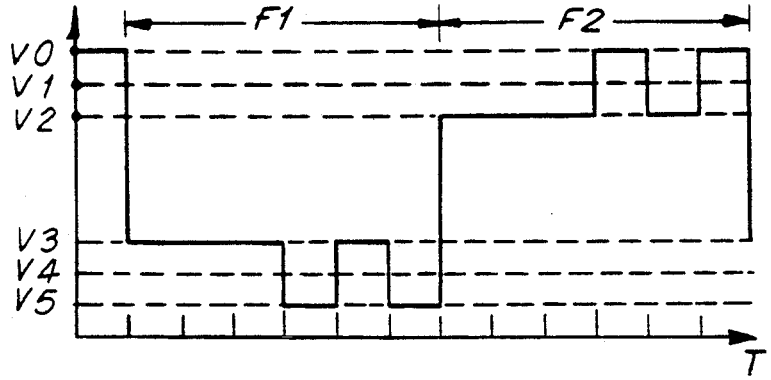
FIGS. 33A–33C are graphs of the voltage waveform applied to form the pattern of FIG. 32.
Figure 33B:
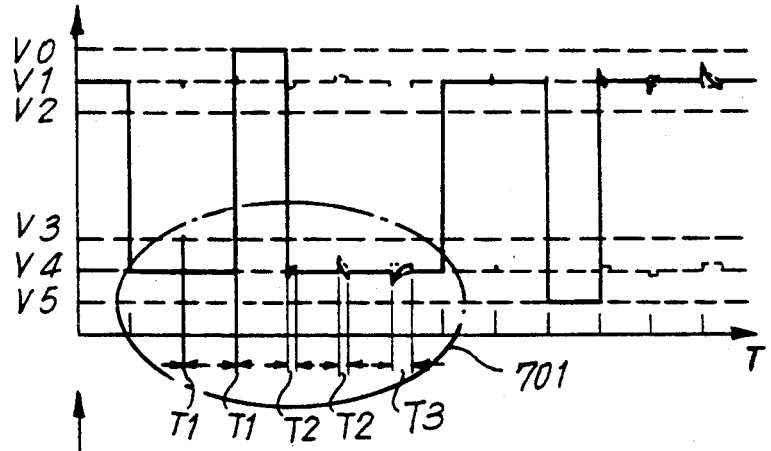
Figure 33C:
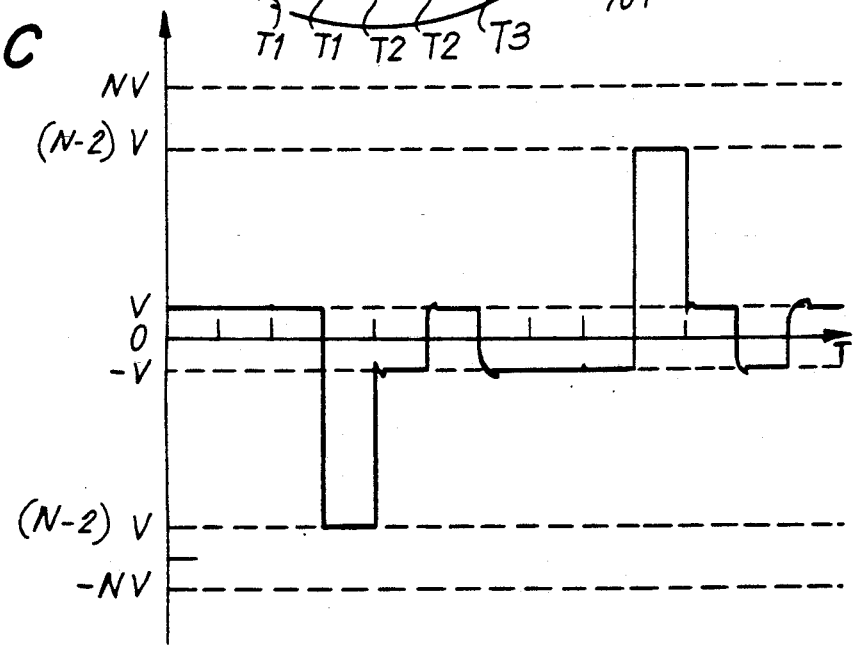

The voltages indicated by the dashed lines in FIGS. 33A and 33B indicate voltages V0, V2, V3, and V5 of X power source 107 and voltages V0, V1, V4 and V5 of Y power source 106.

Figure 34:
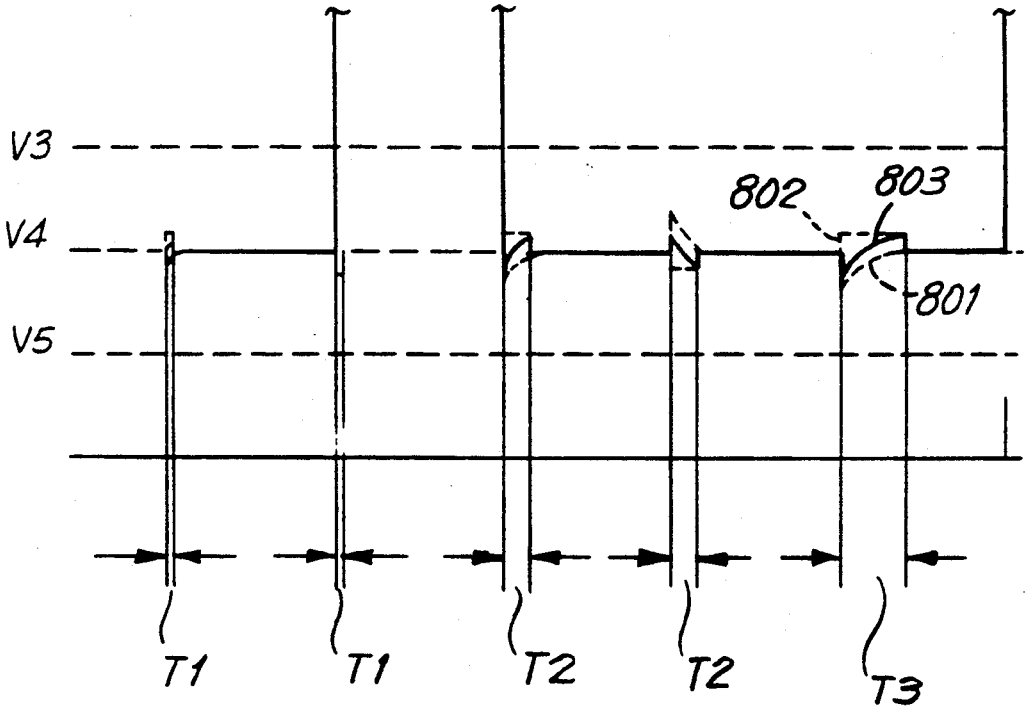
FIG. 34 is a partial exploded view of the waveform of FIG. 33B.

Reference is made to FIG. 34 in which the portion indicated by the circled area 701 in FIG. 33B is shown.

A spike shaped noise voltage 801 tends to occur in the common electrode. A changeable non-selected voltage 802 is formed by Y power source 106. Voltages 801 and 802 are combined to form voltage 803.

Figure 32:
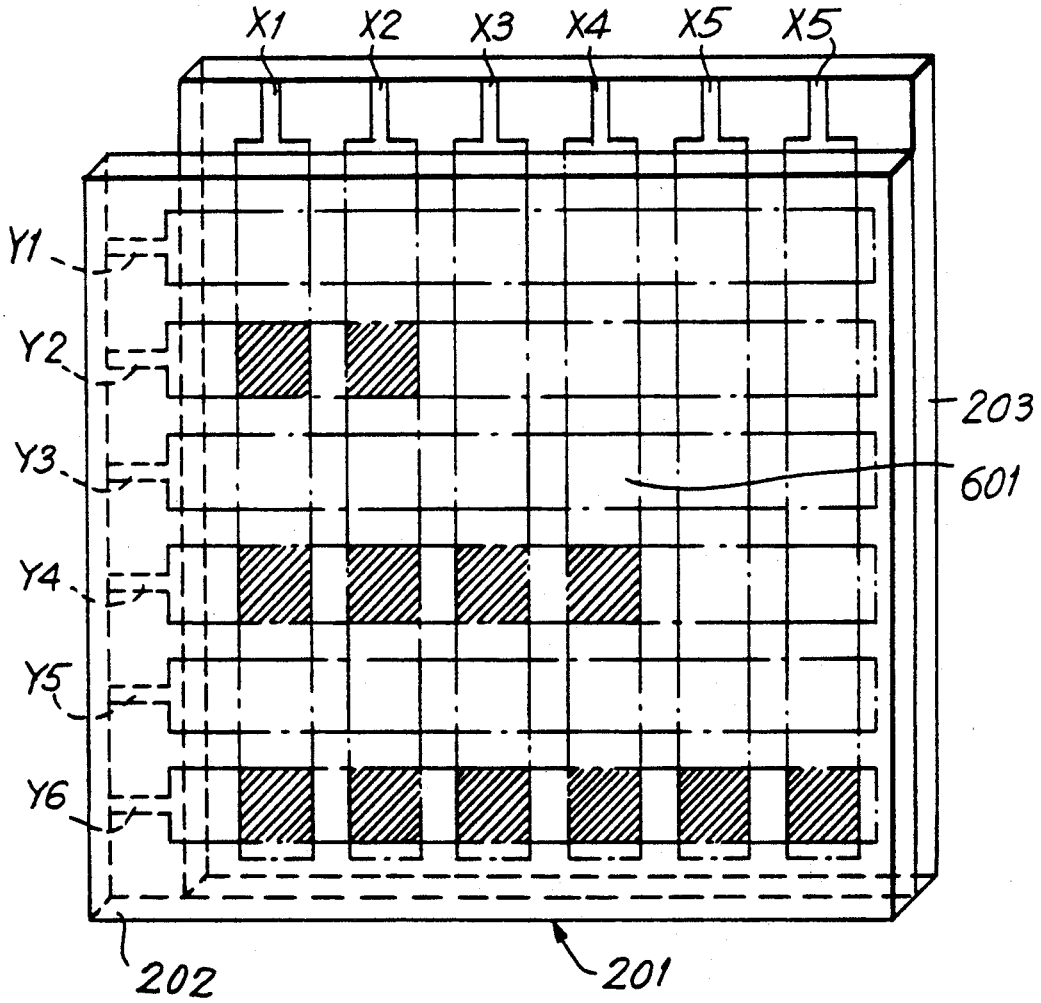
FIG. 32 is a perspective view of a liquid crystal panel wherein display pattern is displayed.

When the pattern of FIG. 32 is displayed, the difference I between the number of ON dots $N_{ON}$ on the nth common electrode and the number of ON dots $M_{ON}$ on the (n+1)th common electrode at the time of changing the selection from the nth common electrode to (n+1)th common electrode is as follows. When the selection moves from the first common electrode Y1 to the second common electrode Y2, I=−2; when the selection moves from the second common electrode Y2 to the third common electrode Y3, I=2; when the selection moves from the third common electrode Y3 to the fourth common electrode Y4, I=−4; when the selection moves from the fourth common electrode Y4 to the fifth common electrode Y5, I=4; when the selection moves from the fifth common electrode Y5 to the sixth common electrode Y6, I=−6; and when the selection moves from the sixth common electrode Y6 to the first common electrode Y1, I=6.

Thus, in accordance with changes from electrode Y1 to electrode Y2, electrode Y2 to electrode Y3, electrode Y3 to electrode Y4 and so on, the noise voltage 801 increases. However, the period for which the non-selected voltage 802 changes in the direction opposed to the noise voltage 801 increases from T1 to T3, so that combined voltage 803 is compensated. Therefore, the voltage applied to display dot 601 is compensated, thereby realizing an improved display without zebra crosstalk. As mentioned above, when the selected common electrode switches from the nth common electrode to the (n+1)th common electrode of liquid crystal panel 201, the non-selected voltage of Y power source 106 is changed for a period in accordance with the difference I between the number of ON dots on the nth common electrode and the number of ON dots on the (n+1)th common electrode, thereby providing an improved display without zebra crosstalk.

The present embodiment provides a structure for changing the period in which the non-selected voltage is increased or decreased to perform the compensation. Hereinafter this is referred to as a time base compensation of the non-selected voltage.

Reference is now made to FIGS. 35 through 39 wherein a second embodiment of a liquid crystal display device for removing zebra crosstalk is provided.

As discussed above, LCD 100 illustrates a way of providing improved display without zebra crosstalk by compensating the time base of the non-selected voltage. However, the same effect can be obtained even though the non-selected voltage is changed by an amount corresponding to the voltage width based upon the value I over a predetermined period.

Figure 35:
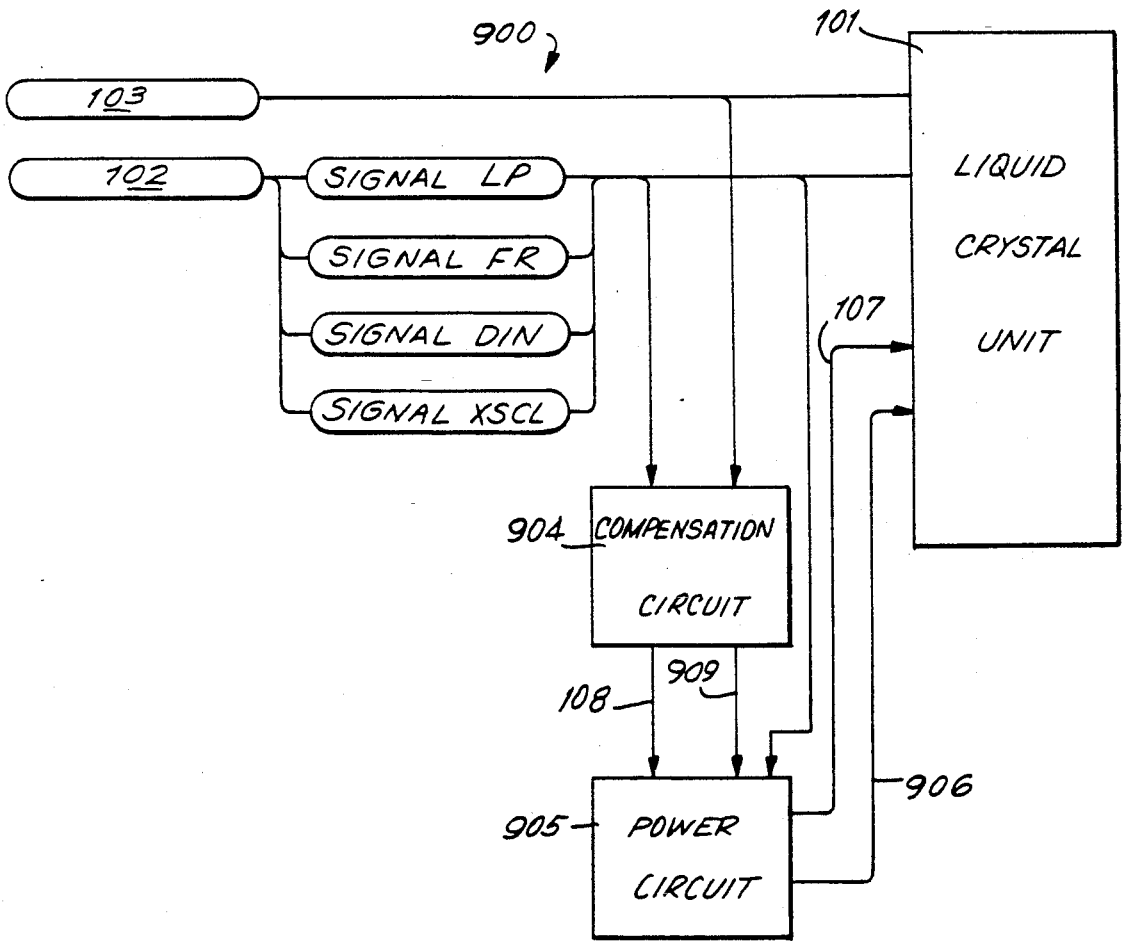
FIG. 35 is a block diagram of a liquid crystal display device in accordance with a second embodiment of the invention.

Reference is now specifically made to FIG. 35 in which a second embodiment of an LCD, generally indicated as 900, is provided. LCD 900 is similar to LCD 100. Like numerals are utilized to indicate like parts, the primary difference being the replacement of compensation circuit 404 and power circuit 105.

A compensation circuit 904 counts the value of I as did compensation circuit 104. The value of I is transmitted to a power circuit 905. Again, the sign of I is sign signal 108 and the absolute value of I is a strength signal 909. Power circuit 905 changes the non-selected voltage of Y power source 906 which is input to liquid crystal unit 101. Y power source 906 is input in a direction corresponding to sign signal 108 and a voltage width in accordance with strength signal 909 over a predetermined period.

In accordance with the above method, the non-selected voltage is changed for the voltage width corresponding to the noise strength for a predetermined period in a direction causing the cancellation of the spike shaped noise generated on the common electrodes of liquid crystal panel 201, thereby providing an improved display without zebra crosstalk. Sign signal 108 determines the direction of change and strength signal 909 determines the width of voltage.

Figure 36:
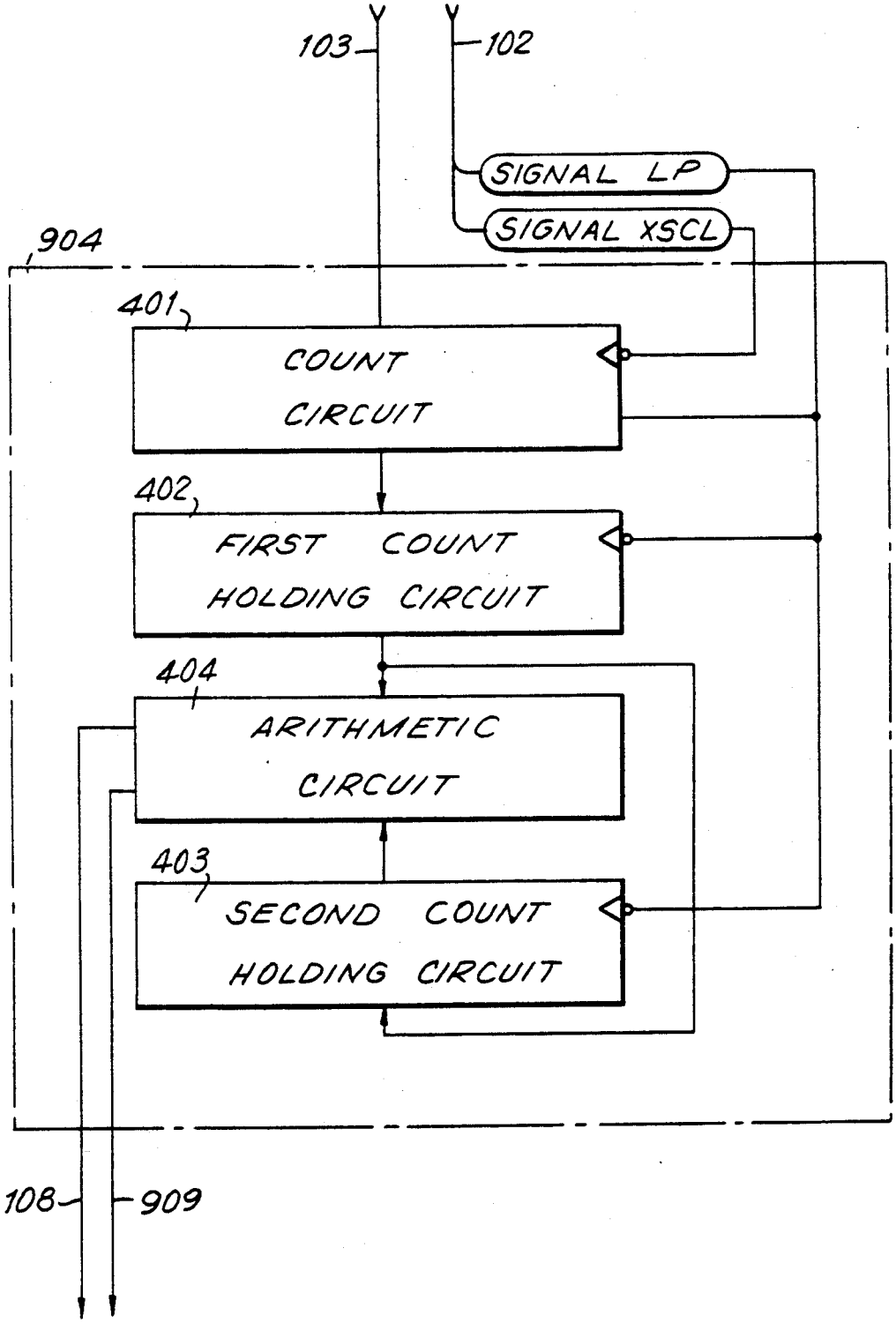
FIG. 36 is a block diagram of a compensation circuit in accordance with the second embodiment of the invention.

Reference is now specifically made to FIG. 36 in which a block diagram for a compensation circuit 904 is provided. Compensation circuit 904 includes a counter circuit 401, a first counter holding circuit 402, a second counter holding circuit 403 and an arithmetic circuit 404 which all function in the same manner as the equivalent structures of compensation circuit 104. Counter circuit 401 counts the number of ON dots from data signal 103. First counter holding circuit 402 and second counter holding circuit 403 store the number of ON dots $M_{ON}$ and $N_{ON}$ on the (n+1)th and nth common electrodes 202, respectively, whereby arithmetic circuit 403 calculates the value of I. Sign signal 108 and strength signal 909 representing the absolute value of I are output in response to signal LP of the control signal 102.

Figure 37:
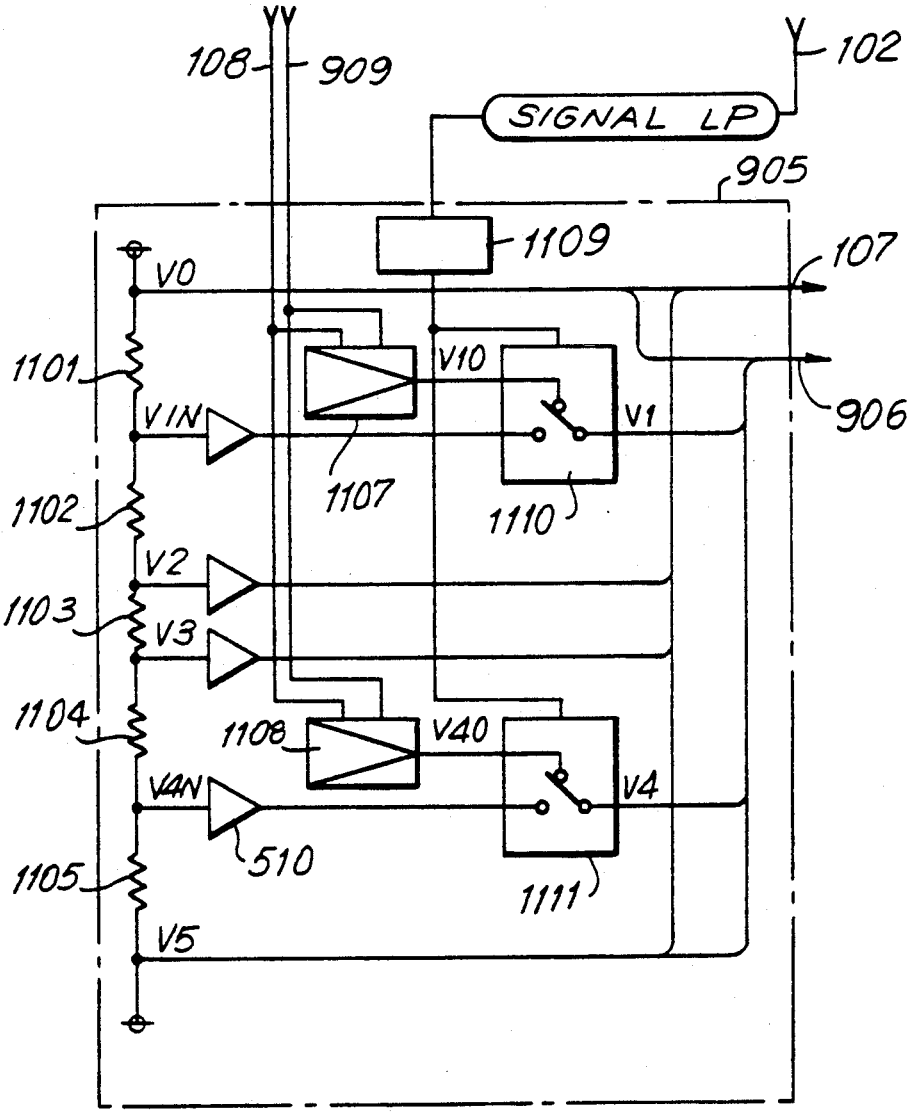
FIG. 37 is a circuit diagram of a power circuit in accordance with the second embodiment of the invention.

Reference is now specifically made to FIG. 37 in which a circuit diagram for power circuit 905 is provided. A plurality of resistors 1101 through 1105 are serially connected. A voltage V0 and V5 are applied at both ends of resistors 1101 through 1105 providing at each coupling of successive resistors.

The resistance value of each resistor 1101 through 1105 is r0, r1, r2, r3, and r4, respectively, and the values are in the following relation:

$$r0 = r1 = r3 = r4$$

$$(n-4) \times r0 = r2 \text{ (n is a constant)}$$

The divided voltage applied at the end portions of each resistor 1101 through 1105 has a respective value V0, V1N, V2, V3, V4N, and V5, which may be expressed by $$V0 - V1N = V1N - V2 = V3 - V4N = V4N - V5 = (V2 - V3)/(n - 4)$$

($n$ is a constant)

Voltages V1N, V2, V3 and V4N are output through a voltage stabilizing circuit 510 as in power circuit 105.

A pair of voltage generating circuits 1107 and 1108 receive sign signal 108 and strength signal 909 and generate a voltage in accordance with the sign signal 108 and strength signal 909. A D/A converter is contained within voltage generating circuits 1107 and 1108. When sign signal 108 indicates a positive value, voltage generating circuit 1107 generates a voltage N1C in which the value of the output voltage shifts relative to the voltage V1N to the voltage V0 side for a voltage width corresponding to the absolute value of I indicated by strength signal 909. Similarly, voltage generating circuit 1108 generates the voltage V4C in which the value of voltage shifts relative to the voltage V4N to the voltage V5 side for a voltage width corresponding to the absolute value of I indicated by strength signal 909. On the other hand, when sign signal 108 indicates a negative value, each voltage generating circuit 1107 and 1108 generates the voltages V1C and V4C, respectively in which each value of voltage shifts to each side of voltage V2 and V3 for a voltage width corresponding to the absolute value of I indicated by strength signal 909.

The size of the above voltage width which varies in accordance with the absolute value of I indicated by strength signal 909 can be changed when the sign I indicated by sign signal 108 is either positive or negative.

A pulse width generating circuit 1109 receives signal LP and generates the signal which triggers the active state only for a predetermined period. The signal is output in response to the signal LP of the control signal 102. However, the signal is not output when signal FR of the control signal 102 is switched.

A switch 1110 selects between the voltage V1N and V1C. A switch 111 selects between voltages V4N and V4C. Additionally, each above switch is switched by the signal output by pulse width generating circuit 1109. Namely, each switch 1110 and 1111 selects the voltages V1C and V4C, respectively, during a predetermined period corresponding to the pulse width when the signal output from pulse width generating circuit 1109 is in the active state. Conversely, when the signal output from pulse width generating circuit 1109 is in the passive state, each voltage is switched to the voltage V1N and the voltage V4N, respectively. The output of switch 1110 is V1 and the voltage output of switch 1111 is V4. Accordingly, voltages V1 and V4 output from the switches 1110 and 1111 change by the value of I for a predetermined period, wherein the direction of change is in accordance with the sign of I and the size of change is in accordance with the absolute value of I.

Power circuit 905 outputs the voltages V1 and V4, and the voltages V0 and V5 as Y power source 906 and outputs the voltages V0, V2, V3, and V5 as X power source 107.

Y power source 906 and X power source 107 output the following two groups of voltages to liquid crystal unit 101.

Namely, one voltage set is;

The voltage V0 of Y power source 906 (selected voltage)

The voltage V4 of Y power source 906 (non-selected voltage)

The voltage V5 of X power source 107 (ON voltage)

The voltage V3 of X power source 107 (OFF voltage), and the other voltage set is;

The voltage V5 of Y power source 906 (selected voltage)

The voltage V1 of Y power source 906 (non-selected voltage)

The voltage V0 of X power source 107 (ON voltage)

The voltage V2 of X power source 107 (OFF voltage).

In the above structure, the non-selected voltage varies in accordance with the value of I for a predetermined period in view of the direction and size of I.

Figure 38A:
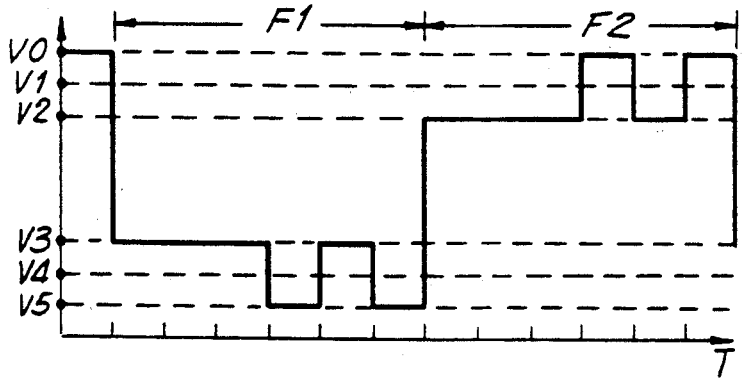
FIGS. 38A–38C are graphs of the voltage waveforms applied for forming the pattern shown in FIG. 32.
Figure 38B:
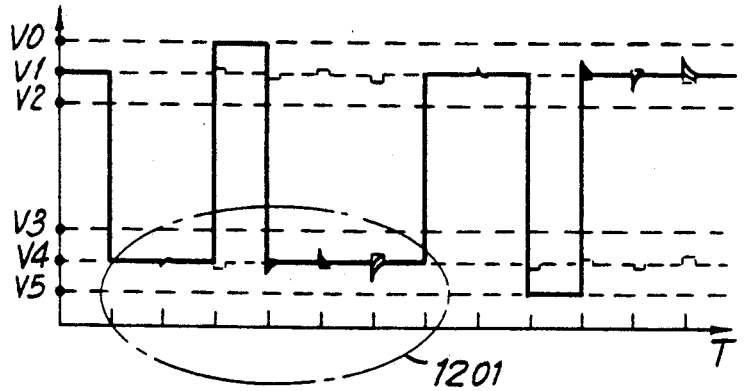
Figure 38C:
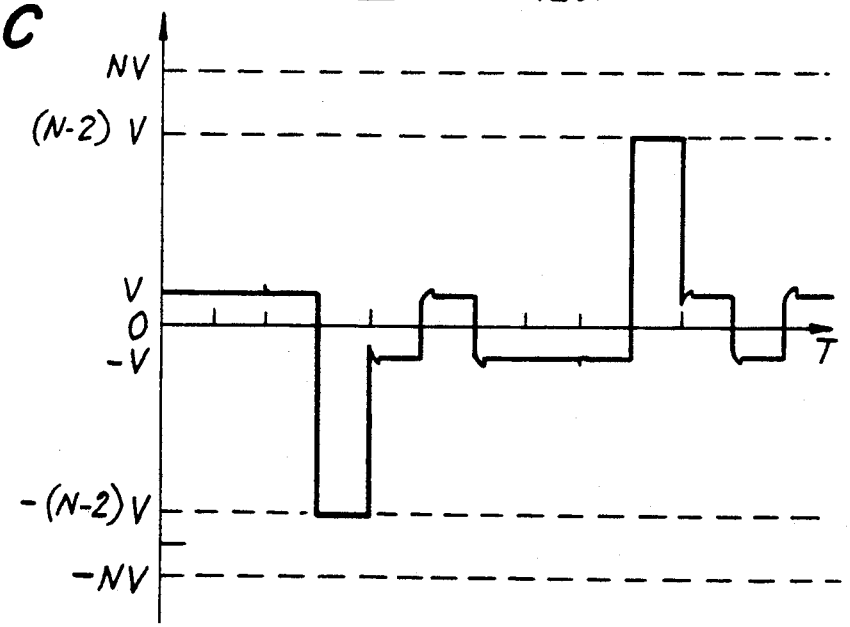
Figure 39:
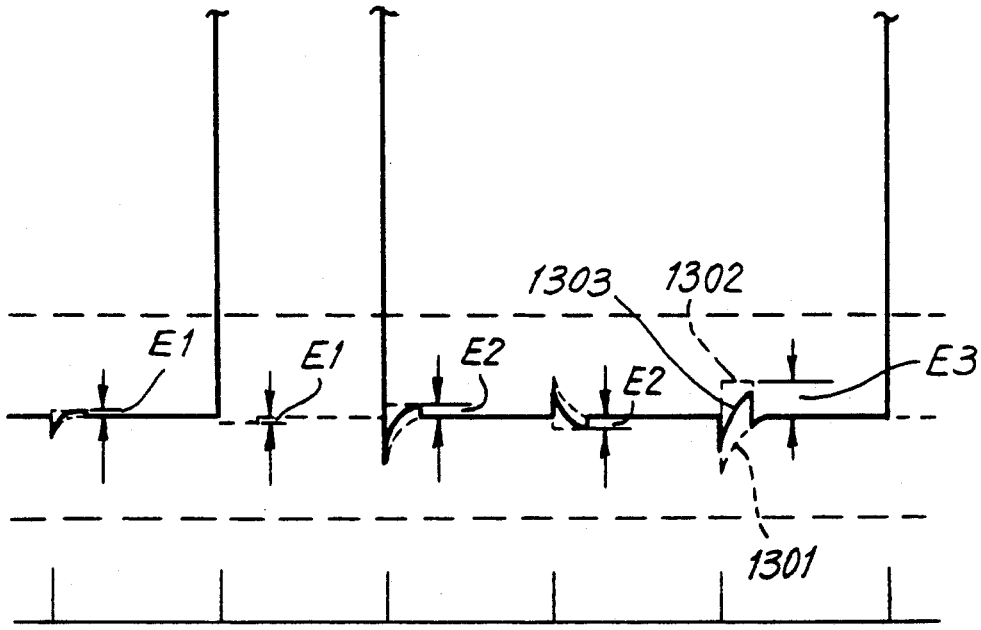
FIG. 39 is a partial exploded view of the waveform of FIG. 38B.

Reference is now made to FIGS. 32, 38 and 39 wherein the operation of LCD 900 is explained in connection with the display pattern of FIG. 32. FIG. 38 shows one example of an applied voltage waveform. FIG. 38A illustrates the segment voltage waveform applied to segment electrode X4 for forming display dot 601. FIG. 38B shows the voltage waveform applied to common electrode Y3 for forming display dot 601. FIG. 38C shows the combined voltage waveform applied at display dot 601. The voltages marked by the dashed lines of FIGS. 38A and 38B show the voltages V0, V2, V3, and V5 of X power source 107 and the voltages V0, V1, V4, and V5 of Y power source 906.

Reference is made to FIG. 39 in which an enlarged portion of FIG. 38B indicated by encircled area 1201 is provided. A spike shaped noise voltage 1301 is generated on the common electrode. A changeable non-selected voltage 1302 is formed by Y power source 906. The voltage widths for changing are marked by E1 through E3. A voltage 1303 is composed of voltages 1301 and 1302.

The difference I between the number of ON dots on the nth common electrode and the number of ON dots on the (n+1)th common electrode at the time when the selected electrode is changed from the nth common electrode to the (n+1)th common electrode is performed as follows: from the first electrode to the second electrode, $I=-2$; from the second electrode to the third electrode, $I=2$; from the third electrode to the fourth electrode, $I=-4$; from the fourth electrode to the fifth electrode, $I=4$; from the fifth electrode to the sixth electrode, $I=-6$; and from the sixth electrode to the first electrode, $I=6$.

As mentioned above, in accordance with the movement from the first electrode to the second electrode, the second electrode to the third electrode, and so on, the noise voltage 1301 increases. The width of non-selected voltages for changing in the direction opposed to the generated noise voltage 1301 for a predetermined period from E1 to E3, also increases, thereby compensating the voltage 1303. Therefore, the voltage added to the display dot 601 is compensated providing an improved display without zebra crosstalk.

As mentioned above, when the selection moves from the nth common electrode of liquid crystal panel 201 to the (n+1)th common electrode, the non-selected voltage of Y power source 906 is changed for a predetermined period in accordance with the difference I between the number of ON dots on the nth common electrode and on the (n+1)the common electrode, thereby providing an improved display without zebra crosstalk.

Accordingly, in the present embodiment, the non-selected voltage is changed for a predetermined period for the voltage width in accordance with the value of I, thereby achieving the necessary compensation. This is known as a voltage base compensation of the non-selected voltage.

Figure 40:
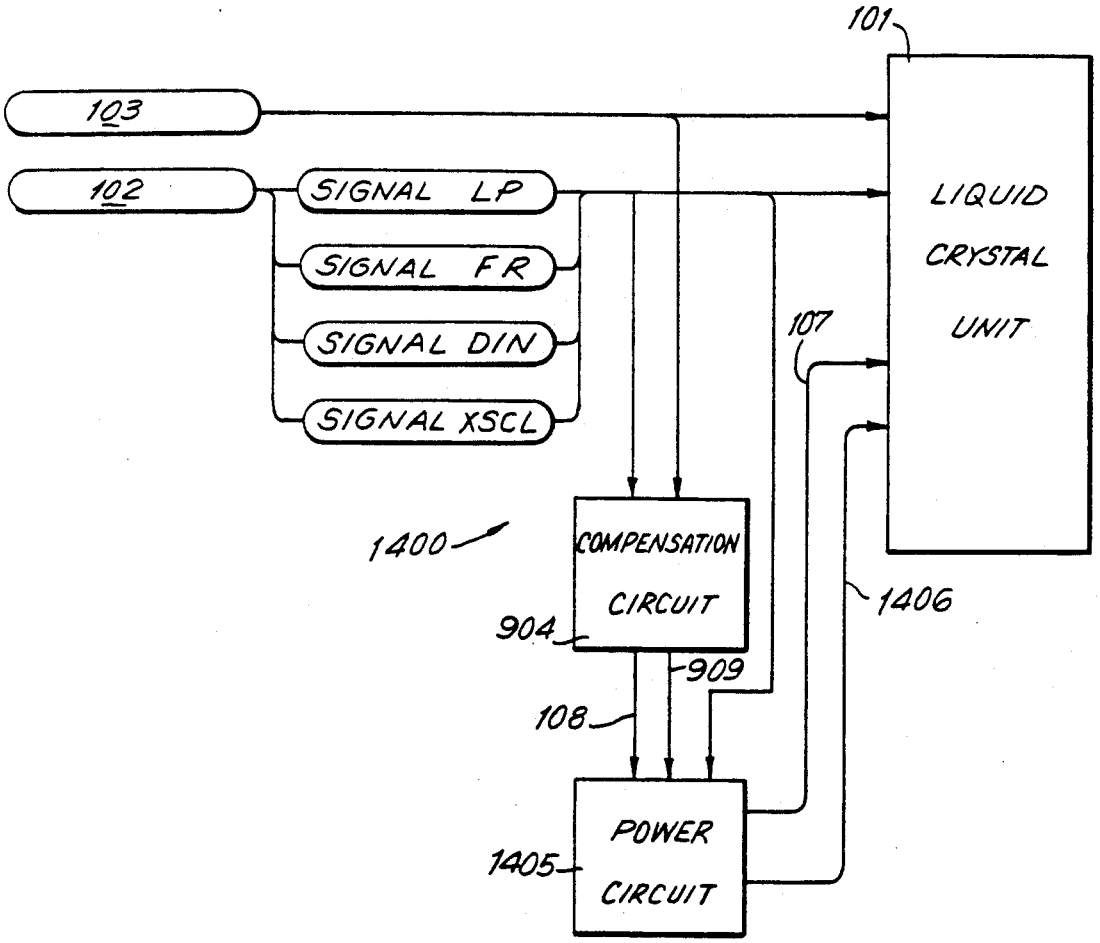
FIG. 40 is a block diagram of the liquid crystal display device in accordance with a third embodiment of the invention.
Figure 41:
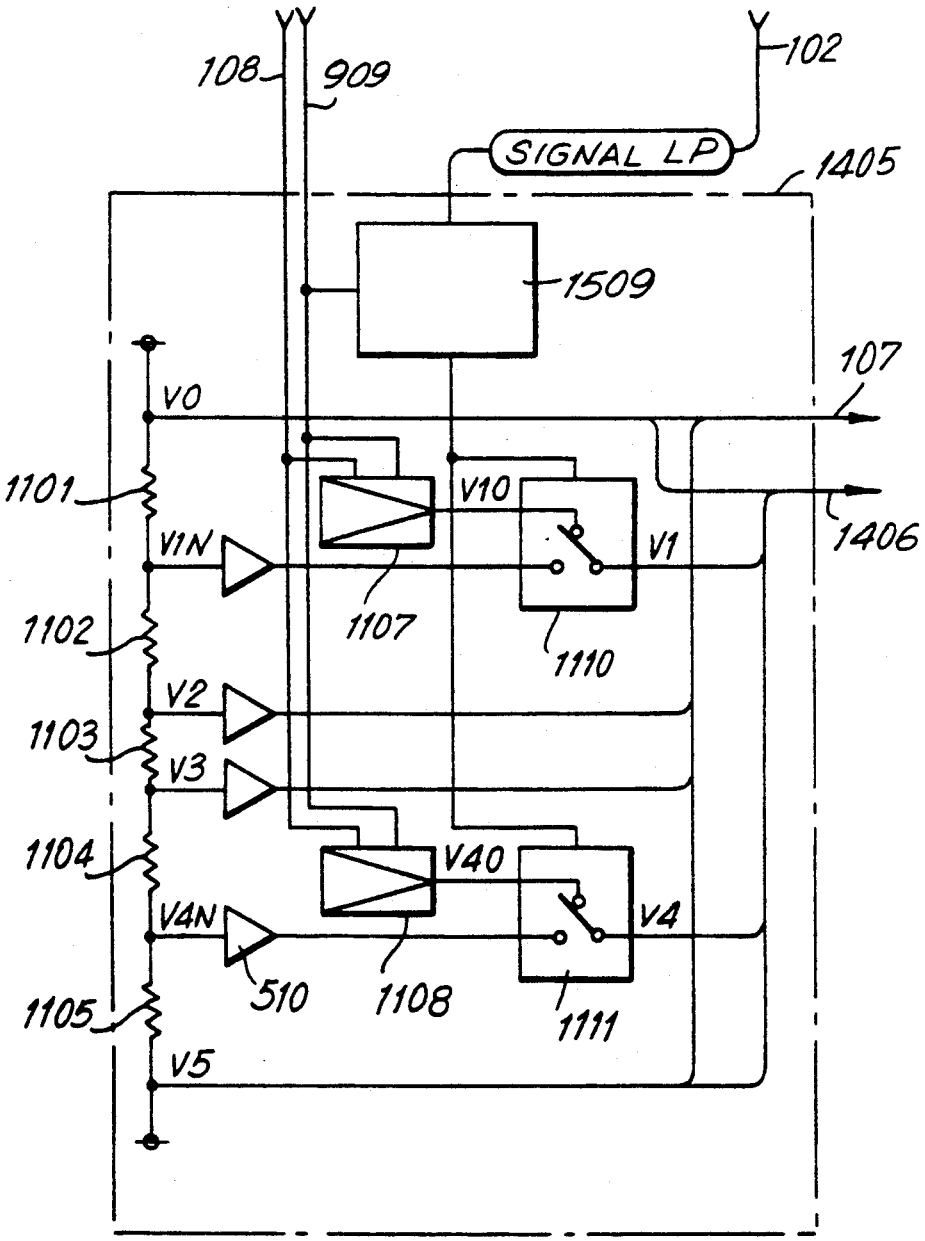
FIG. 41 is a circuit diagram of a power circuit constructed in accordance with the third embodiment of the invention.

Reference is now made to FIGS. 40 and 41 wherein a third embodiment for removing zebra crosstalk for an LCD generally indicated as 1400, is provided.

LCDs 100 and 900 demonstrate a structure for compensating the non-selected voltage by either time or voltage in accordance with the value of I. However, as in LCD 1400, both the period and voltage may be compensated in accordance with the value of I, thereby also obtaining the same effect.

In FIG. 40, the structure and operation of LCD 1400 is the same as LCD 900 with the exception of a power circuit 1405 and a Y power source 1406 formed by power circuit 1405. For the remaining structure like structure are identified by like numerals. FIG. 41 is a circuit diagram for power circuit 1405. The structure and operation of power circuit 1405 is the same as the structure of power circuit 905 with the exception of a pulse width control circuit 1509. For the remaining structure like parts are indicated by like numerals.

Pulse width control circuit 1509 outputs an active signal for the period corresponding to the value of strength signal 909. Pulse width control circuit 1509 is triggered by the falling edge of signal LP of control signal 102. However, the signal is not output when signal FR of control signal 102 is switched. The signal from pulse width control circuit 1509 controls switches 1110 and 1111, and switches the switches 1110 and 1111 for a period corresponding to the value of I.

LCD 1400 allows the period and voltage width of the non-selected voltage of Y power source 1406 to be changed in accordance with the value of I, thereby compensating the noise voltage generated in liquid crystal panel 201. Thereby, an improved display without zebra crosstalk can be realized as in LCD 100 and LCD 900. As mentioned above, in LCD 1400, the non-selected voltage is compensated in accordance with I. This is referred to as a time-voltage base compensation.

In the circuits of the above embodiments, spike shaped noise waveforms generated on the common electrodes of the liquid crystal panel 201 are compensated by applying a square-shaped waveforms to the common electrodes. However, the generated noise waveform, in fact, is spike shaped, rather than square-shaped. The generated noise waveform is a waveform based upon the voltage generated from a differentiating circuit and is defined by an exponential function. The differentiating circuit comprises the resistors of the common and segment electrodes of liquid crystal panel 201 and a capacitor of liquid crystal layer 215. Accordingly, to more accurately compensate the voltage waveform, the voltage waveform having a peak value according to the value I and having a shape similar to the generated noise waveform is applied to the non-selected voltage, thereby making it possible to provide an improved display quality without zebra crosstalk.

Figure 42:
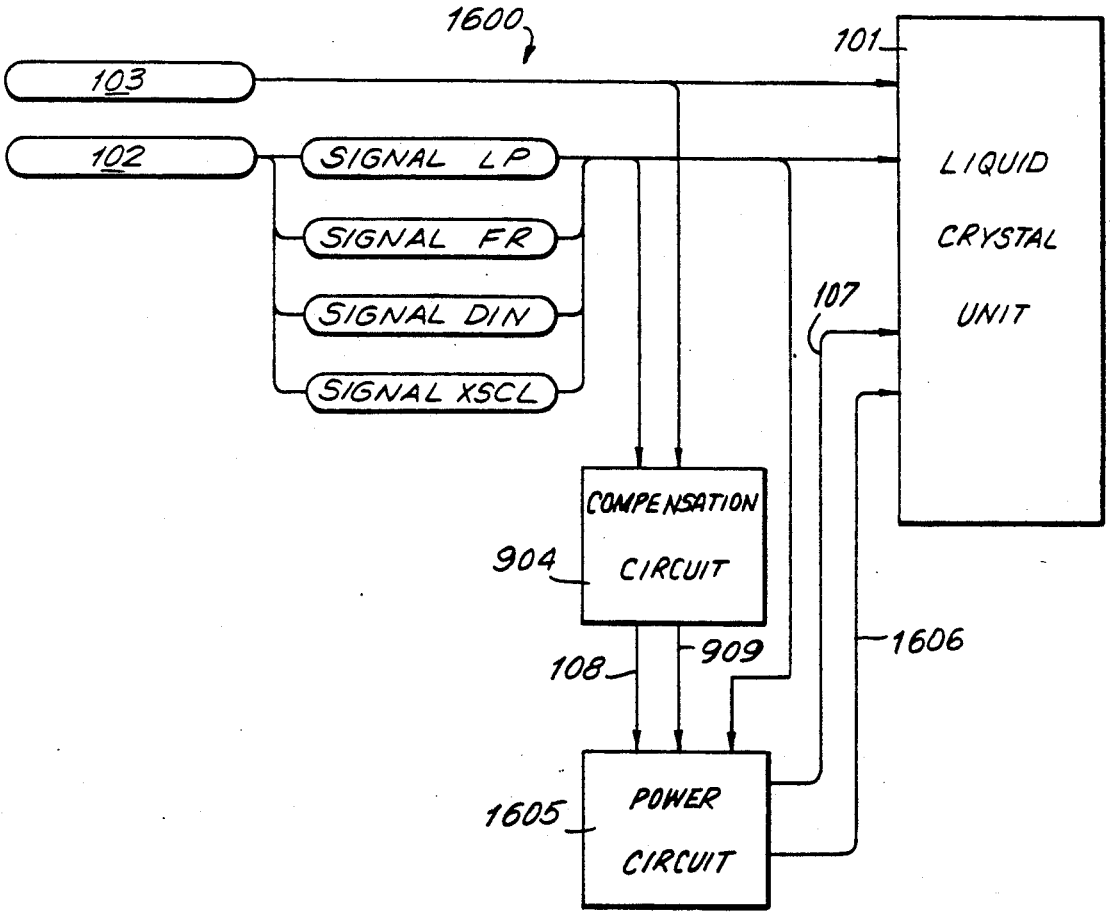
FIG. 42 is a block diagram of a liquid crystal display device in accordance with a fourth embodiment of the invention.

Reference is now made to FIG. 42 in which a circuit diagram for a fourth embodiment of an LCD, generally incated as 1600, for compensating such voltage waveforms is provided. LCD 1600 is similar in structure and operation to LCD 900 with the exception of a power source circuit 1605 and a Y power source 1606 generated by power circuit 1605.

Figure 43:
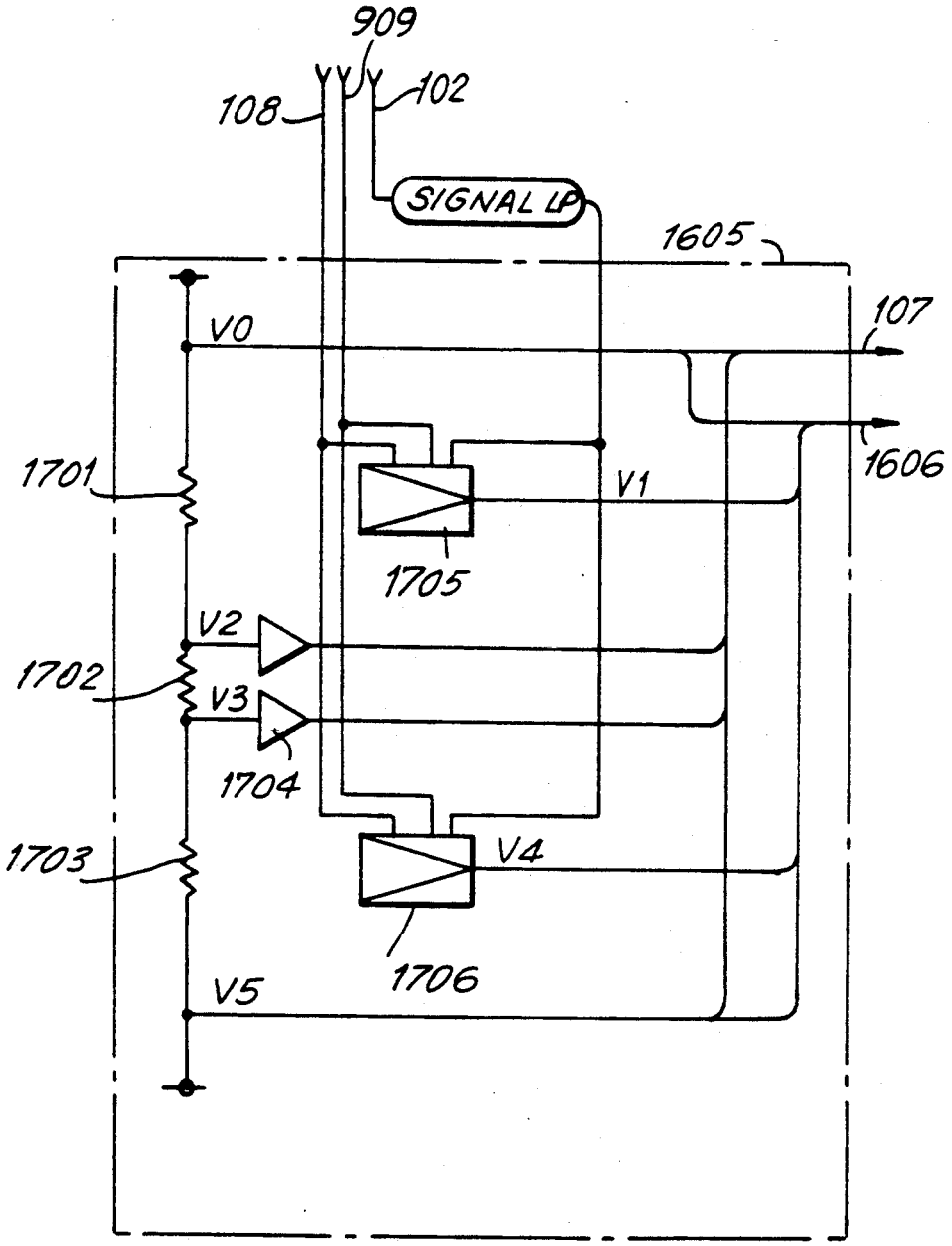
FIG. 43 is a circuit diagram of a circuit constructed in accordance with the fourth embodiment of the invention.

Reference is now made to FIG. 43 in which a circuit diagram for power circuit 1605 is provided. Three resistors 1701, 1702, 1703 are serially connected and have respective resistance values r1, r2 and r3. The resistance relationship is as follows:

$$r1/2=r2/2=r3/(n-4) \text{ (n is a constant)}$$

A voltage V0 and a voltage V5 are applied across the ends of resistors 1701 and 1703. Voltage V0 is greater than voltage V5. Voltage dividers are formed at the resistor junctions so that voltages V0, V2, V3 and V5 are the voltages existing at the ends of respective resistors 1701, 1702, 1703.

The relationship between voltages is expressed by the following equations:

$$(V0 - V2)/2 = (V3 - V5)/2 = (V2 - V3)/(n - 4)$$
$$(n \text{ is a constant})$$

The voltages V2 and V3 are stabilized by respective voltage stabilizing circuits 1704 which function identically to voltage stabilizing circuit 510.

Herein, a voltage V1N and a voltage V4N are defined as follows:

$$V1N=(V0-V2)/2+V2$$

$$V4N=(V3-V5)/2+V5$$

Namely, voltage V1N is an intermediate value between the voltages V0 and V2, and voltage V4N is an intermediate value between the voltages V3 and V5.

A pair of function waveform generating circuits 1705 and 1706 receive sign signal 108, strength signal 909 and signal LP as inputs. Waveform generating circuits 1705 and 1706 output function waveform voltages V1 and V4 of which the direction and the peak value is changed by sign signal 108 and strength signal 909.

Figure 44:
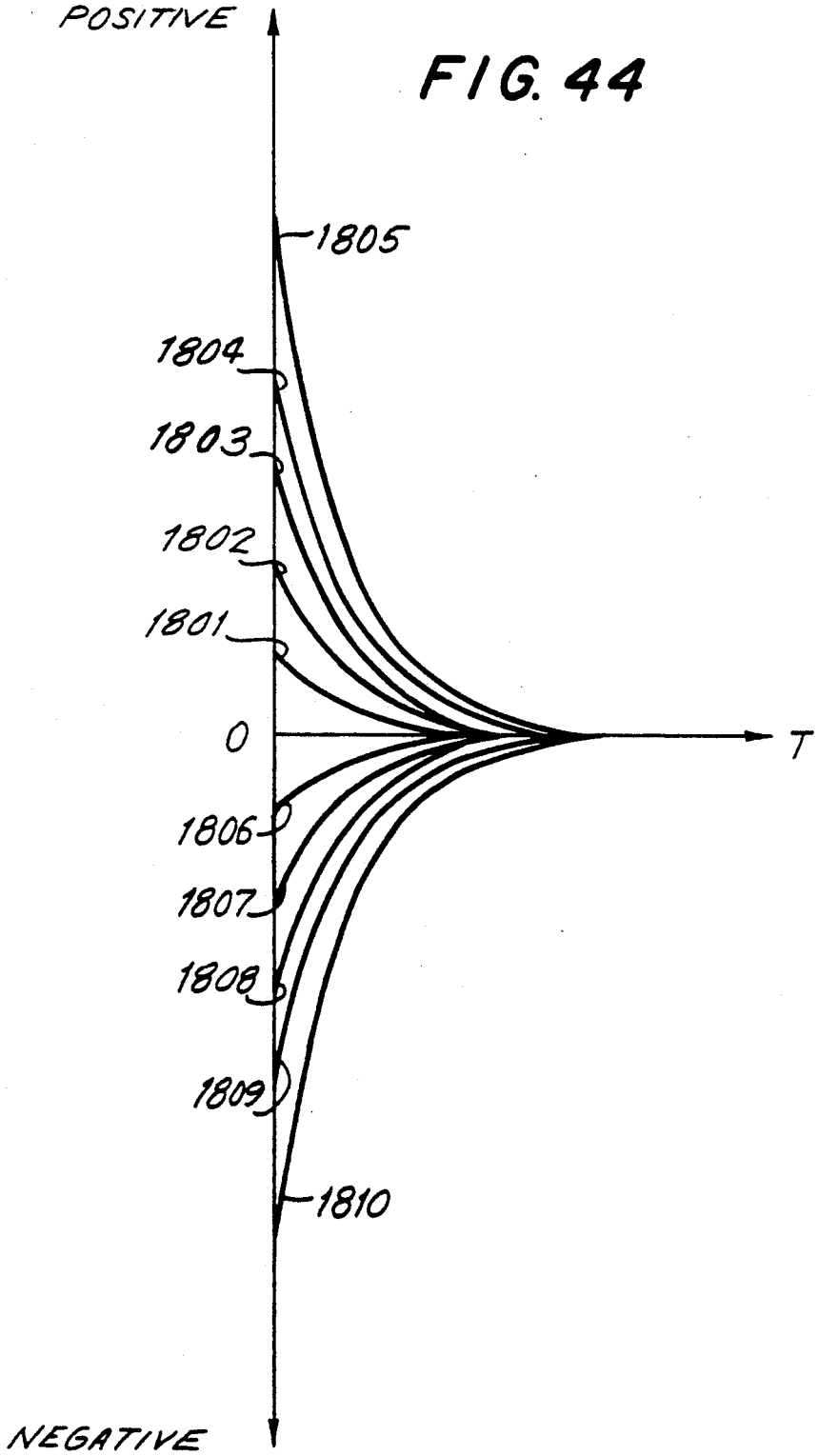
FIG. 44 is a graph of an experimental function waveform.

Reference is now made to FIG. 44 in which the voltage waveforms produced by function waveform circuits 1705 and 1706 are provided. Compensation voltage V1 output by function waveform circuit 1705 is either a voltage V1N or voltage V1N in combination with a voltage E having a potential function waveform (FIG. 44). In this case, the exponential function waveform of voltage E may be expressed by the following equation:

$$E=\alpha\times exp(-\beta\times T)$$

wherein $\alpha$ and $\beta$ are constants, and T is time.

Similarly, a compensation voltage V4 output by comprising either a voltage V4N or voltage V4N and voltage E having an exponential function waveform E (FIG. 44). Again, the voltage E is expressed by the following equation:

$$E=-\alpha\times exp(-\alpha\times T)$$

The sign of $\alpha$ corresponds to the signal indicated by sign signal 108. Upon receipt of sign signal 108, the direction in which the compensation voltage is applied is switched. The absolute value of $\alpha$ is changed in accordance with strength signal 909, thereby making it possible to change the peak value of the waveforms.

When sign signal 108 is positive and the value of strength signal 909 gradually increases, the waveforms 1801, 1802, 1803, and so on are generally generated by function waveform generating circuit 1705. When sign signal 108 is negative, the waveforms 1806, 1807, 1808 and so on are generated. However, when sign signal 108 is positive and the value of strength signal 909 is gradually increased, waveform generating circuit 1706 outputs waveforms 1806, 1807, 1808, . . . . When sign signal 108 is negative, waveform generating circuit 1706 generates waveforms 1801, 1802, 1803, . . . .

Compensation voltages V1 and V4 are generated by function waveform generating circuit 1705 and 1706, respectively, in synchronism with signal LP of control signal 102. However, when signal FR of control signal 102 is switched, voltages V1N and V4N are generated by respective function waveform generating circuits 1705 and 1706, and not in synchronism with signal LP of the control signal 102.

Figure 45:
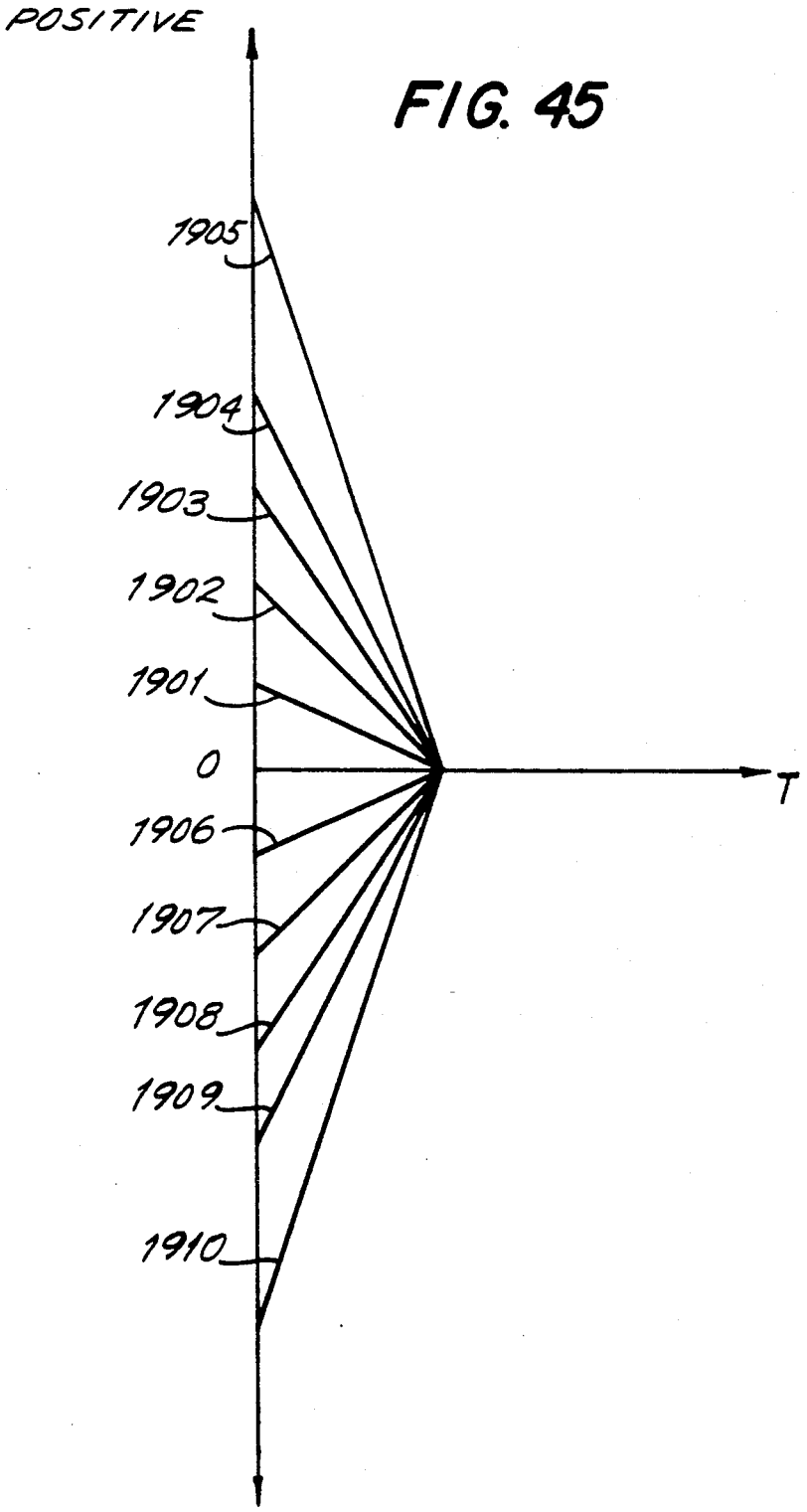
FIG. 45 is a graph of a ramp voltage waveform.

Reference is now made to FIG. 45 in which a second voltage waveform is provided. Function waveform generating circuit 1705 also outputs a voltage V1 comprising voltage V1N and a triangular waveform voltage E (FIG. 45). Voltage E may be closely expressed as an exponential function obtained by the following equation:

$$E = \alpha(\beta - T) \quad \beta \geqq T$$
$$E = 0 \quad \beta < T$$

wherein $\alpha$ and $\beta$ are constants and T is time. Similarly, function waveform generating circuit 1706 outputs a voltage V4 comprising voltage V4N and a triangular waveform voltage E (FIG. 45) which may be closely expressed as an exponential function obtained by the following equation:

$$E = -\alpha(\beta - T) \quad \beta \geqq T$$
$$E = 0 \quad \beta < T$$

Herein, the sign of $\alpha$ corresponds to the negative or positive values of sign signal 108, and changes the applied direction of the voltage in accordance thereto. Additionally, the absolute value of $\alpha$ changes in accordance with strength signal 909, thereby making it possible to change the peak value of the waveform.

Specifically, when sign signal 108 is positive and the value of strength signal 909 is gradually increased, waveforms 1901, 1902, 1903 and so on and waveforms 1906, 1907, 1908 and so on are output by respective function waveform generating circuits 1705 and 1706. Conversely, when sign signal 108 is negative waveforms 1906, 1907, 1908 and so on and waveforms 1901, 1902, 1903 and so on are output by respective function waveform generating circuits 1705 and 1706.

Figure 46:
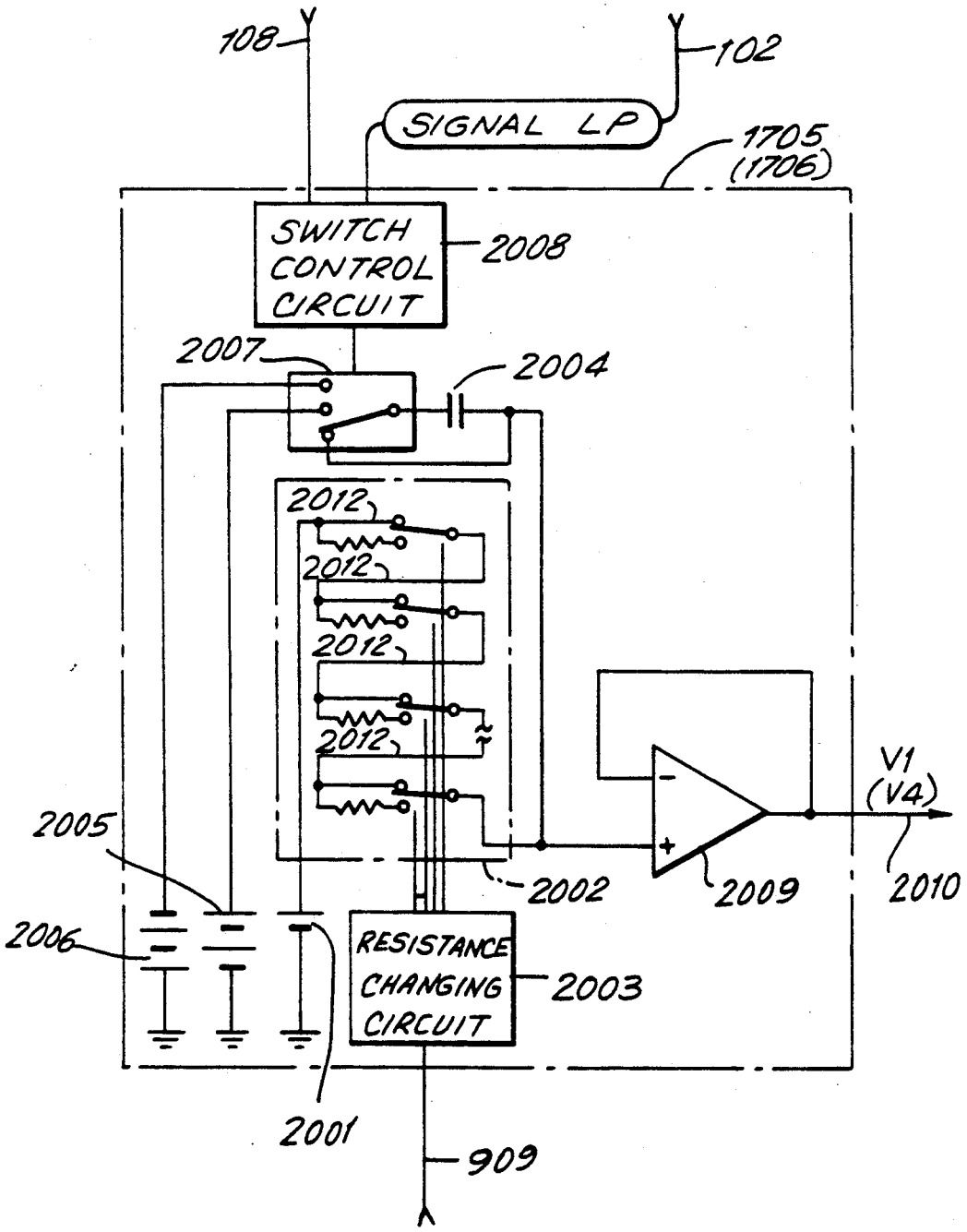
FIG. 46 is a schematic diagram of a function waveform generating circuit constructed in accordance with the invention.

Reference is now made to FIG. 46 in which a circuit diagram of respective function waveform circuits 1705 and 1706 is provided. The structure of function waveform circuits 1705 and 1706 are identical, however, in 1705 the reference voltage 2001 is used as V1N and in function generating circuit 1706 a different reference voltage, V4N is utilized.

A variable resistor 2002 comprises a plurality of resistors 2012 wherein the resistance value is increased exponentially as expressed by the relationship $\gamma$, $2\gamma$, $4\gamma$ through 2m. Switches located within resistor 2012 may be controlled to change the value of resistor 2002. A resistance changing circuit 2003 receives strength signal 909 and changes the value of variable resistor 2002, in accordance with the values of strength signal 909. As strength signal 909 is gradually increased, the value of the variable resistor 2002 increases. A capacitor 2004 is coupled to variable resistor 2002 to form a differential circuit.

A first switching power source 2005 has a voltage higher than reference voltage 2001. However, the voltage V0 may be substituted for power source 2005 in function waveform generating circuit 1705, and further, the voltage V3 may be substituted in function waveform generating circuit 1706. A second switching power source 2006 has a voltage lower than reference voltage 2001. The voltage V2 may be substituted in function waveform generating circuit 1705 for voltage 2006 and further, the voltage V5 may be substituted in function waveform generating circuit 1706.

A switch 2007 is connected to the opposing electrodes of capacitor 2004, and may select either first switching power source 2005 or second switching power source 2006. A switch control circuit 2008 receives signal LP and sign signal 108 and controls switch 2007 controls according to the condition of sign signal 108, in synchronism with signal LP of control signal 102, except when signal FR of control signal 102 is switched.

Specifically in function waveform generating circuit 1705, when sign signal 108 indicates a positive sign, switch 2007 is switched so as to be connected to first switching power source 2005. When sign signal 108 indicates a negative sign, switch 2007 is switched so as to be connected to second switching power source 2006. However, in function waveform generating circuit 1706, when sign signal 108 indicates a positive sign, switch 2007 is switched so as to be connected to second switching power source 2006, and when sign signal 108 indicates a negative sign, switch 2007 is switched so as to be connected to first switching power source 2005. Then, prior to inputting the next signal LP of control signal 102 to switch control circuit 2008, switch 2007 is switched to the opposing electrode of the capacitor 2004.

A voltage follower circuit 2009 having an operational amplifier is provided to reduce the impedance of the voltage applied to the non-inverted input terminal to output a voltage waveform having the reduced impedance. An output voltage 2010 of voltage follower circuit 2009 is output as V1 from function waveform generating circuit 1705 and is output as V4 from function waveform generating circuit 1706.

In function waveform circuits 1705 and 1706, since either the first switching power source 2005 or the second switching power source 2006 is connected to the differential circuit comprising the capacitor 2004 and the variable resistor 2002, the voltage waveform of the exponential function is generated at the non-inverted input terminal of the voltage follower circuit 2009. The voltage waveform has a value which varies according to the capacitance of capacitor 2004 and the resistance of variable resistor 2002. Therefore, the larger the value of strength signal 909, the larger the resistance value of variable resistor 2002 and the larger the voltage waveform. Additionally, the direction in which the voltage is applied is determined by the output of sign signal 108.

Voltage follower circuit 2009 functions to reduce the impedance of the voltage applied to the non-inverted input terminal and produce a voltage waveform having reduced impedance. Further, the voltages V1 and V4 generated by function waveform generating circuits 1705 and 1706 are combined with voltages V0 and V5 as a Y power source 1601 and are output to liquid crystal unit 101.

The voltages V0, V2, V3 and V5 are combined as X power source 107 and are output to liquid crystal unit 101. At this time, in accordance with I as in put by sign signal 108 and strength signal 909, a voltage having a different direction and value of the exponential function waveform, or the voltage having the trigonometric function waveform similar to the exponential function waveform, is superimposed and is applied to the non-selected voltage.

In LCD 1600 when the selected electrode is changed from the nth common electrode to the (n+1)th common electrode on liquid crystal panel 201, the exponential function voltage waveform or the trigonometric function waveform, which is closely expressed by an exponential function voltage waveform having a peak value corresponding to the difference I between the values of ON dots on the nth common electrode and (n+1)th common electrode, is output as the non-selected voltage of Y power source 1606. The output voltage waveform has a direction opposed to the direction of the spiked-shape noise waveform and the same shape as that of the spike-shaped noise waveform. By superimposing the output waveform on the noise waveform, the spike-shaped noise waveform is substantially omitted, compensating the voltages applied to the respective display dots 204 improving display quality without zebra crosstalk. As discussed above, such a compensation is carried out by superimposing the function waveform on the non-selected voltage. This structure is referred to as "the function waveform compensation of the non-selective voltage".

In LCDs 100, 900, 1400 and 1600, the non-selected voltages are compensated in accordance with the value I. However, the same effects can be obtained by compensating the ON/OFF voltages in accordance with the value I, making it possible to provide an improved display quality without zebra crosstalk.

Figure 47:
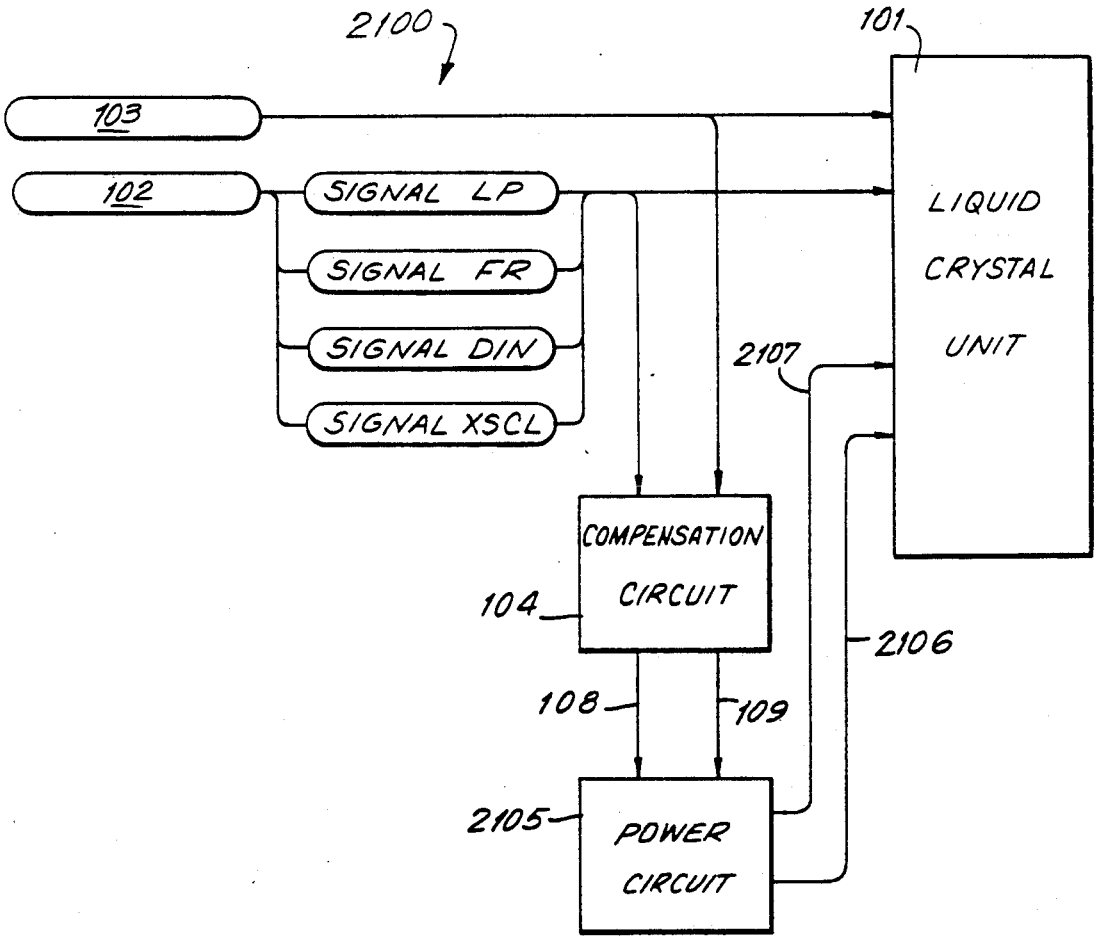
FIG. 47 is a block diagram of a liquid crystal display device constructed in accordance with a fifth embodiment of the invention.

Accordingly, reference is made to FIG. 47 in which a block diagram of a fifth embodiment of an LCD, generally indicated as 2100, for compensating the period during which the ON/OFF voltages are applied is provided. The constituent parts of LCD 2100 operate in the same manner as LCD 100 with the exception of a power circuit 2105, a Y power source 2106 generated by power source circuit 2105 and an X power source 2107. Like numbers are utilized to indicate like structure.

Upon the input of sign signal 108 and strength signal 109, power source circuit 2105 outputs X power source 2107 of variable ON/OFF voltages and Y power source 2106 of which the selected/non-selected voltages are fixed.

Figure 48:
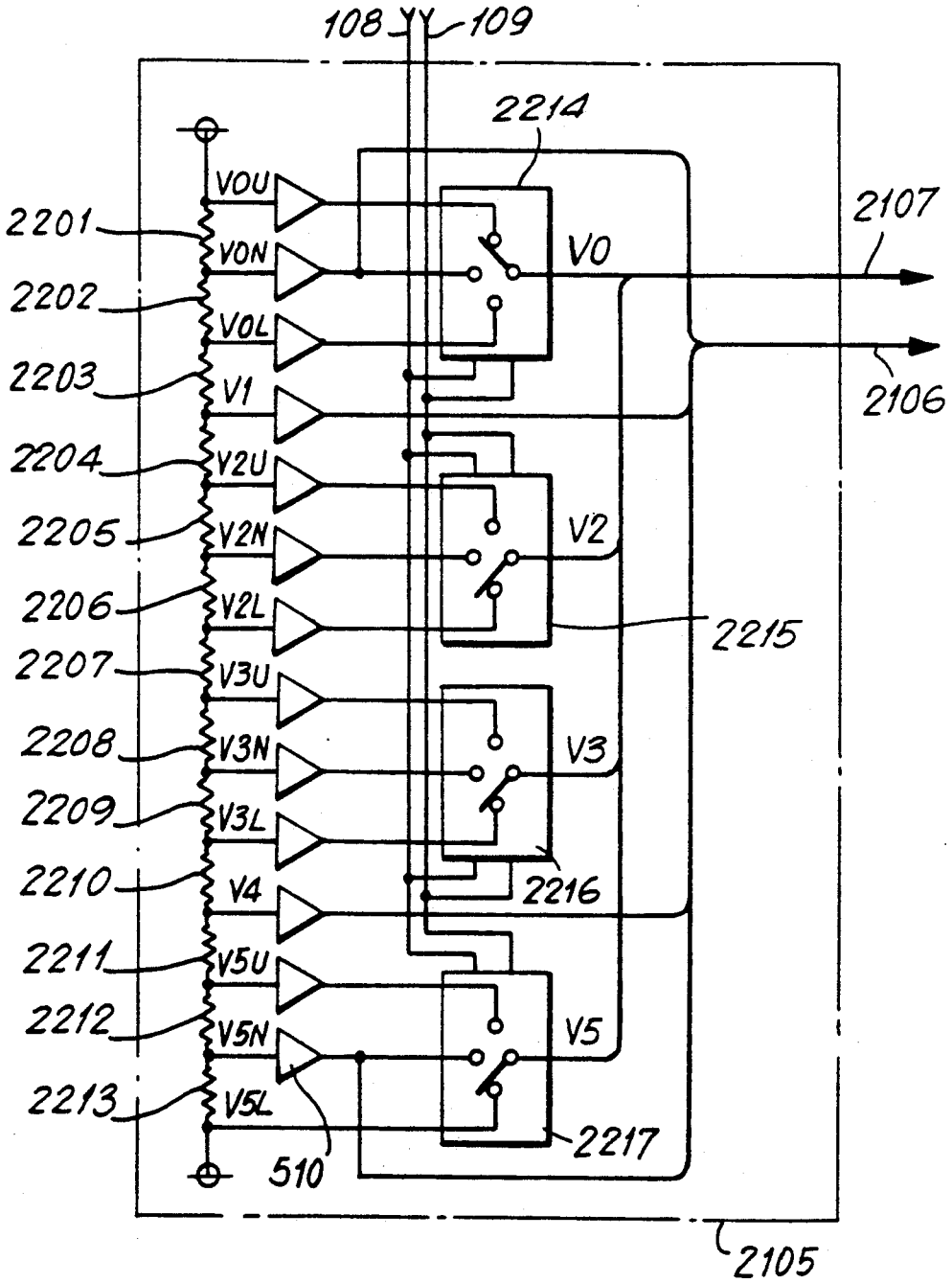
FIG. 48 is a circuit diagram of a power source constructed in accordance with the fifth embodiment of the invention.

Reference is now made to FIG. 48 wherein a circuit diagram of power circuit 2105 is provided. A plurality of resistors 2201 through 2213 are serially connected providing associated voltage dividers. Voltages V0U and V5L are applied across the ends of the resistor series. The voltages V0U, V0N, V0L, V1, V2U, V2L, V3U, V3N, V3L, V4, V5U, V5N and V5L are the divided voltages generated at the terminals of respective resistors 2201 through 2213. The voltage values are set and may be expressed by the following equations:

$$V0N - V1 = V1 = V2N = V3N - V4 = V4 - V5N = (V2N - V3N)/(n - 4)$$

($n$ is a constant)

Further, $$(V0N - V0L)/(V0N - V1) = (V2N - V2L)/(V1 - V2N) = (V3U - V3N)/(V3N - V4) = (V5U - V5N)/(V4 - V5N)$$

Furthermore, $$(V0U - V1N)/(V0N - V1) = (V2U - V2N)/(V1 - V2N) = (V3N - V3L)/(V3N - V4) = (V5N - V5L)/(V4 - V5N)$$

The divided voltages V0N through V5N which are obtained at the terminals of respective resistors 2201 through 2213 are each stabilized by a voltage stabilizing circuit 510 as in power circuit 105. Four switches 2214 through 2217 each receive sign signal 108 and strength signal 109 and selected switch position based upon the signal values. For example, when strength signal 109 is active and sign signal 108 indicates a positive sign, respective switches 2214 through 2217 select the following voltages:

switch 2214—Voltage V0U
switch 2215—Voltage V2U
switch 2216—Voltage V3L
switch 2217—Voltage V5L Further, when sign signal 108 indicates a negative value, respective switches 2214 through 2217 select the following voltages:

switch 2214—Voltage V0L
switch 2215—Voltage V2L
switch 2216—Voltage V3U
switch 2217—Voltage V5U Furthermore, when strength signal 109 is not active, respective switches 2214 through 2217 select the following voltages, regardless of the condition of sign signal 108:

switch 2214—Voltage V0N
switch 2215—Voltage V2N
switch 2216—Voltage V3N
switch 2217—Voltage V5N When the voltages output by switches 2214 through 2217 V0, V2, V3 and V5, power circuit 2105 outputs a combined voltage of V0, V2, V3 and V5 as X power source 2107 and outputs a combined voltage of V0N, V1, V4 and V5V as Y power source 2106. The voltage of Y power source 2016 and the voltage of X power source 2107 are applied to liquid crystal unit 101 as either of two sets.

In the first set, the combined voltage Y0N of Y power source 2106 is the selected voltage and the voltage V4 of Y power source 2106 is the non-selected voltage. The voltage V5 of X power source 2107 is the ON voltage and the voltage V3 of X power source 2107 is the OFF voltage. In the second set the voltage V5N of Y power source 2106 is the selected voltage and the voltage V1 of Y power source 2106 is the non-selected voltage. The voltage V0 of X power source 2107 is the ON voltage :nd the voltage V2 of X power source 2107 is the OFF voltage. Either of the two sets of controlling voltages is selected in the same manner as in LCD 100.

When the selection of common electrodes Y1 through Y6 on the liquid crystal panel 210 is changed from the common electrode to the (n+1)th common electrode and the difference I between the number of ON dots on both the nth and (n+1)th common electrodes is positive, the voltages V0U, V2U, V3L and V5L are applied as the voltages V0, V2, V3 and V5 by X power source 2107 to liquid crystal unit 101 for a period corresponding to the absolute value of I. Conversely, when I has a negative value the voltages V0L, V2L, V3U and V5U are applied to liquid crystal unit 101 as the voltages V0, V2, V3 and V5 for a period corresponding to the absolute value of I.

Figure 49A:
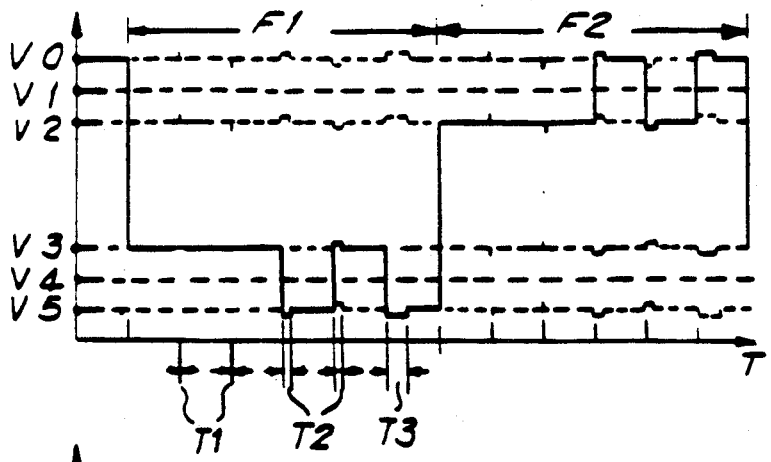
FIGS. 49A-49C are graphs of the applied voltage waveform for forming the display pattern of FIG. 32.
Figure 49B:
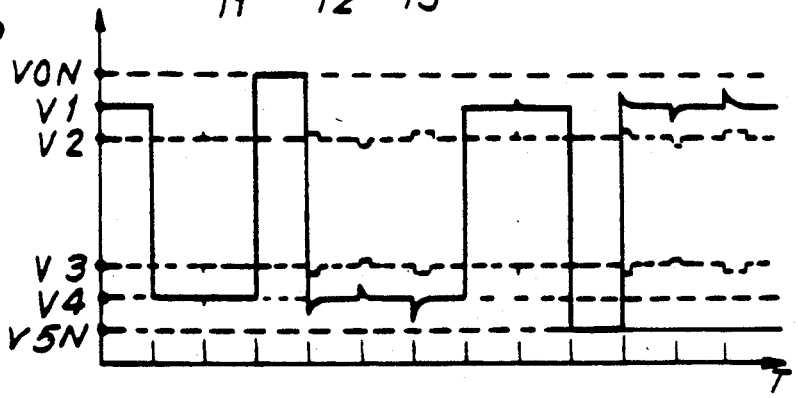
Figure 49C:
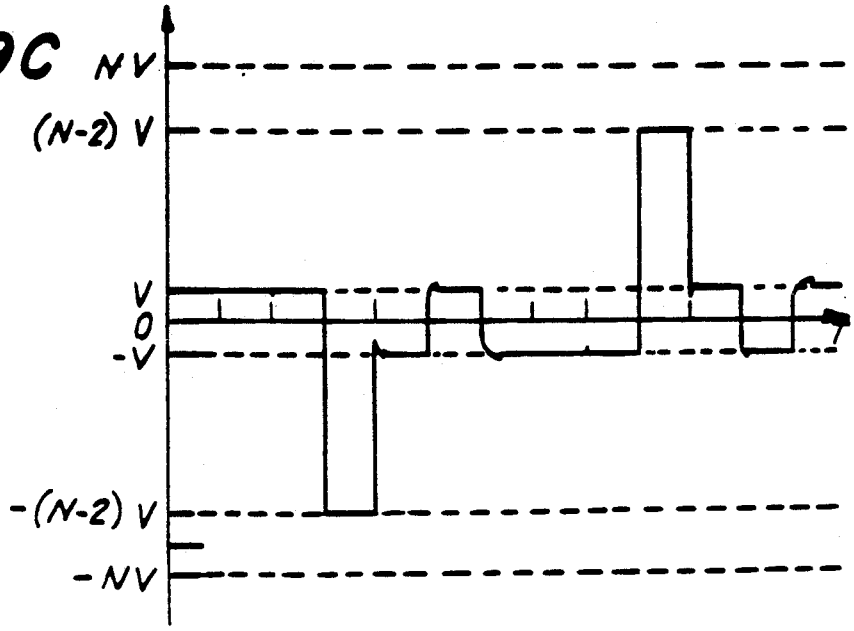

Reference is now made to FIGS. 49A-49C where waveforms for producing the display of FIG. 32 by LCD 2100 is provided. FIG. 49A illustrates a voltage waveform applied to segment electrode X4 for forming display dot 601. FIG. 49B illustrates a voltage waveform applied to common electrode Y3 for forming display dot 601. FIG. 49C illustrates the combined voltage waveform applied to the display dot 601.

As discussed above, when the selected electrode is moved from one common electrode to the next common electrode, the greater the difference I between the number of ON dots on the common electrode and the number of ON dots on the next selected common electrode, the larger the spike-shaped noise waveform superimposed to the non-selected voltage becomes. However, as seen in FIG. 49A ON/OFF voltages are changed in the direction of generated superimposed spike-shaped noise and the period during which the ON/OFF voltages are changed is increased according to the difference I, as shown in periods T1, T2 and T3.

Under such a construction, it is possible to provide an improved display without zebra crosstalk by compensating the effective voltage. As noted above, ON/OFF voltages are changed for the period corresponding to the value I, thereby obtaining the same effects as in LCD 100, 900, 1400 and 1600. The above mentioned compensation is known as "time base compensation of ON/OFF voltages".

In a sixth embodiment, it is possible to compensate the voltage base, the time-voltage base, or the functional waveform of the ON/OFF voltages. In these cases, the same effects as those of LCD 2100 can be obtained. Further, it is also possible to compensate the voltage base, the time-voltage base or the functional waveform of non-selected voltage and either the ON voltage or the OFF voltage, or all three voltages. Additionally, such constructions are easily achieved based upon the above described embodiments therefore the description of the constructions are omitted herein.

As mentioned above, in each of the embodiments when the selected common electrode Y1 through Y6 is changed from one common electrode to the next common electrode the non-selected voltage, or the ON/OFF voltages are changed in accordance with the difference I between the number of ON dots of the one common electrode and the next selected common electrode, thereby making it possible to provide an improved display quality without zebra crosstalk. While specific embodiments have been illustrated and described herein, the means for compensating the voltage is not limited thereto. It is also possible to utilize any means that can compensate the effective voltages applied to the display dots in accordance with the value of I.

Figure 50:
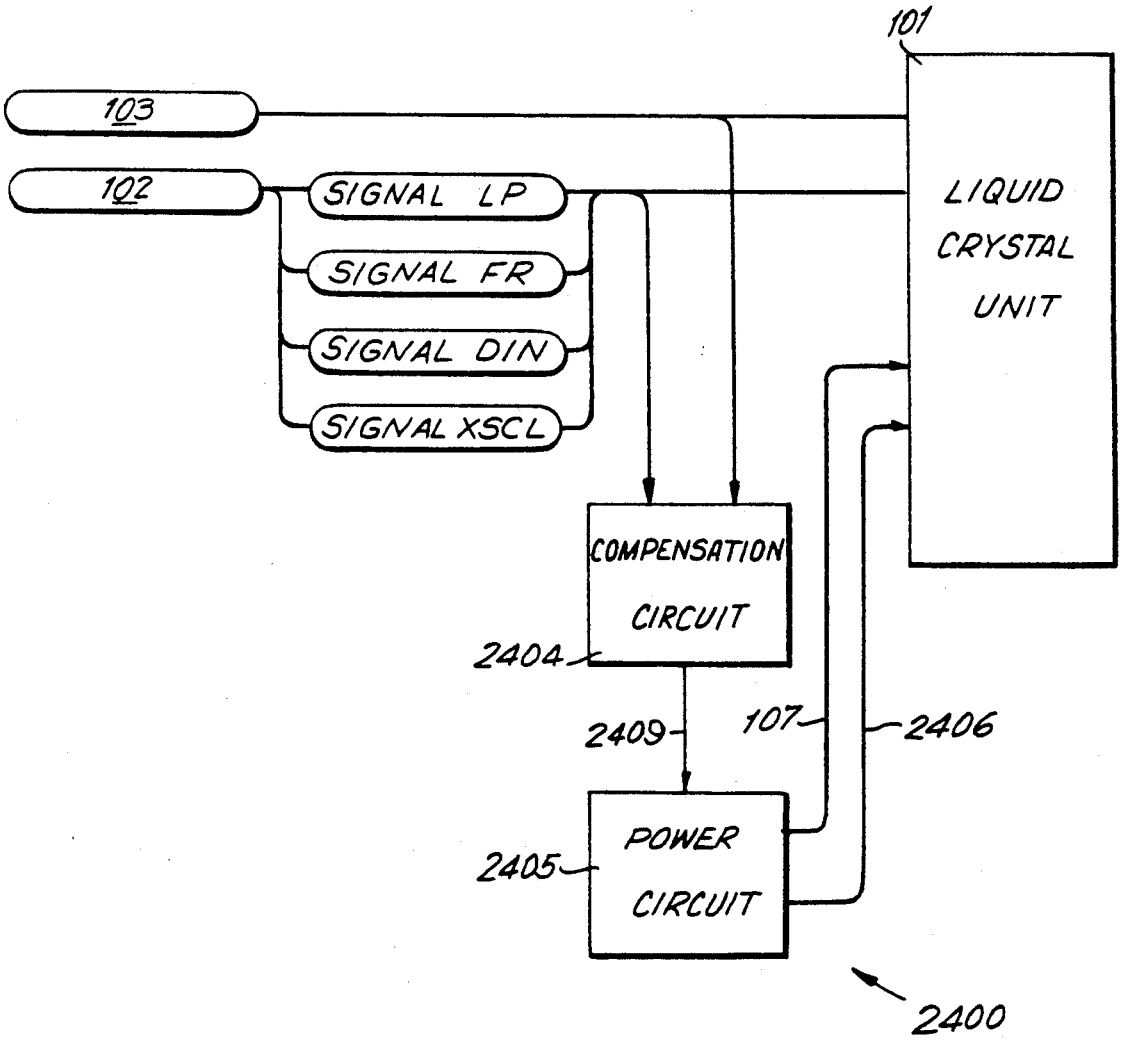
FIG. 50 is a block diagram of a liquid crystal device constructed in accordance with a seventh embodiment of the invention.

Reference is now made to FIG. 50 wherein a block diagram of a seventh embodiment of an LCD, generally indicated as 2400 for providing a display without horizontal crosstalk. As discussed above, the degree of horizontal crosstalk is determined by the number of ON dots on the selected common electrode. Therefore, it is necessary to compensate the waveform in accordance with a counted value Z during operation of the liquid crystal display device.

LCD 2400 includes a compensation circuit 2409 for counting the number of ON dots Z on the next selected common electrode and producing a strength signal 2409 for a period corresponding to the value Z. Compensation circuit 2404 receives data signal 103 and control signal 102 and calculates Z in synchronism with signal LP of control signal 102. A power circuit 2405 receives strength signal 2409, and outputs a Y power source 2406 and an X power source 107. Power source 106 includes a selected voltage which may be varied. The voltage width of the selected voltage is uniform, and the period of the changed voltage width is defined by strength signal 2409. Accordingly, the period of the selected voltage is varied according to the value Z. Therefore, the selected voltage is compensated by varying the period according to the value Z counted by the compensation circuit 2404.

Figure 51:
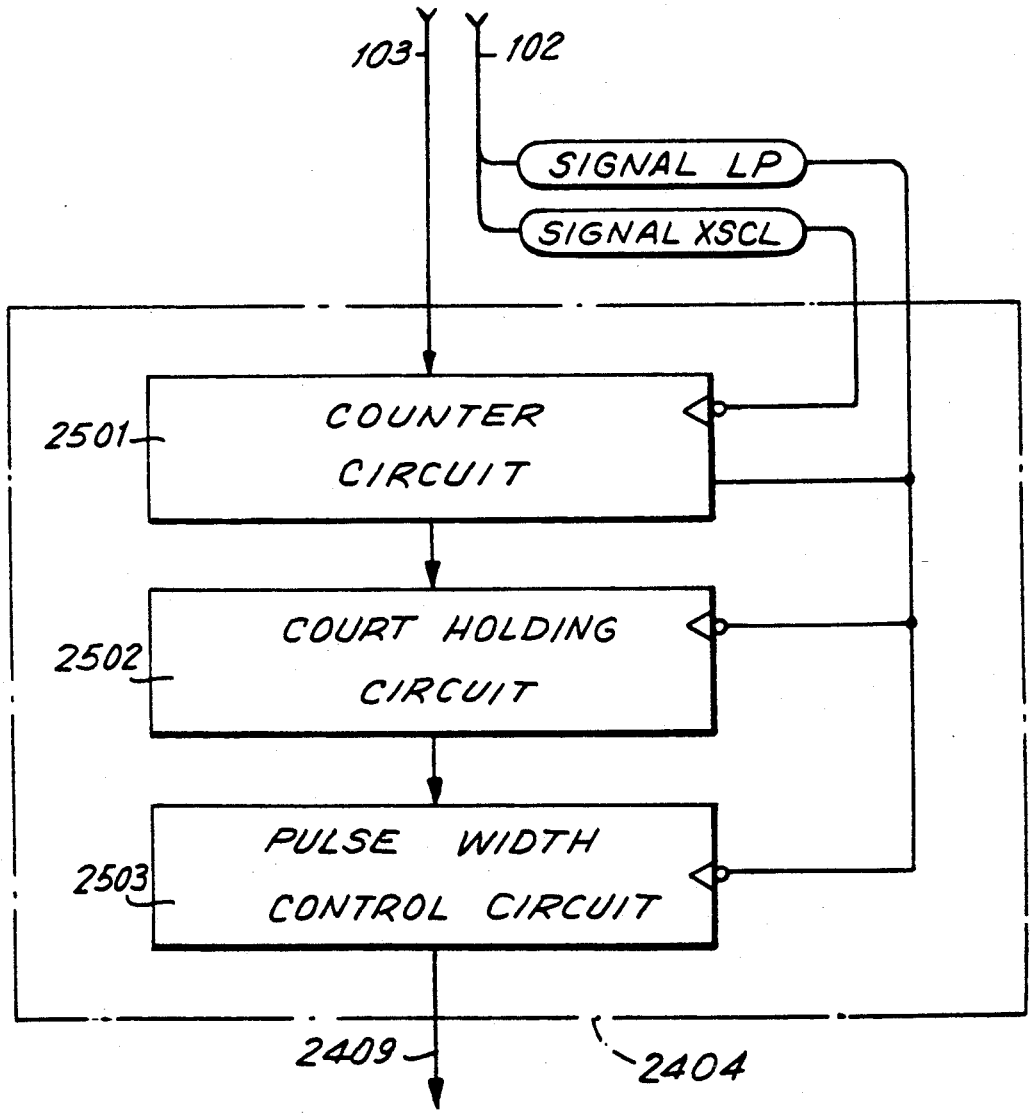
FIG. 51 is a block diagram of a compensation circuit constructed in accordance with the seventh embodiment.
Figure 52:
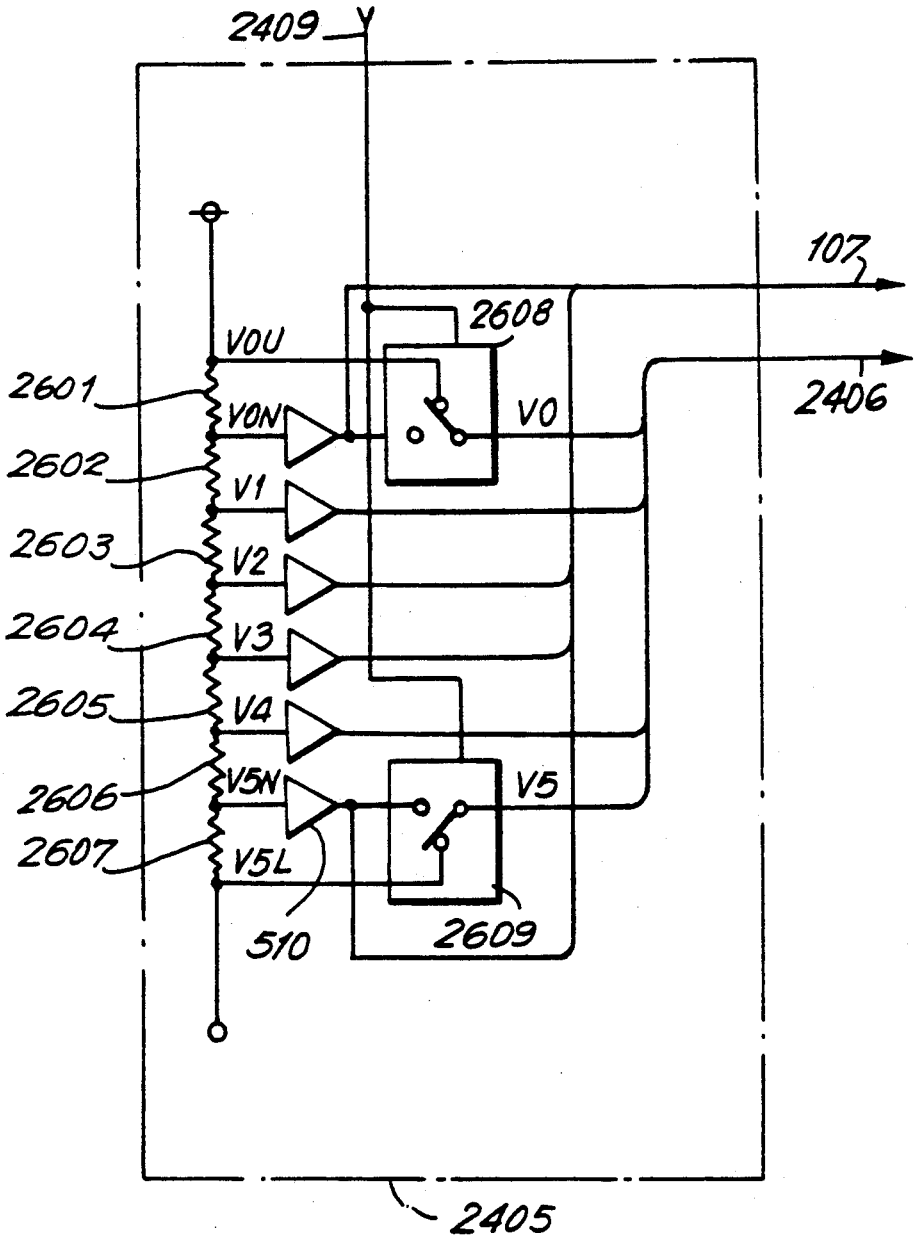
FIG. 52 is a circuit diagram of a power circuit constructed in accordance with the seventh embodiment of the invention.

Reference is now made to FIG. 51 wherein an exemplary embodiment of compensation circuit 2404 is provided. A counter circuit 2501 and a count holding circuit 2502 operate in the same manner as counter circuit 401 and count holding circuit 402. Generally, the value $M_{ON}$ of ON dots of the next selected common electrode is counted by counter circuit 2501 and is output as the value Z into count holding circuit 2502. A pulse width control circuit 2503 receives the output of count holding circuit 2502 and signal LP and is triggered by output strength signal 2409 which is active for a period corresponding to the value Z. The output of pulse width control circuit 2503 is triggered by the falling edge of signal LP of control signal 102.

The period W over which strength signal 2409 is active is represented by the following equation:

$$W=\Sigma a_k Z^{1/k} \Sigma b_k Z^{1/k}$$

$a_k$ and $b_k$ are constants. K is a natural number. In compensation circuit 2404 the period is represented by the following equation:

$$W=a_o+a_1Z+a_2Z^2+b_2Z^{1/2}$$

Compensation circuit 2404 comprises the above construction. Therefore, when the selected common electrode changes from the nth common electrode to the (n+1)th common electrode, strength signal 2409 is output for a period in accordance with the value Z of ON dots on the (n+1)th common electrode.

Reference is now made to FIG. 51 in which circuit diagram for power circuit 2405 is provided. A plurality of resistors 2601 through 2607 are serially connected forming associated voltage dividers. Voltages V0U and V5L are applied across each end of the series of resistors.

Accordingly, voltages V0U, V0N, V1, V2, V3, V4, V5N and V5L are the voltages generated at the respective terminals of resistors 2601 through 2607. The relationship among the respective voltages is defined as follows:

$$V0N - V1 = V1 - V2 = V3 - V4 = V4 - V5N = (V2 - V3)/(n - 4)$$

($n$ is a constant).

Further, $$(V0U - V0N)/(V1 - V2) = (V5N - V5L)/(V4 - V5N)$$

Furthermore, the voltages V0N through V5N generated by the above resistors 2601 through 2607 are stabilized by a respective voltage stabilizing circuit 510 in the same manner as in power circuit 105.

Two switches 2608 and 2609 each receive strength signal 2409. Switch 2608 receives V0U and V0N as inputs and switch 2609 receives switch V5L and V5N as inputs. Switches 2608 and 2609 select the appropriate voltages based upon strength signal 2409. When strength signal 2409 is active, switches 2608 and 2609 are select voltages V0U and V5L, respectively. When strength signal 2409 is not active, switches 2608 and 2609 select voltages V0N and V5N, respectively. The voltages output by switches 2608 and 2609 are output voltages V0 and V5. Y power source 2406 includes voltages V0 and V5 and voltages V1 and V2. Voltages V0N, V2, V3 and V5N are output as X power source 107. When strength signal 2409 generated by compensation circuit 2404 is active, voltages V0U and V5L are output as voltages V0 and V5 of Y power source 106. When strength signal 2409 is not active, voltages V0N and V5N are output as Y power source 106.

Furthermore, the selected voltage, non-selected voltage, ON voltage and OFF voltage are applied to liquid crystal unit 101 in two sets by Y power source 2406 and X power source 107 as in the above embodiments. The selected voltage of Y power source 2406 is varied in accordance with values of Z. In LCD 2600 when the selected common electrode is changed from the nth common electrode to the (n+1)th common electrode of liquid crystal panel 201, voltages V0U and V6L not V0N and V5N, are generated as voltages V0 and V5 of Y power source 2406 for a period corresponding to the value Z of ON dots on the (n+1)th common electrode.

Figure 55A:
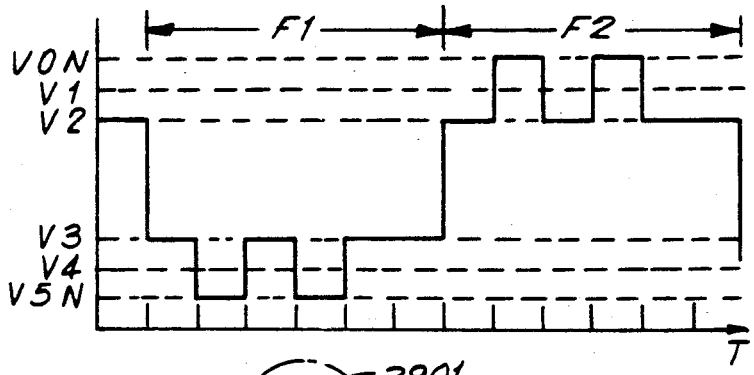
Figure 55B:
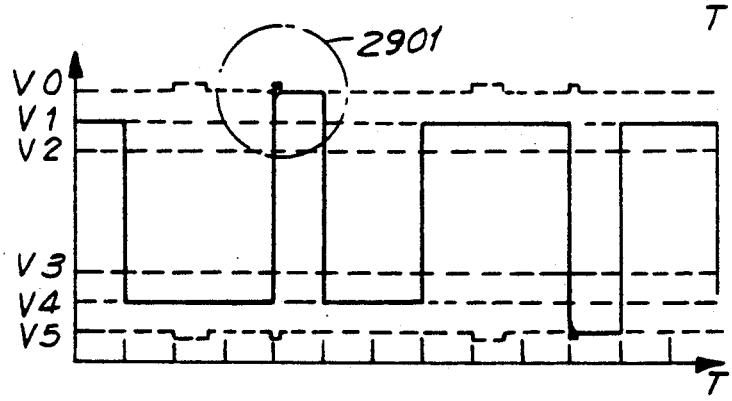
Figure 55C:
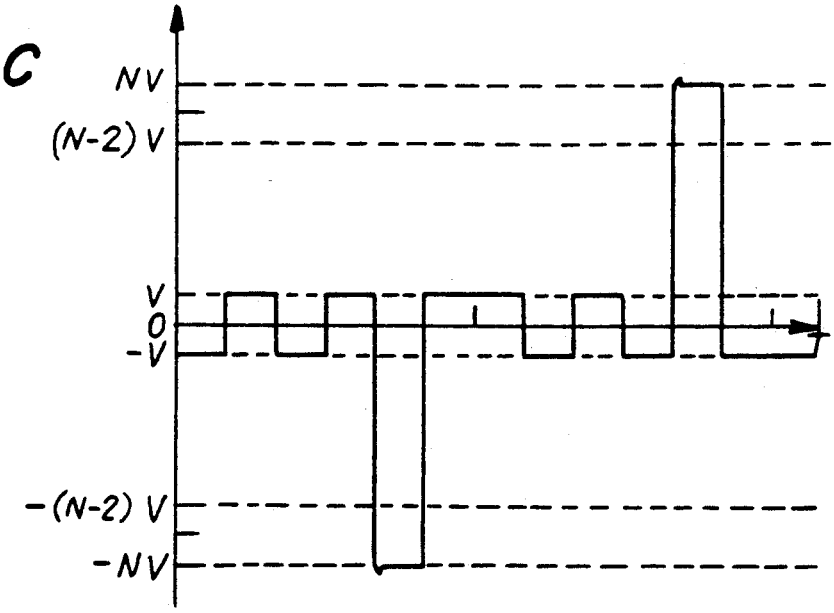

Reference is now made to FIGS. 53–55C in which one embodiment of a display pattern formed in accordance with LCD 2600 is provided. FIG. 54A illustrates a voltage waveform applied to segment electrode X1 to form an ON dot 2701. FIG. 54B illustrates a voltage waveform applied to common electrode Y4 to form ON dot 2701. FIG. 55C illustrates a combined voltage waveform applied at ON dot 2701.

Similarly, FIG. 55A illustrates a voltage waveform applied to segment electrode X1 to form an ON dot 2702. FIG. 55B illustrates a voltage waveform applied to common electrode Y4 to form ON dot 2702. FIG. 55C illustrates a combined voltage waveform applied to ON dot 2702. Voltages applied by Y power source 2406 and Y power source 107 are represented by dashed lines.

Figure 56:
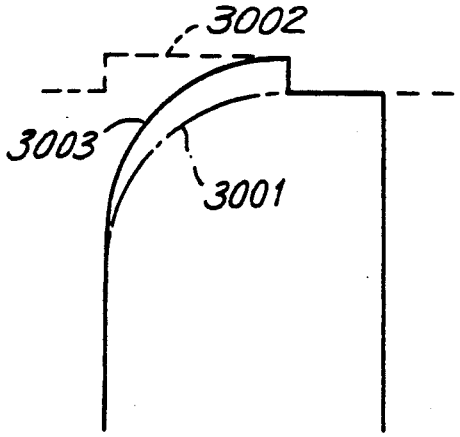
FIG. 56 is partial exploded view of the waveform of FIG. 54C.
Figure 57:
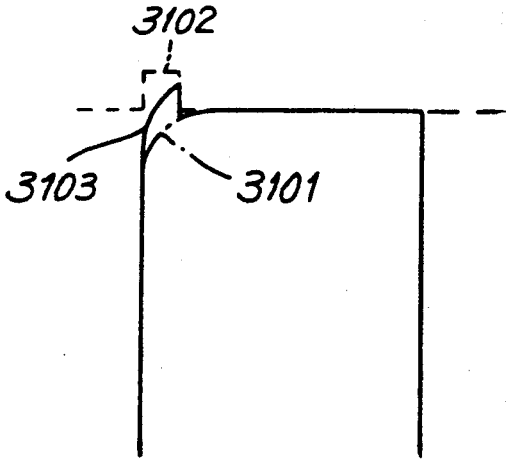
FIG. 57 is a partial exploded view of the waveform of FIG. 55C.

Reference is also made to FIGS. 56 and 57 in which a region of FIG. 55B, generally indicated as 2801 and an exploded view of FIG. 56B, generally indicated as 2901, are provided. A rounded waveform 3001 is generated in second common electrode Y2 when common electrode Y2 is switched from the non-selected voltage to the selected voltage. A waveform of the selected voltage 3002 is applied by Y power source 2406, resulting in a combined waveform 3003, voltage waveform 3003 is applied to second common electrode Y2.

Similarly, a round waveform 3101 is generated in fourth common electrode Y4 when switched from the non-selected voltage to the selected voltage. Again a selective voltage waveform 3102 is applied by Y power source 2406. A waveform 3013 is obtained by the combination of waveforms 3101 and 3102, and is the actual voltage waveform applied to the fourth common electrode Y4.

Figure 53:
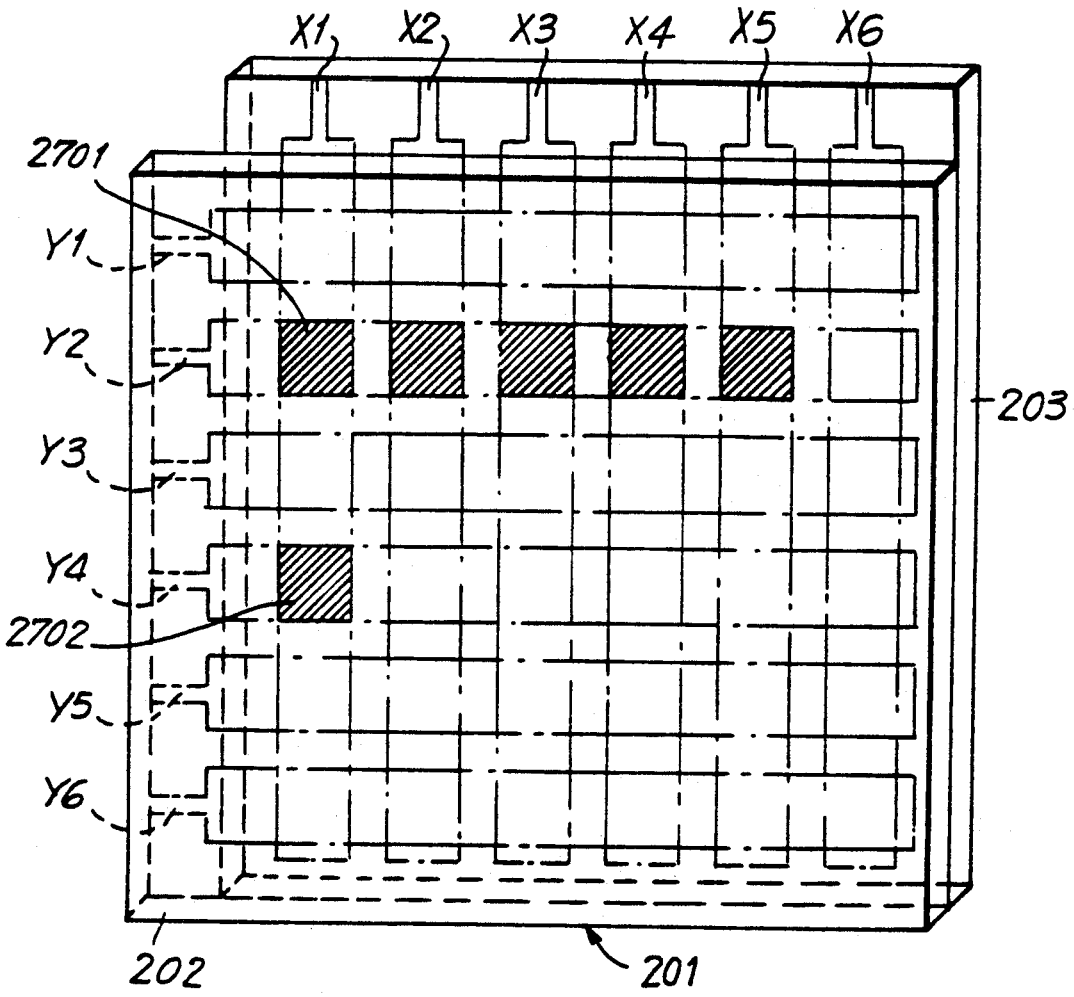
FIG. 53 is a perspective view of a liquid crystal panel wherein another display pattern is displayed.
Figure 54A:
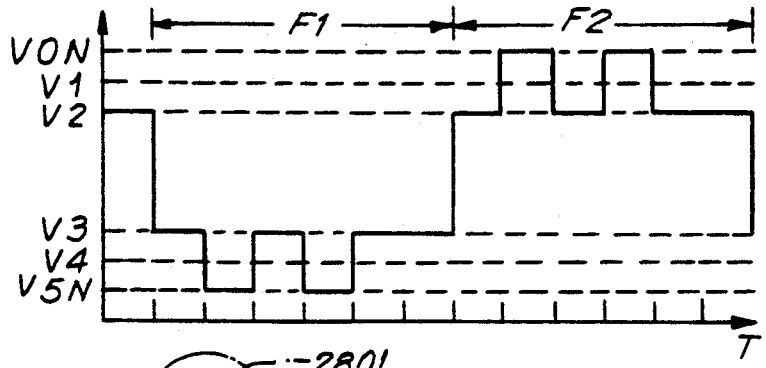
FIGS. 54A-54C and 55A-55C are graphs of the waveforms of the voltage applied to the liquid crystal panel for forming the display pattern of FIG. 23.
Figure 54B:
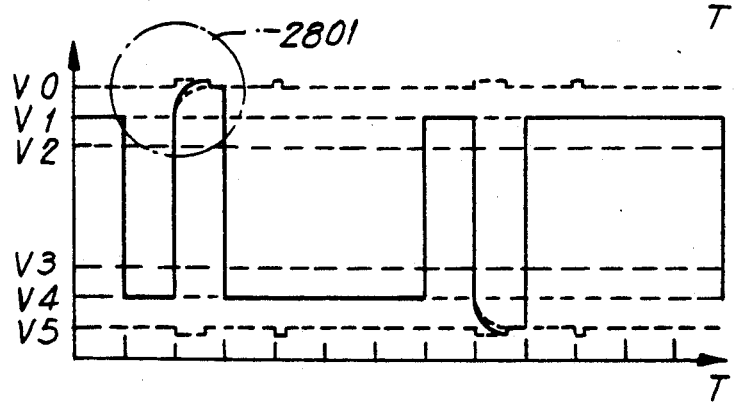
Figure 54C:
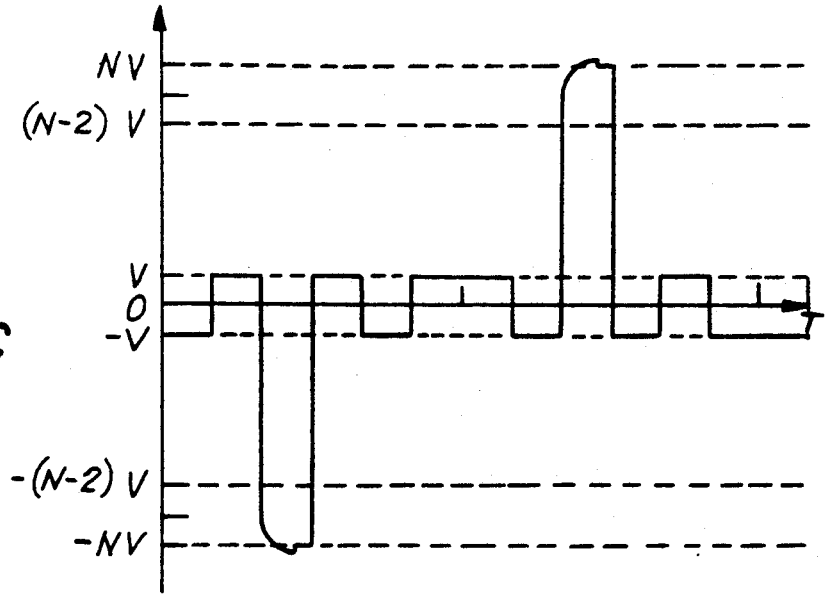

Herein, when the display pattern shown in FIG. 53 is formed, the respective values for Z of ON dots on common electrode substrate 202 are as follows:

| | |
|---|---|
| first common electrode *Y1* | $Z = 0$ |
| second common electrode *Y2* | $Z = 5$ |
| third common electrode *Y3* | $Z = 0$ |
| fourth common electrode *Y4* | $Z = 0$ |
| fifth common electrode *Y5* | $Z = 1$ |
| sixth common electrode *Y6* | $Z = 0$ |

As is apparent from the comparison between waveform 3001 and waveform 3101, a larger rounded waveform may occur on second common electrode Y2, than on fifth common electrode Y5, when switching from non-selected voltage to the selected voltage occurs. However, waveform 3002 of the selected voltage changes more quickly in the direction in which voltage on the common electrode is applied and for a longer time than those of waveform 3102. Accordingly, the selected voltages are compensatively applied in accordance with the respective degree of the roundness of each waveform 3101, resulting in no difference between the effective voltage applied to ON dots 2701 and 2702, respectively. Therefore, it is possible to provide a superior display quality without horizontal crosstalk.

As noted, it is possible to provide an improved display without horizontal crosstalk by compensating the period during which the selected voltage is applied in accordance with a value Z of ON dots on the selected common electrode.

In an eighth embodiment, it is also possible to compensate the voltage base, the time-voltage base, or the functional waveform of the selected voltage in accordance with the value Z of the ON dots on the selected common electrode as in FIG. 28. The same effects as those of LCD 2400 can then be obtained. In a ninth embodiment, it is possible to compensate the voltage, the time-voltage base or the functional waveform of the ON voltage and the OFF voltage in accordance with the value Z of the ON dots on the selected common electrodes of substrate 202.

Figure 58:
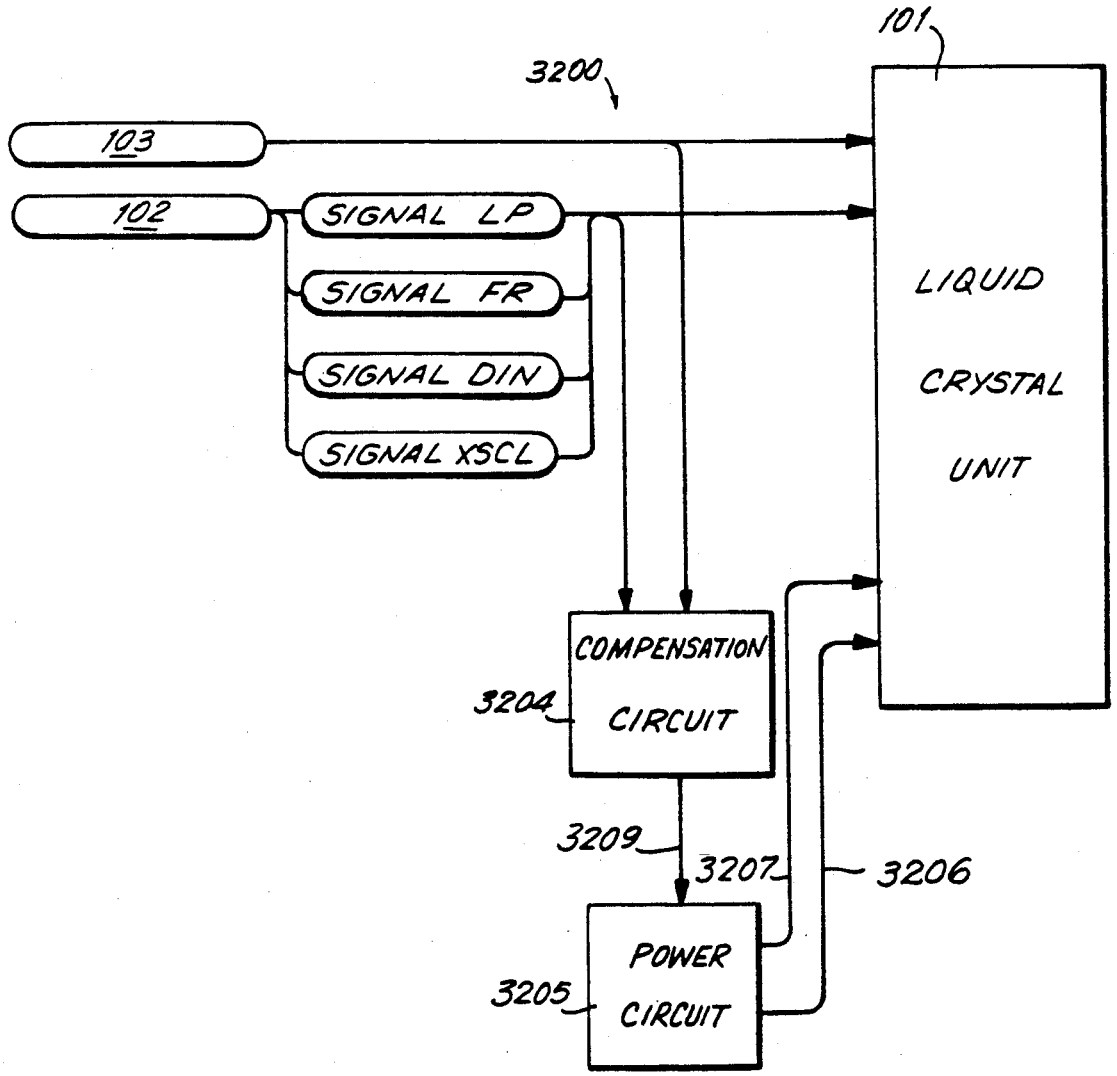
FIG. 58 is a block diagram of a liquid crystal display of a tenth embodiment of the invention.

Reference is made to FIG. 58 in which a block diagram of a tenth embodiment of an LCD, generally indicated as 3200, which displays a pattern without vertical crosstalk is provided. As mentioned above, the degree of vertical crosstalk is determined by the difference T' between the number T of ON dots and the value L of OFF dots on the liquid crystal panel. Since the sum of T and L is G, the total number of display dots on the liquid crystal panel, T' is expressed by the following equation:

$$\begin{aligned} T' &= T - L \\ &= T - (G - T) \\ &= 2 \times T - G \end{aligned}$$

(*G* is a constant).

Therefore, when the liquid crystal display device is operated, it is not necessary to count both the values T and L, but only the value T and then compensate the applied voltage in accordance with the value T.

LCD 3200 includes a compensation circuit which receives data signal 103, signal XSCL and signal DIN and counts the number of ON dots on liquid crystal panel 201. Compensation circuit 3204 outputs a strength signal 3209 to a power circuit 3205. Power circuit 3205 shifts the potential value of the OFF voltage of Y power source 3206 in accordance with the input value of strength signal 3209. It thus becomes possible to prevent vertical crosstalk and provide a superior display.

Figure 59:
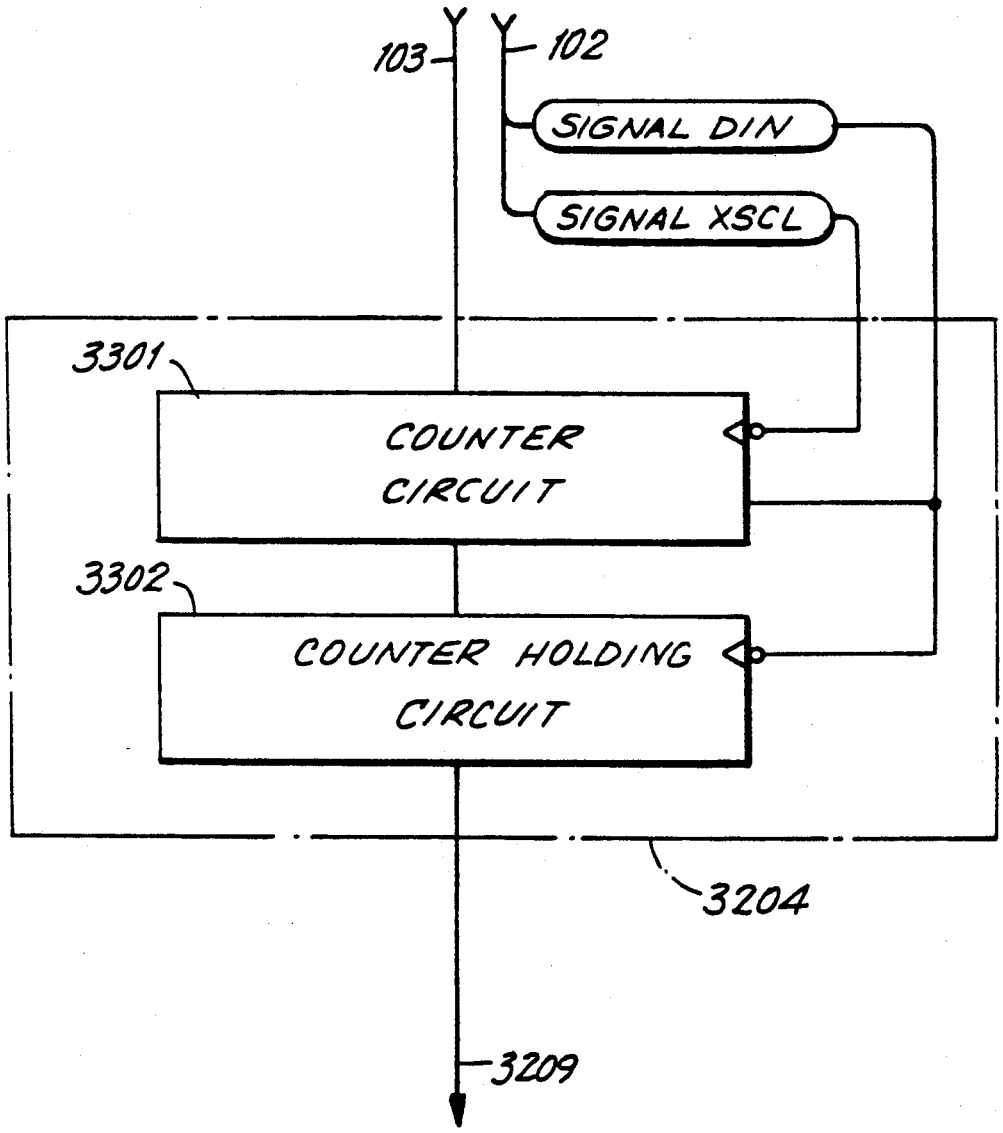
FIG. 59 is a block diagram of a compensation circuit constructed in accordance with the tenth embodiment.

Reference is now made to FIG. 59 in which a block diagram of compensation circuit 3204 is provided. A counter circuit 3301 counts the total number of ON dots on liquid crystal panel 201 and more particularly, counts the number of ON dots for a period between successive signal DINs of control signal 102 when data signal 103 is active and at the falling edge of signal XSCL. The counted number is then output to a counter holding circuit 3302. The counted number of counter circuit 3301 is returned to zero. Counter circuit 3301 again counts the number of ON dots. By such a construction, it is possible to count the value T of the ON dots on liquid crystal panel 201. In addition, it is not required to make an errorless count. Errors of up to approximately five percent of the total number of display dots 204 on liquid crystal panel 201 do not effect the quality of the display.

Counter holding circuit 3302 is provided to hold the value T generated by counter circuit 3301. The counted value T is output as strength signal 3209. Thus, compensation circuit 3204 outputs the value T of ON dots on liquid crystal panel 201 as strength signal 3209.

Figure 60:
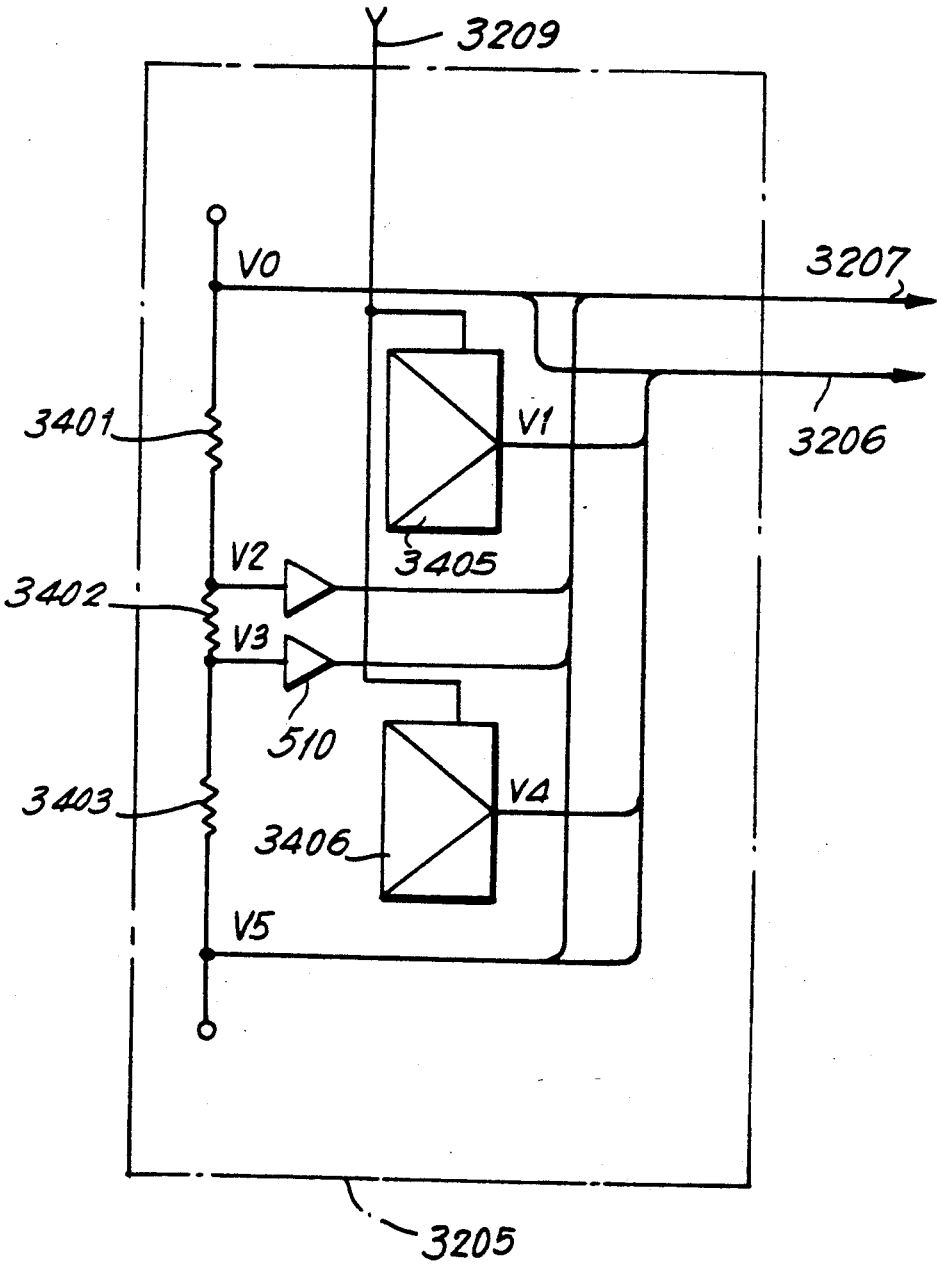
FIG. 60 is a block diagram of a power circuit constructed in accordance with the tenth embodiment of the present invention.

Reference is now made to FIG. 60 in which a circuit diagram of power circuit 3205 is provided. Three resistors 3401, 3402, 3403 are serially connected. Voltages V0 and V5 are applied across the ends of the series of connected resistors providing voltage dividers. The divided voltage V0, V2, V3 and V5 represent the divided voltages at the terminals of respective resistors 3401, 3202 and 3403. The respective voltage values are predetermined and represented as follows:

$$(V0-V2)/2=(V3-V5)/2$$

Further, to stabilize the voltages V2 and V3, a voltage stabilizing circuit 510 which functions identically as in power circuit 105 is provided.

Herein, the voltages V1N and V4N are defined as follows:

$$V1N=(V0+V2)/2$$

$$V4N=(V5+V3)/2$$

The voltages V1N and V4N are set to be an intermediate voltage between voltages V0 and V2, and an intermediate voltage between the voltages V3 and V5, respectively.

Voltage generating circuits 3405 and 3406 receive strength signal 3209 and generate output voltages which are varied in accordance with changing values of strength signal 3209. Voltage generating circuits 3405 and 3406 comprise a digital to analogue convertor. Herein, P, the strength signal 3209, is defined as follows:

$$P=T-(\gamma\times G)$$

where G indicates the total number of dots on liquid crystal panel 201 and $\gamma$ is approximately $\frac{1}{2}$. In an exemplary embodiment, $\gamma$ is $\frac{1}{2}$.

Voltage generating circuit 3405 is controlled to output a voltage V1N which is shifted in accordance with the absolute value of P in the direction of voltage V2 when P is positive ($T>(\gamma\times G)$ and in the direction of the voltage V0 when P is negative ($T<(\gamma\times G)$. Similarly, when the value T of the strength signal 3209 is larger than the constant ($\gamma\times G$), voltage generating circuit 3406 outputs a voltage corresponding to the absolute value of P which is shifted in the direction of the voltage V3 relative to the voltage V4. When the value T of strength signal 3209 is smaller than the constant, the voltage generating circuit 3406 outputs a voltage corresponding to the absolute value of P which is shifted in the direction of the voltage V5 relative to voltage V4. The voltage generated by voltage generating circuits 3405 and 3406 serve as V1 and V4. Voltages V1, V4 and voltages V0 and V5 are generated by the power circuit 3205 as a Y power source 3206. The voltage V0, V2 and V5 are generated by power circuit 3205 as an X power source 3207. Y power source 3206 and X power source 3207 are applied to liquid crystal panel 201 in either set as discussed above in the other embodiments. The voltages V1 and V4 are non-selected voltages of Y power source 3206 and their potential values are changed in accordance with the value T as discussed above.

In LCD 3200, when a small number of dots on liquid crystal panel 201 are in the ON state, the non-selected voltage of Y power source 3206 has a value approximating the ON voltage. However, when a large number of dots on liquid crystal panel 201 are in the ON state, the non-selected voltage has a value approximating the OFF voltage.

Figure 61:
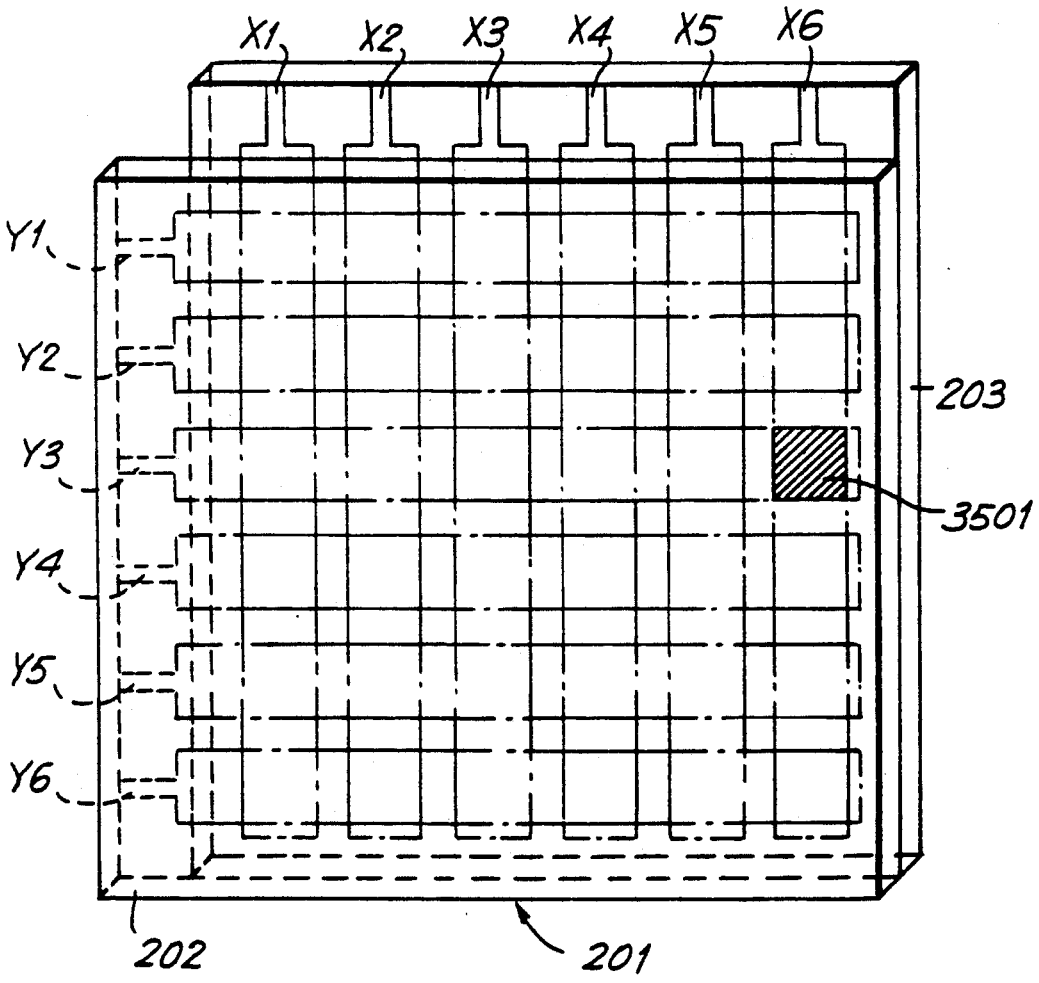
FIG. 61 is a perspective view of a liquid crystal panel wherein another display pattern is displayed.
Figure 62A:
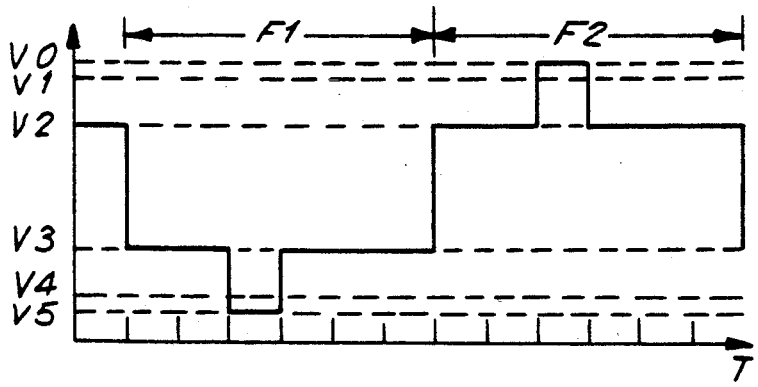
FIGS. 62A-62C are graphs of the waveforms of the voltage applied to the liquid crystal panel for forming the display pattern shown in FIG. 61.
Figure 62B:
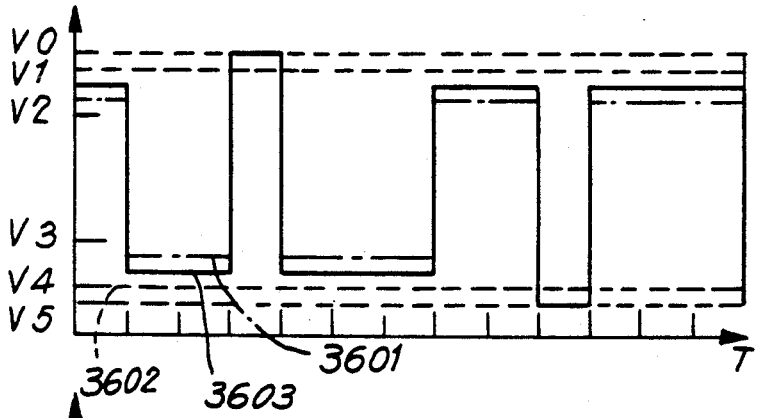
Figure 62C:
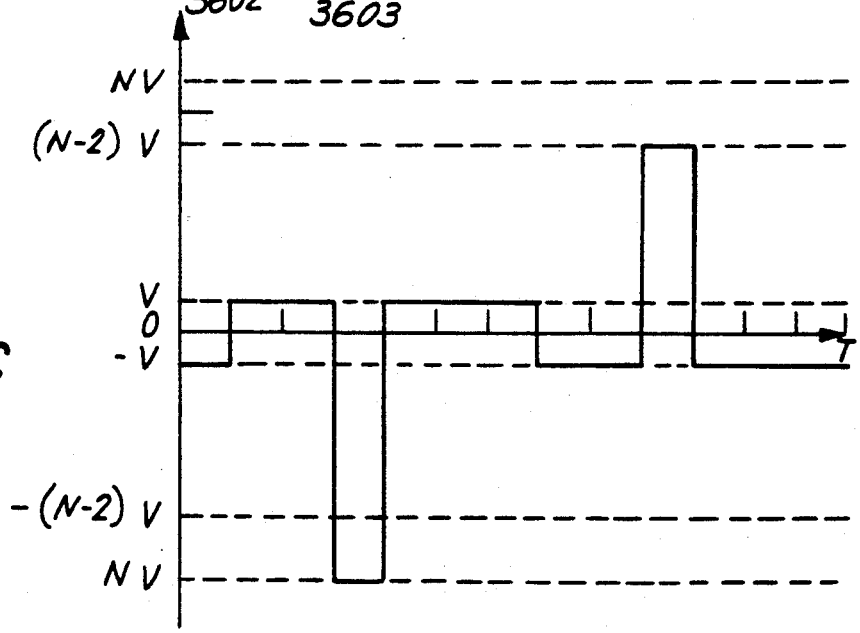

Reference is now made to FIGS. 61 through 62C in which one embodiment of a display pattern and waveforms input to LCD 3200 are provided. Liquid crystal panel 201 provides display pattern having a small number of ON dots. FIG. 62A illustrates a voltage waveform applied to segment electrode X6 to form a ON dot 3501. FIG. 63B illustrates a voltage waveform applied to common electrode Y3 to form ON dot 3501. FIG. 63C shows the combined voltage waveform applied at ON dot 3501.

A voltage 3601 is the voltage to be shifted on the common electrode. A voltage 3602 is the non-selected voltage generated by Y power source 3206. A voltage 3603 on the common electrode is obtained by combining voltages 3601 and 3602.

Since the display pattern has a small number of ON dots on the liquid crystal panel 201 ($T<\gamma\times G$), the non-selected voltage on the common electrode is likely to be changed to a value approximating the non-selected voltage as shown in voltage 3601. However, since the display pattern has a small number of ON dots on liquid panel 201, the non-selected voltage generated by Y power source 3206 approximates the ON voltage, as shown by voltage 3602. Accordingly, voltage 3603 is compensated to be an intermediate value between the ON/OFF voltages, resulting in no difference between the effective voltages applied to the display dots of liquid crystal panel 201.

Conversely, when the display pattern has a large number of ON dots on liquid crystal panel 201 ($T>(\gamma\times G)$), the non-selected voltage on the common electrode is likely to be changed to a value near the OFF voltage. However, since the display pattern has a large number of ON dots on liquid crystal panel 201 ($M_{ON}$), the selected voltage generated by Y power source 3206 approximates the OFF voltage, so that the voltage is compensated in the same way.

As discussed, the value of the non-selected voltage is changed in accordance with the value T of the number of ON dots on liquid crystal panel 201, thereby making it possible to provide a good display quality without vertical crosstalk.

In an eleventh embodiment the value of ON/OFF voltages may also be changed in accordance with the value T of the number of ON dots on liquid crystal panel 201, to obtain the same effects. Namely, rather than compensate the value of the non-selected voltage, ON/OFF voltages can be changed by the same value and in the same direction as the value and the direction in which the non-selected voltage applied to the common electrode is likely to be changed, thereby making it possible to provide a high quality of display without any vertical crosstalk.

While specific embodiments have been illustrated and described herein, the means for compensating the voltage is not limited thereto. It is also possible to apply any means that can compensate the difference of the effective voltages generated in accordance with the value T of the number of ON dots on the liquid crystal panel 201.

Figure 63:
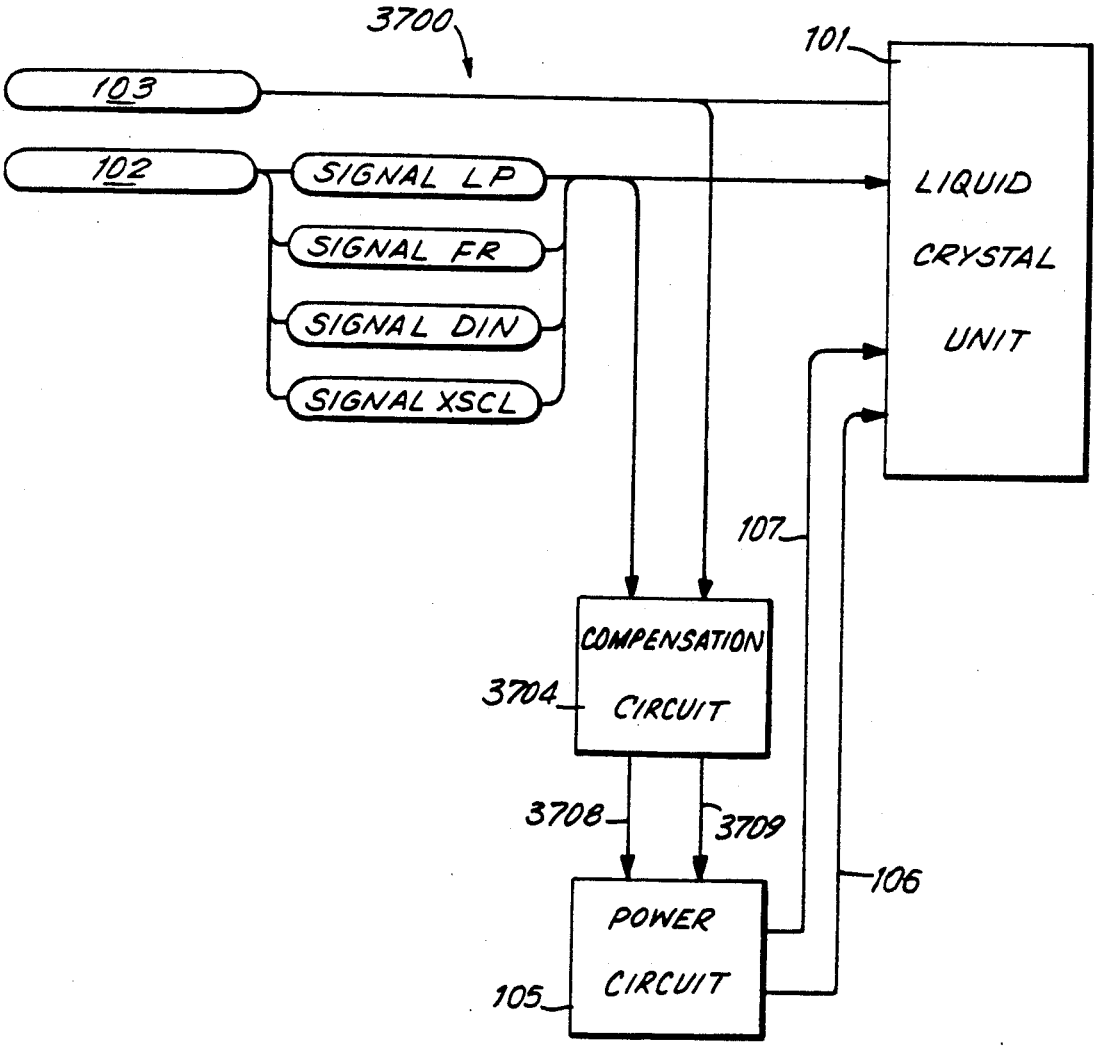
FIG. 63 is a block diagram of a liquid crystal display device constructed in accordance with a twelfth embodiment of the invention.

Reference is now made to FIG. 63 in which a block diagram of a twelfth embodiment of an LCD, generally indicated as 3700, for providing a display without inversion crosstalk is provided. As mentioned above, if the polarity is reversed when the selected common electrode is switched from the nth common electrode to the (n+1)th common electrode, the degree of inversion crosstalk is determined by a value F which is the difference between the sum of the display dots and the sum of the ON dots on both the nth and (n+1)th common electrodes. Therefore, at the time of changing the LCD, it is necessary to count the value F and compensate the voltage in accordance with the value F.

The construction of LCD 3700 is the same as that of LCD 100 with the exception of a compensation circuit 3704, a sign signal 3708 and a strength signal 3709. Like numerals are utilized to indicate like structure.

Upon the inputting of control signal 102 and data signal 103 to compensation circuit 3704, the value F is counted by compensation circuit 3704 and the sign of F is output as sign signal 3708 by compensation circuit 3704. Further, strength signal 3709 which is generated for a period corresponding to the absolute value of F is also output by compensation circuit 3704 in synchronism with signal LP when signal FR of control signal 102 changes. Power circuit 105 receives both strength signal 3709 and sign signal 3708. Upon the input of sign signal 3708 and strength signal 3709, power circuit 105 changes the non-selected voltage of Y power source 106 to compensate the applied voltage.

Figure 64:
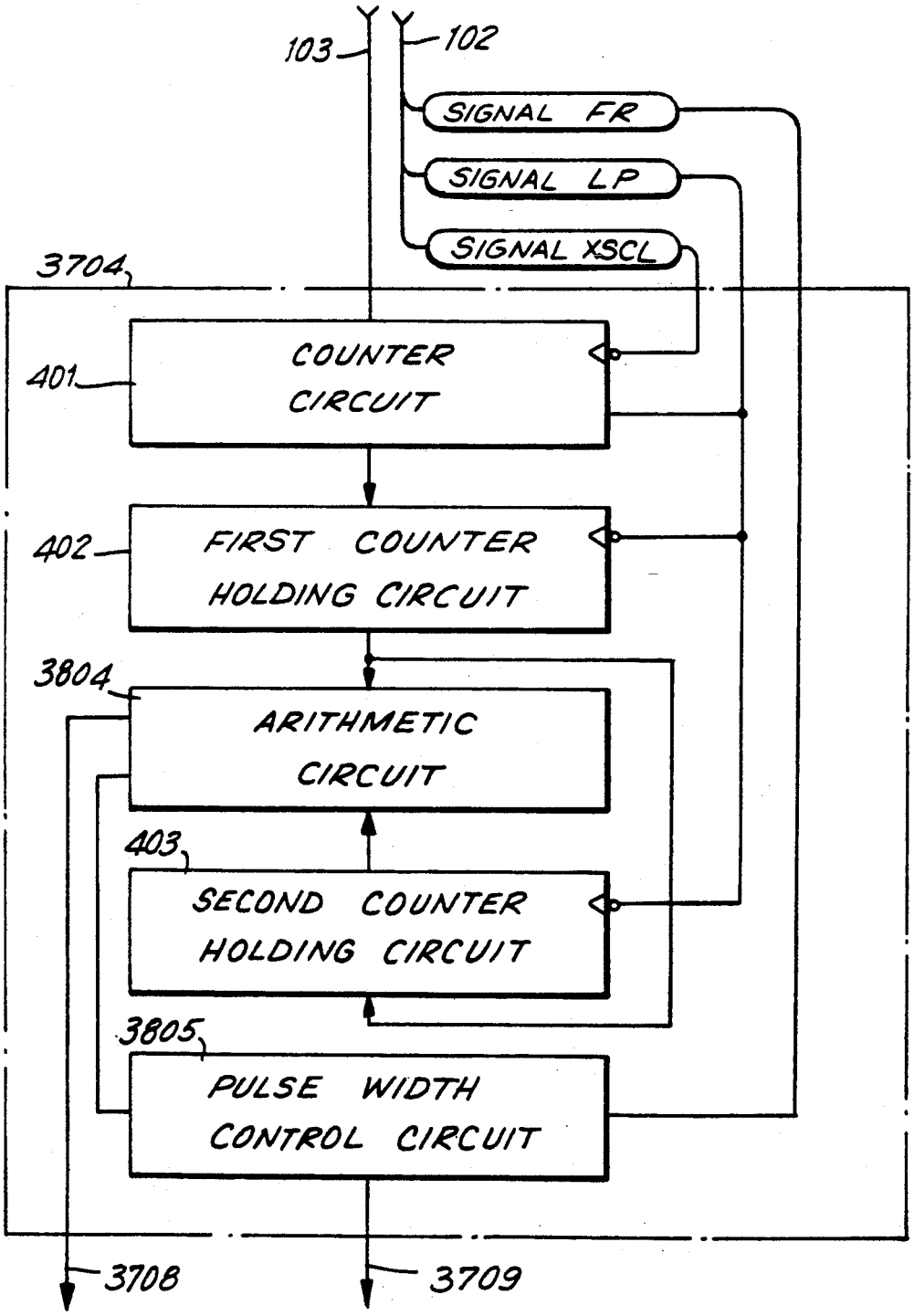
FIG. 64 is a block diagram of a compensation circuit constructed in accordance with the twelfth embodiment of the invention.
Figure 65:
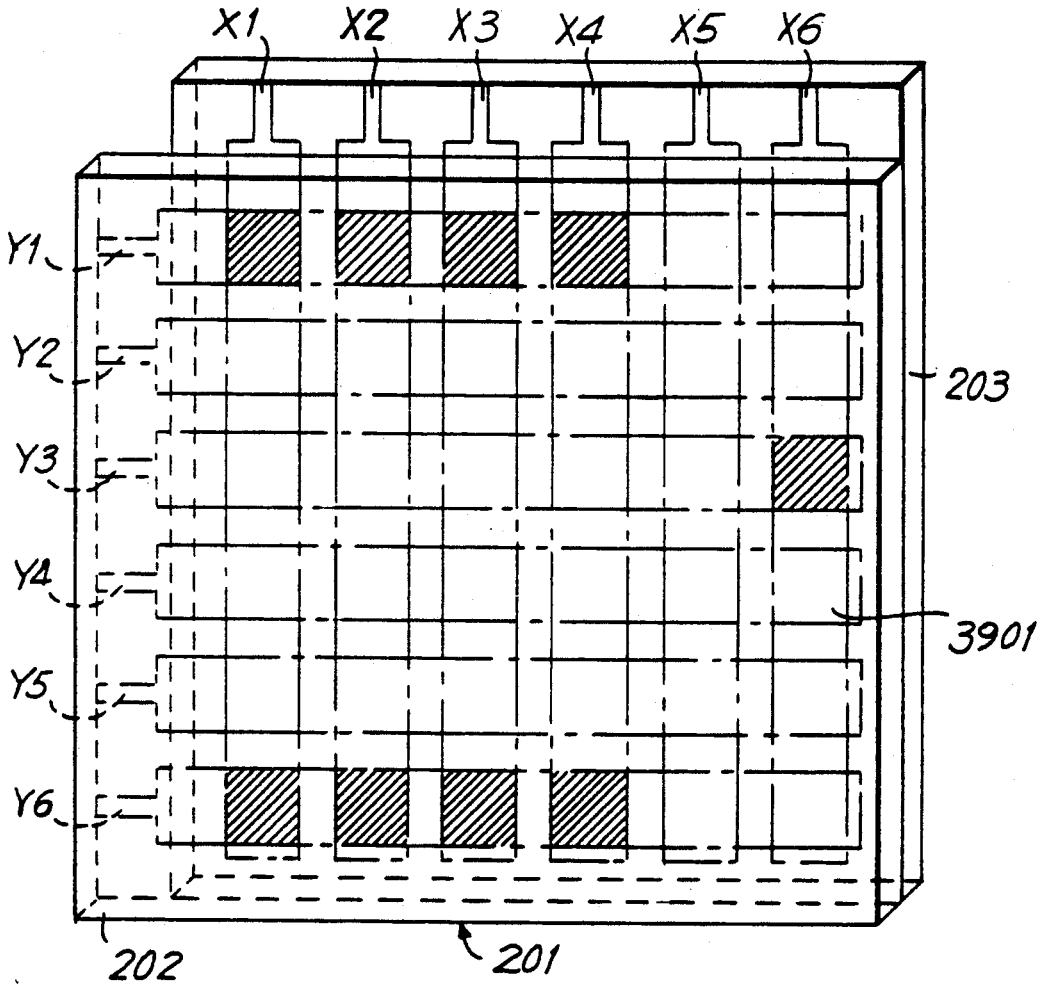
FIG. 65 is a perspective view of a liquid crystal panel wherein another display pattern is displayed.

Reference is now made to FIG. 64 wherein a block diagram of compensation circuit 3704 is provided. Compensation circuit 3704 includes counter circuit 401, a first counter holding circuit 402 and a second counter holding circuit 403 which all operate in the same way manner as in compensation circuit 104. However, an arithmetic circuit 3804 is provided to calculate the following equation:

$$F=-(N_{ON}+M_{ON}-Q)$$

Where Q is a number approximating the number of segment electrodes X1 through X6. In an exemplary embodiment, Q is predetermined as the number of segment electrodes X1 through X6. The sign of F obtained by arithmetic circuit 3804 is output as a sign signal 3708 and the absolute value of F is output to a pulse width control circuit 3805. Pulse width control circuit 3805 outputs strength signal 3709 which is generated over a period corresponding to the absolute value of F in synchronism with signal LP when signal FR of control signal 102 changes. The relation between the output period of strength signal 3709 and the absolute value of F is the same as that of the pulse width control circuit 405. Further, sign signal 3708 and strength signal 3709 generated by compensation circuit 3704 operate in the same manner as sign signal 108 and strength signal 109.

In compensation circuit 3704, if the polarity of F is reversed when the selected electrode is switched from the nth common electrode to the (n+1)th common electrode, when the sum of the number of ON dots on the nth and (n+1)th common electrodes is larger than the number of segment electrodes X1 through X6, the non-selected voltage applied to common electrodes Y1 through Y6 is changed for a period corresponding to the difference between the number of ON dots and the number of segment electrodes in the direction of the OFF voltage. However, when the sum of the number of ON dots on the nth and (n+1)th common electrodes is smaller than the number of segment electrodes X1 through X6, the non-selected voltage is changed for a period corresponding to the difference between the number of ON dots and segment electrodes in the direction of the ON voltage.

Reference is now made to FIGS. 65 through 70 which illustrate other embodiments of a display pattern provided by LCD 3700. FIG. 66A illustrates a voltage waveform applied to the segment electrode X6 to form an ON dot 3901. FIG. 66B illustrates a voltage waveform applied to common electrode Y4 to form ON dot 3901. FIG. 66C illustrates a combined voltage waveform applied to ON dot 3901. A spike-shaped noise waveform 4101 (FIG. 67) is generated on the common electrode. A waveform 4102 of the selected voltage is applied by Y power source 107 to produce a waveform 4103 obtained by the combination of waveforms 4101 and 4102, on common electrode with a value V.

Figure 69A:
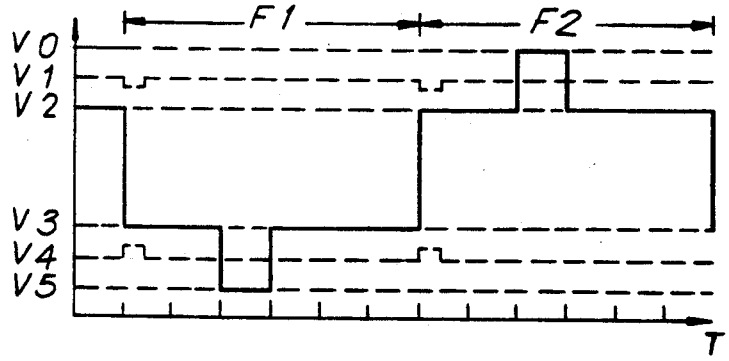
FIGS. 69A-69C are graphs of the waveforms applied to the liquid crystal panel for forming the display pattern of FIG. 68.
Figure 69B:
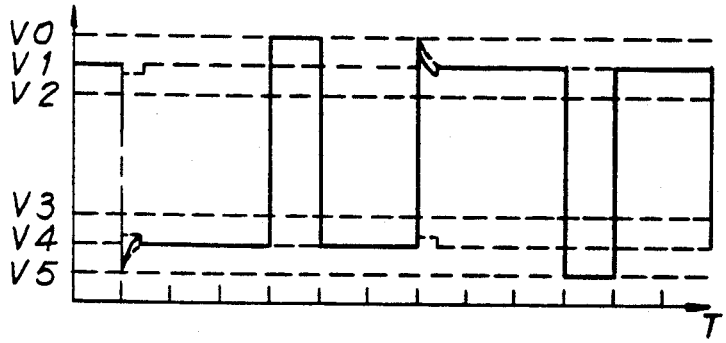
Figure 69C:
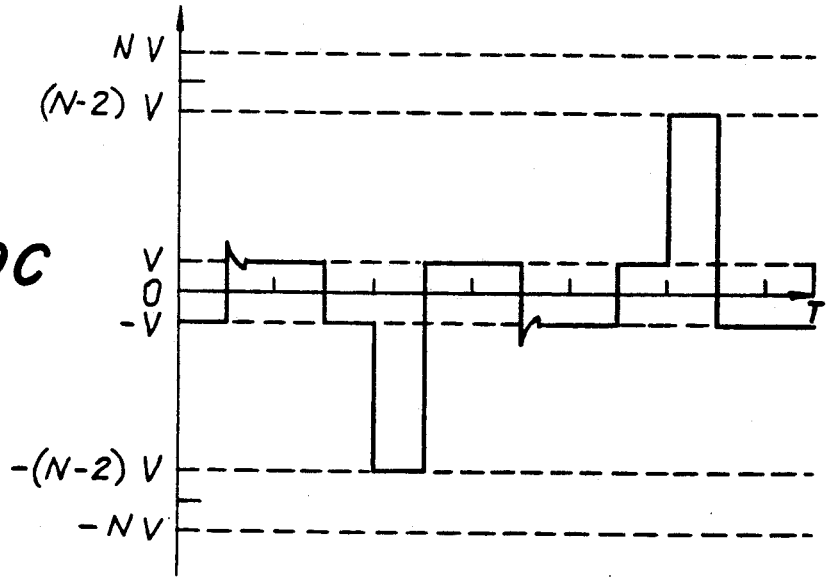

FIG. 69A illustrates a voltage waveform applied to segment electrode X6 to form the display dot 4201. FIG. 69B illustrates a voltage waveform applied to segment electrode Y4 to form display dot 4201. FIG. 69C illustrates a combined waveform of the voltage applied at the display dot 4201.

Figure 66A:
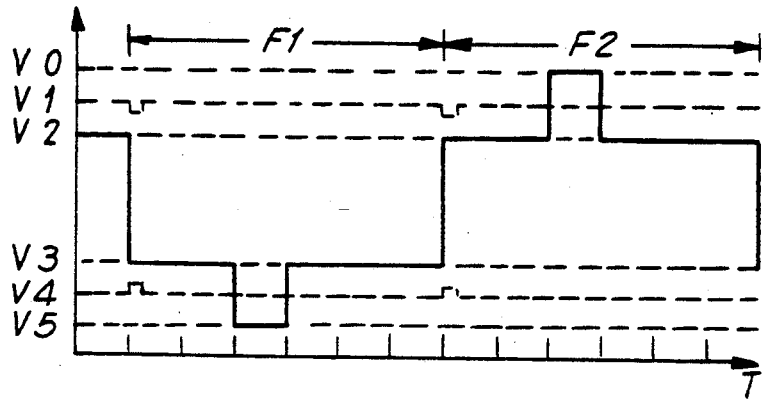
FIGS. 66A-66C are graphs of waveforms of the voltage applied to the liquid crystal panel of FIG. 65.
Figure 66B:
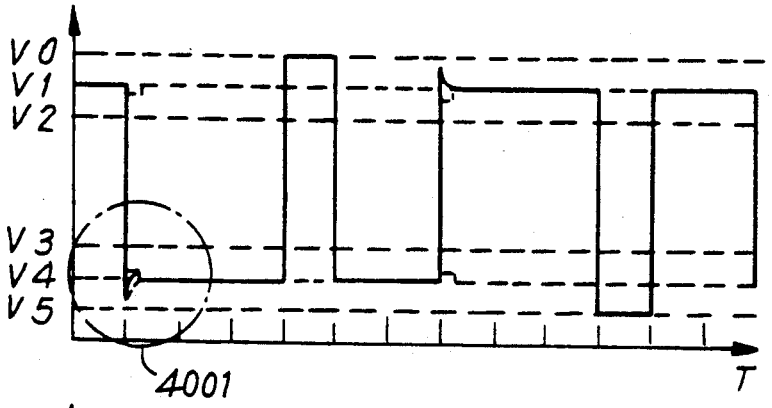
Figure 66C:
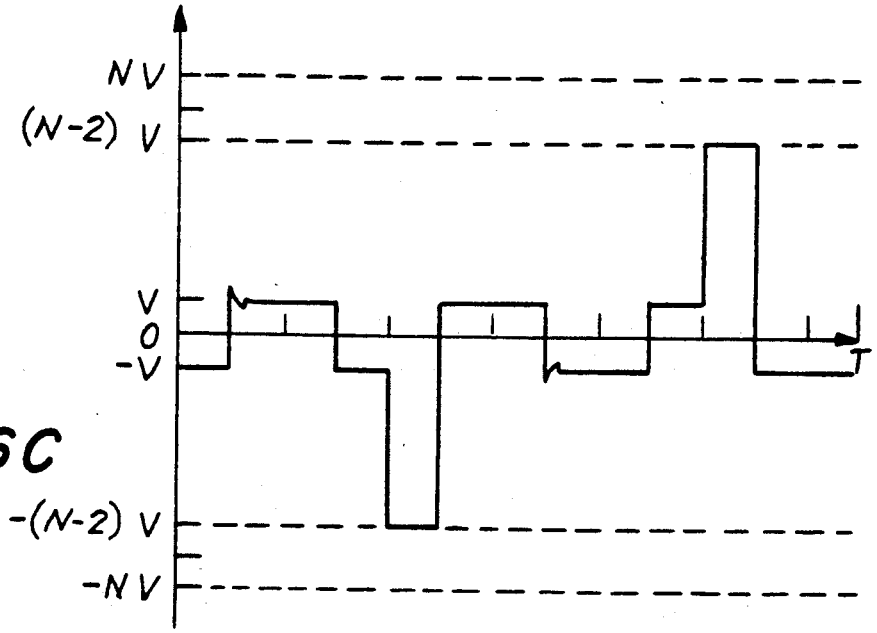
Figure 67:
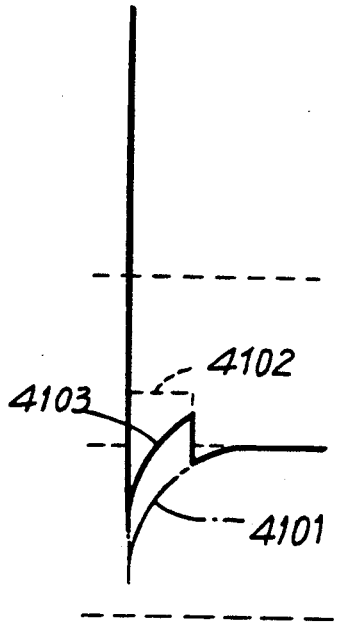
FIG. 67 is a partial exploded view of the waveform of FIG. 64C.
Figure 70:
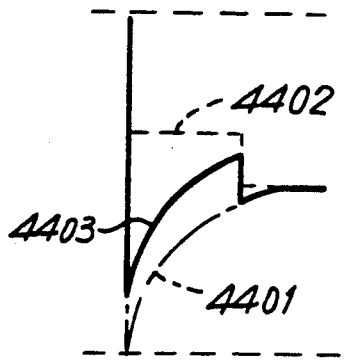
FIG. 70 is an exploded view of the waveform of FIG. 69B.
Figure 68:
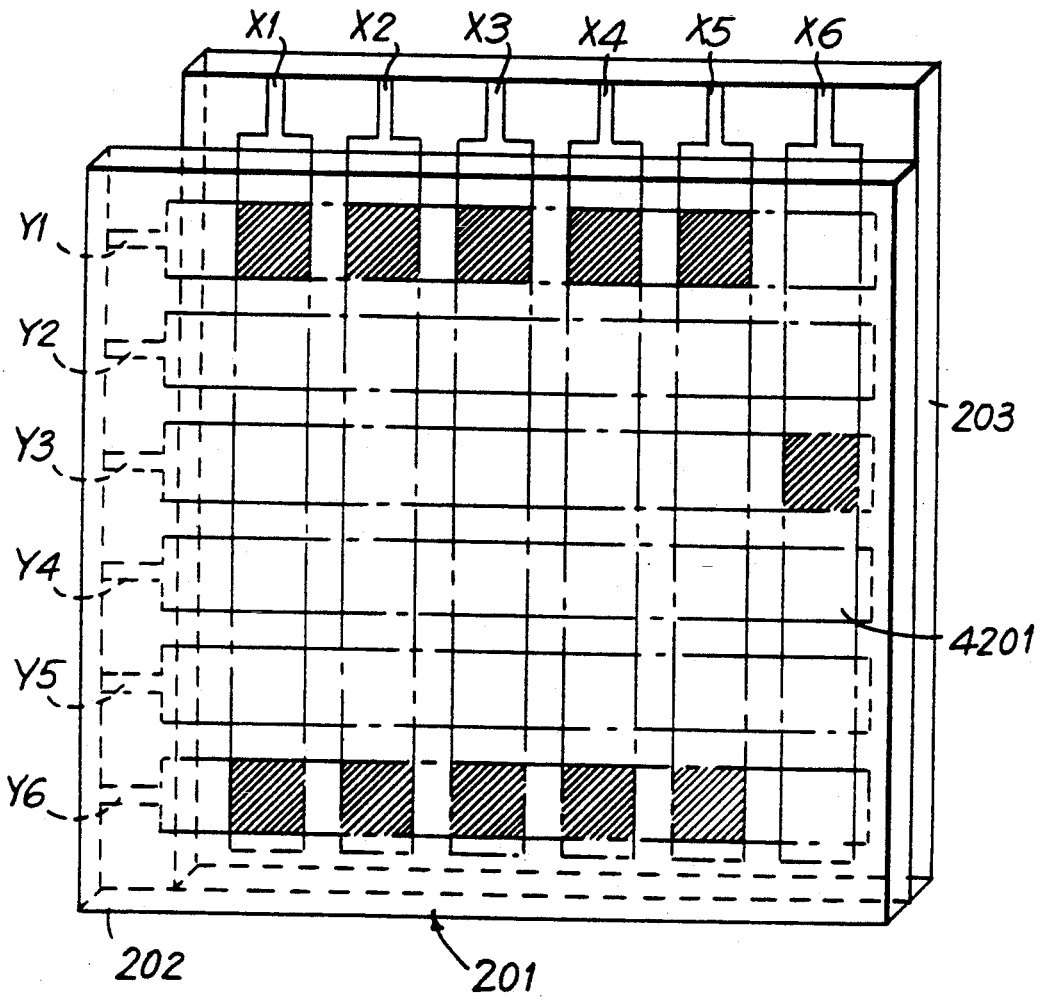
FIG. 68 is a perspective view of a liquid crystal panel wherein another display pattern is formed.

Reference is now made to FIG. 70 in which an enlarged area of FIG. 69B generally indicated as 4001 is provided. A spike-shaped noise waveform 4401 is generated on the common electrode. A waveform 4102 of the non-selected voltage of Y power source is applied to the common electrode 107 resulting in waveform 4101 obtained by the combination of waveforms 4401 and 4402. In addition, FIGS. 67 and 70 are enlarged in a constant ratio. So that herein, in FIG. 65, the value of F is −2 (F=−2), while in FIG. 68, the value F is −4. (F=−4) The resulting voltage of FIG. 70 becomes a larger rounded waveform 4401 than the waveform 4101 of the resulting voltage of FIG. 66.

However, the non-selected voltage is compensatively changed and the voltage waveform 4402 is applied for a longer period than that of the voltage waveform 4102, in accordance with the value F to prevent any noise waveform. By such a construction, the non-selected voltage is compensated, and no difference arises between the effective voltage applied to the display dots as shown in FIGS. 66C and 69C. As mentioned above, the period of the non-selected voltage is compensated in accordance with the value F, thereby making it possible to improve the display quality during the reversing of the polarity.

In a thirteenth embodiment, it is possible to compensate the voltage base, the time-voltage base, or the functional waveform of the non-selected voltage in accordance with the value F. Thus, the same effects as those obtained by LCD 3700 can be obtained.

In a fourteenth embodiment, it is also possible to compensate the voltage base, the time-voltage base, or the functional waveform of ON/OFF voltages in accordance with the value F. In this case, the same effects as those of LCD 2400 can be obtained.

While specific embodiments have been illustrated and described herein, the means for compensating the voltage is not limited thereto. It is also possible to apply any means that can compensate the difference of the effective voltages on the common electrodes Y1 through Y6 by changing the non-selected voltage according to the value F.

To provide an improved high quality display without respective modes of crosstalk, several embodiments have been illustrated and described above. The values according to the kinds and degree of the crosstalk are not limited to the values I, Z, T and F mentioned above.

For example, it has been explained that horizontal crosstalk is determined by the number $M_{ON}$ of ON dots on the selected common electrode, that is, the value Z. In particular, as a result of the analysis of the charge/-discharge between the common and segment electrodes at the time of selecting the common electrodes, a value Z' is derived and expressed by the following equation:

$$Z' = M_{ON} + \delta \times (M_{ON} - N_{ON}),$$

where δ is a constant based upon the liquid crystal material and driving method. In an exemplary embodiment $|\delta| \leqq 2$. Z' is defined by the relationship between the display pattern and the crosstalk and in accordance with the value Z' the voltage is compensated, thereby making it possible to better improve display quality without horizontal crosstalk. In addition, the above equation, $Z' = M_{ON} + \delta \times (M_{ON} - N_{ON})$ is calculated from the following equation:

$$Z' = M_{ON} + \delta \times (d - c)$$

Herein, c is the number of segment electrodes which are switched from an ON voltage to an OFF voltage when the selected common electrode is changed to the next common electrode. d is the number of segment electrodes which are switched from an OFF voltage to an ON voltage during this period.

Due to crosstalk, changes in the voltages applied to the segment electrodes affect the voltages applied to the common electrodes. When the voltage on the common electrode is changed from the non-selected voltage to the selected voltage, it is possible to prevent the voltage on the common electrode from being changed to a selected voltage through crosstalk by calculating a value M corresponding to the horizontal crosstalk; that is, to increase the size of a rounded waveform. Herein, the direction in which the voltage is changed on the segment electrodes which are switched from an ON voltage to an OFF voltage is in the direction opposed to the direction in which the voltage is changed on the common electrodes, therefore it is possible to prevent the voltage on the common electrode from being changed to the selected voltage. Conversely, since the direction of the voltage change on the segment electrodes which are switched from an OFF voltage to an ON voltage is the same voltage and the same direction in which the voltage is changed on the common electrodes, the segment electrode serves to change the voltage on the common electrode to the selected voltage to some degree. Therefore, the degree of rounded waveform is determined by the difference (d−c) between the number c of segment electrodes which are switched from an ON voltage to an OFF voltage and the number d of segment electrodes which are switched from an OFF voltage to an ON voltage, when the voltage on the common electrodes is changed to the selected voltage.

Figure 71:
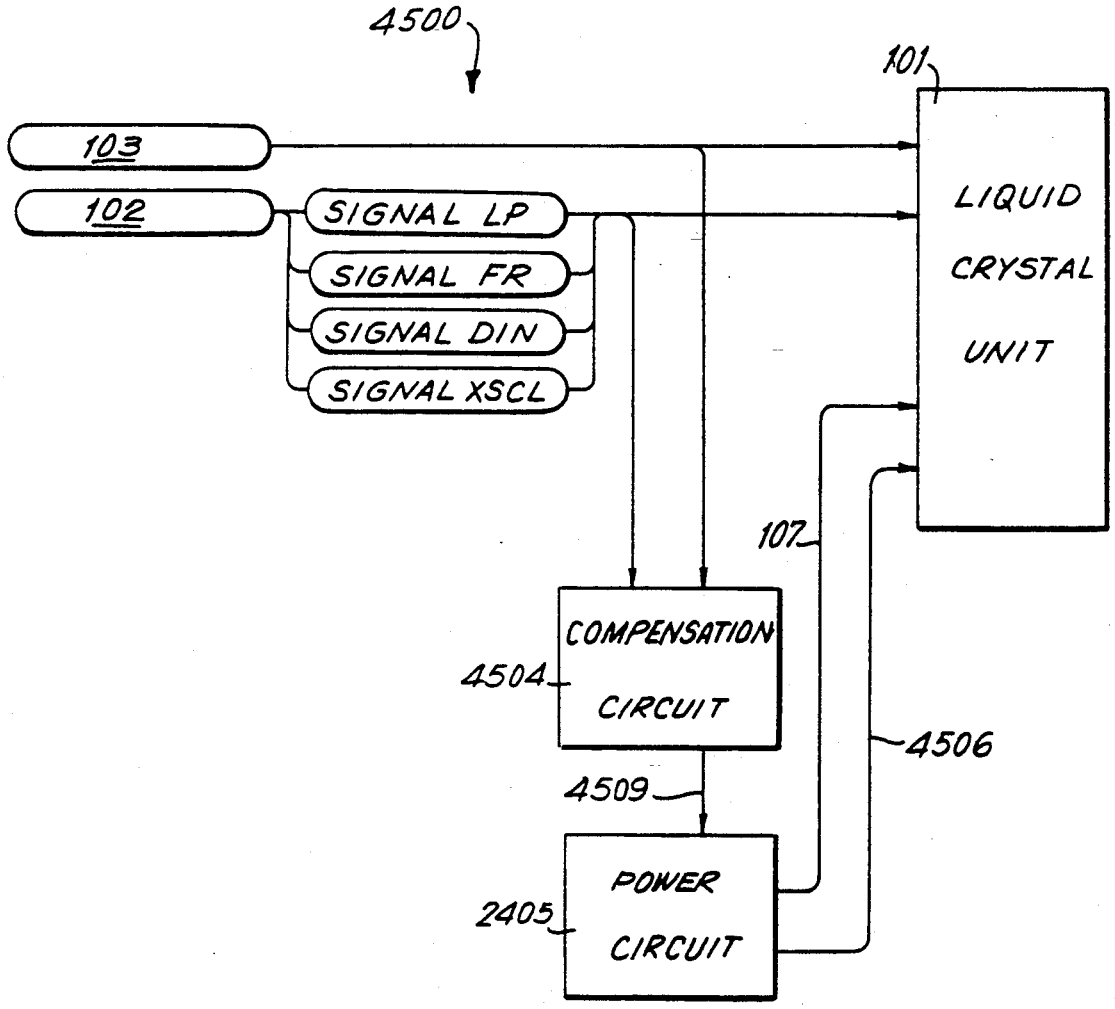
FIG. 71 is a block diagram of a liquid crystal device constructed in accordance with a fourteenth embodiment of the invention.

Reference is now made to FIG. 71 in which a block diagram of a fifteenth embodiment of an LCD, generally indicated as 4500, for compensating crosstalk according to a value Z' is provided. LCD 4500 includes structure operated in the same manner as in LCD 2400 with the exception of a compensation circuit 4504, a strength signal 4509 generated by compensation circuit 4504, and a Y power source 4506 generated by power circuit 2405. Like structure is identified by like numerals.

Compensation circuit 4504 receives data signal 103 and control signal 102 as inputs. Upon the inputting of control signal 102 and data signal 103, compensation circuit 4504 counts the value of Z'. Compensation circuit 4504 outputs a strength signal 4509 in synchronism with signal LP of control signal 102. Strength signal 4509 is active for a period corresponding to the absolute value of Z'. Upon receipt of strength signal 4509, power circuit 2405 changes the selected voltage of Y power source 4506 to compensate the applied voltage.

Figure 72:
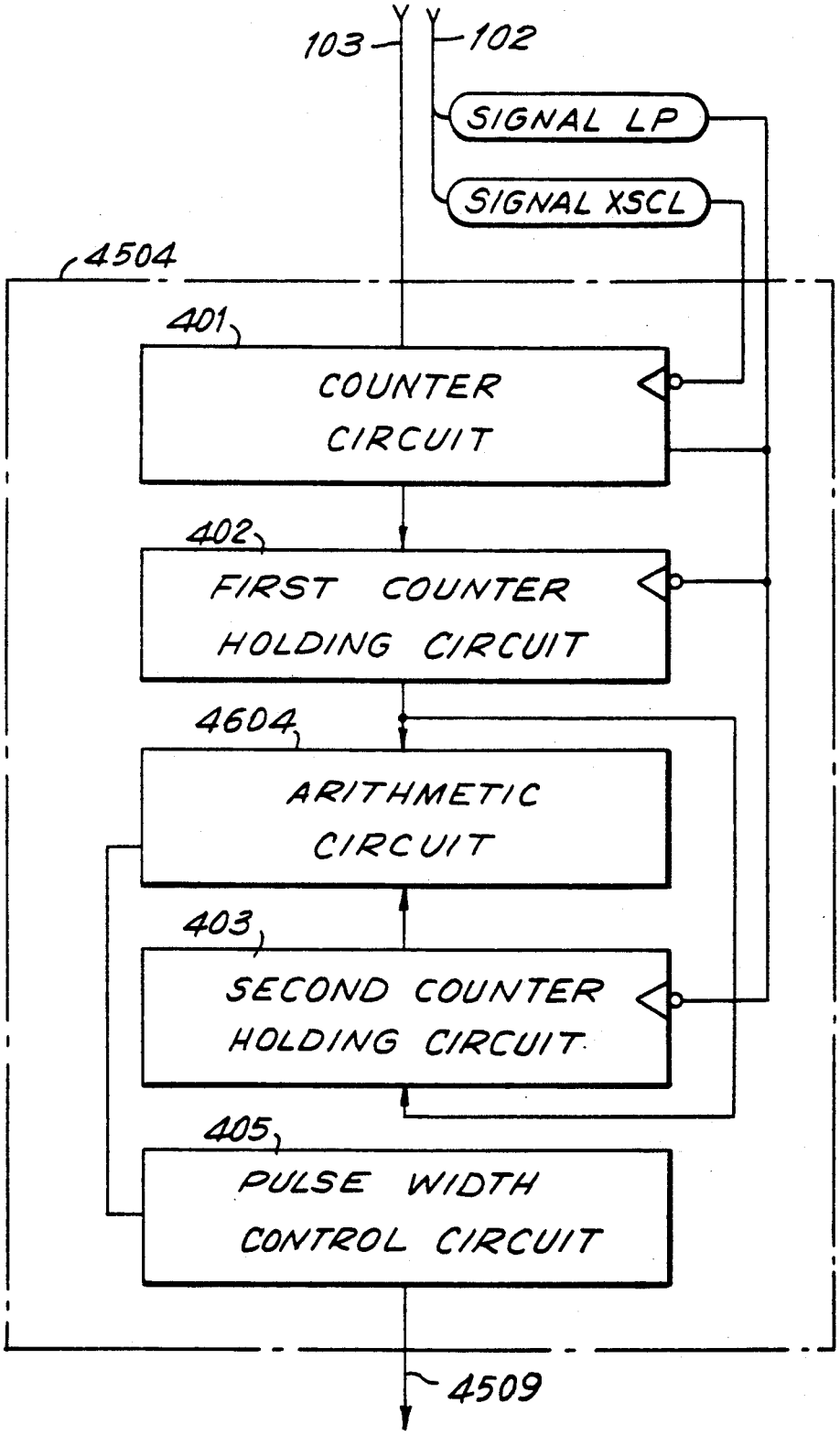
FIG. 72 is a block diagram of a compensation circuit constructed in accordance with the fourteenth embodiment of the invention.

Reference is now made to FIG. 72 in which a block diagram of compensation circuit 4504 is provided. Compensation circuit 4504 includes a counter circuit 401, a first counter holding circuit 402 and a second counter holding circuit 403 which operate in the same manner as compensation circuit 104. An operative circuit 4604 is provided to perform the following calculation:

$$Z' = M_{ON} + \delta \times (M_{ON} - N_{ON})$$

The value Z' obtained by the above equation is output to a pulse width control circuit 405. Upon the input of Z' from operative circuit 4604, strength signal 4509 which is active for the period corresponding to both Z' and a constant s is output from pulse width control circuit 405. Constant s is defined as the product of the number of segment electrodes X1 through X6 on liquid crystal panel 201 and δ, within a range that the value Z' is not negative. Because compensation circuit 4504 has the above construction, the selected voltage is changed during a period corresponding to the value Z' when nth common electrode is selected.

Figure 73:
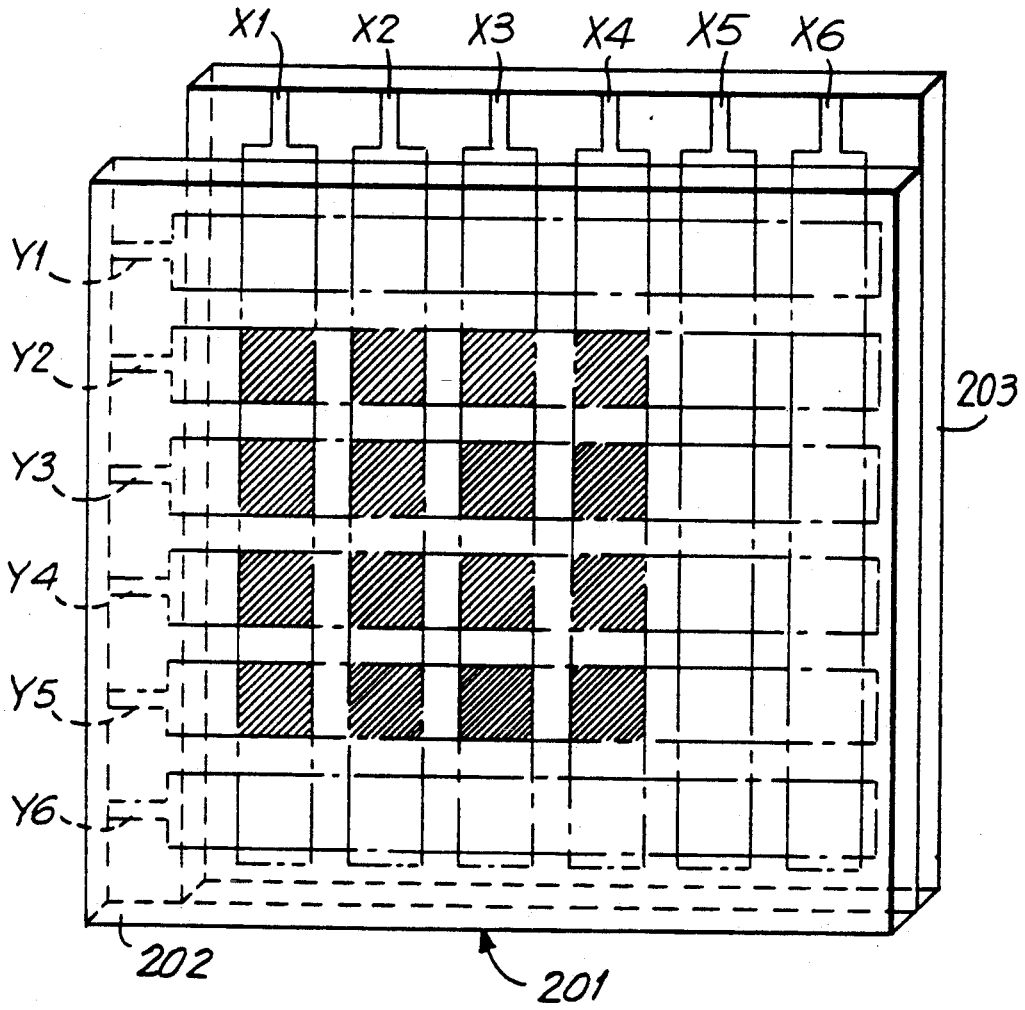
FIG. 73 is a perspective view of a liquid crystal panel wherein another display pattern is formed.

Reference is now made to FIG. 73 wherein one embodiment of a display pattern in which the above construction is applied to liquid crystal panel 201. Additionally, reference is made to FIG. wherein a display condition after compensating the applied voltage to prevent horizontal crosstalk is provided. A remaining crosstalk 4801 (hereinafter referred to as a fine horizontal crosstalk) remains on liquid crystal panel 201 after compensating the applied voltage in accordance with the above construction. The fine horizontal crosstalk occurs on the common electrodes disposed at the boundary of ON/OFF dots, as shown in FIG. 74.

Figure 74:
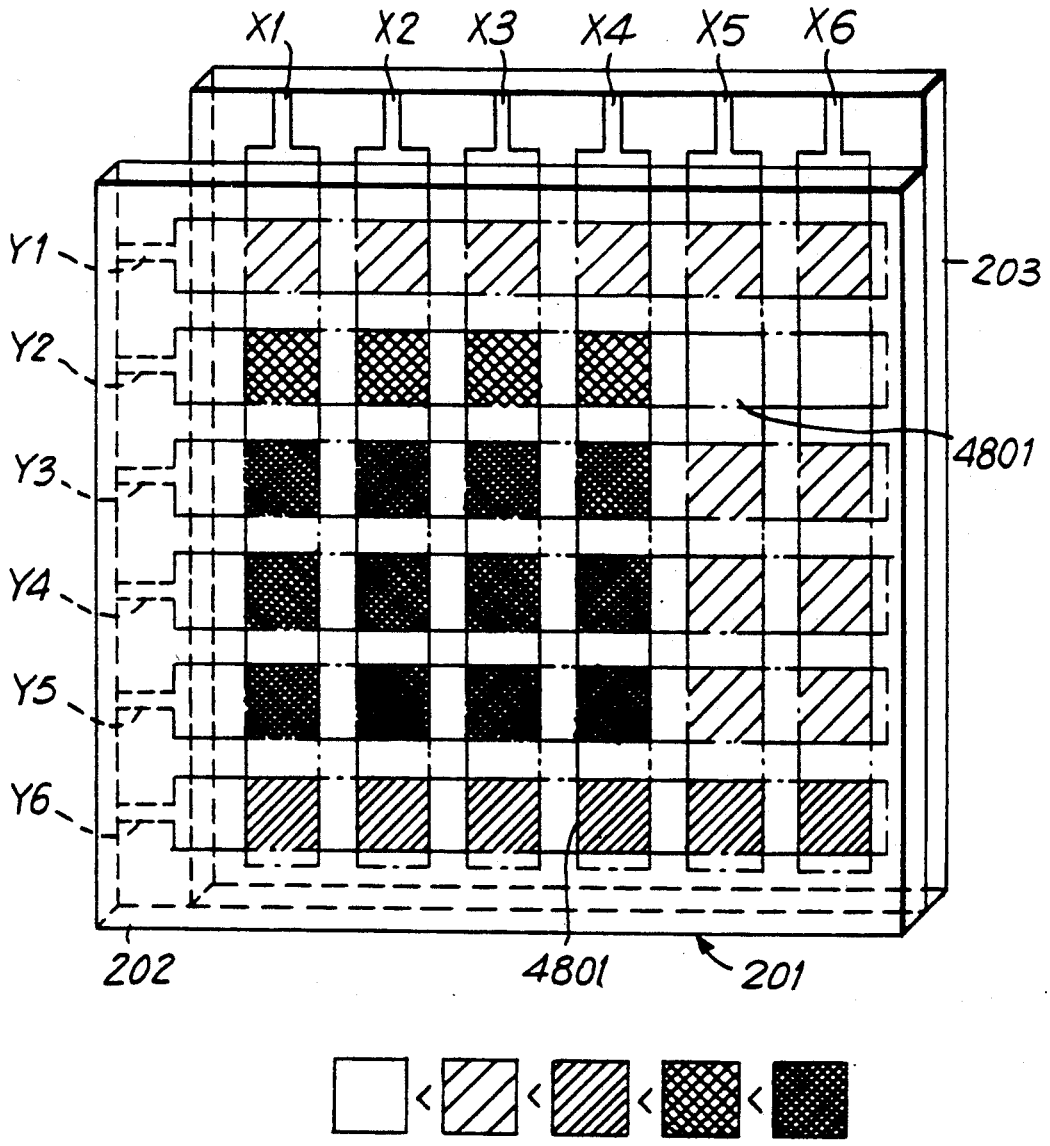
FIG. 74 is a perspective view showing a display condition during the forming of the display pattern of FIG. 71.

Herein, when the display pattern shown in FIG. 74 is formed, the respective values Z' are as follows:

| | |
|---|---|
| first common electrode *Y1* | $Z' = 0$ |
| second common electrode *Y2* | $Z' = 4 + 4 \times \delta$ |
| third common electrode *Y3* | $Z' = 4$ |
| fourth common electrode *Y4* | $Z' = 4$ |
| fifth common electrode *Y5* | $Z' = 4$ |
| sixth common electrode *Y6* | $Z' = 0 - 4 \times \delta$ |

Figure 75:
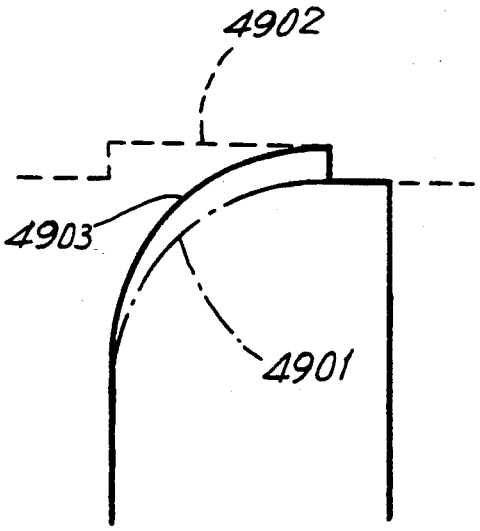
FIGS. 75 and 76 are exploded graphs of voltage waveforms applied to the electrodes when the common electrodes are changed from the non-selected voltage to the selected voltages.
Figure 76:
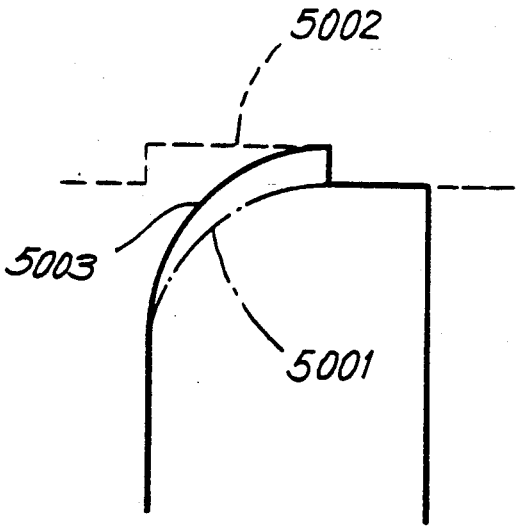

Reference is now made to FIGS. 75 and 76 wherein exploded views of the waveforms of third common electrode Y3 and fourth common electrode Y4 when they are respectively changed from the non-selected voltage to the selected voltage is provided. A rounded waveform 4901 is generated in third common electrode Y3. A changing waveform 4902 is applied as the selected voltage resulting in a combined waveform 4903 obtained by the combination of the waveforms 4901 and 4902. Waveform 4903 is the voltage applied to third common electrode Y3.

Similarly, as seen in FIG. 76, a rounded waveform 5001 is generated in fourth common electrode Y4. A changing waveform 5002 is applied as the selected voltage resulting in a waveform 5003 obtained by the combination of the waveforms 5001 and 5002. Waveform 5003 is the voltage applied to fourth common electrode Y4.

In FIG. 73, when the selected electrode is changed from first common electrode Y1 to second common electrode Y2, a rounded waveform 4901 may be generated in accordance with the number $M_{ON}$ or Z (=4) of ON dots on second common electrode Y2 and the difference $M_{ON}-N_{ON}$ (=4) between the number of ON dots on first common electrode Y1 and second common electrode Y2. Similarly, in FIG. 73, when the selected electrode is changed from third common electrode Y3 to fourth common electrode Y4, a rounded waveform 5001 may be generated in accordance with the number MON or Z (=4) of ON dots on third common electrode Y3 and the difference $M_{ON}-N_{ON}$ (=0) between the number of ON dots on second common electrode Y2 and third common electrode Y3. As can be seen from a comparison between waveform 4901 and waveform 5001, waveform 4901 may have larger rounded section than that of waveform 5001 due to the difference in the number of ON dots. However, the waveform 4902 of the selected voltage is changed for a longer time than the selected voltage of the waveform 5002. By such a construction, waveform 4903 and waveform 5003 are compensated, resulting in an improved display without fine horizontal crosstalk.

As mentioned above, charge/discharge between the common and segment electrodes which are generated according to the display pattern on the liquid crystal panel 201 is analyzed. Based on the analysis, the differences of the effective voltages applied to the display dots are compensated by changing the voltages applied to the common electrodes Y1 through Y6 and the segment electrodes X1 through X6, resulting in an improved display. Further, charge/discharge between adjacent segment electrodes X1 through X6 through common electrodes Y1 through Y6 and charge/discharge between adjacent segment electrodes X1 through X6 through common electrodes Y1 through Y6 are analyzed. Based on the analysis, the difference of the effective voltages applied to the display dots are compensated by changing the voltages applied to the common electrodes Y1 through Y6 and the segment electrodes X1 through X6, resulting in an improved display.

The same effects can be obtained by counting OFF dots instead of ON dots. Furthermore, it is also possible to eliminate additional crosstalk by weighing respective ON dot positions when counting the number of ON dots.

Figure 77:
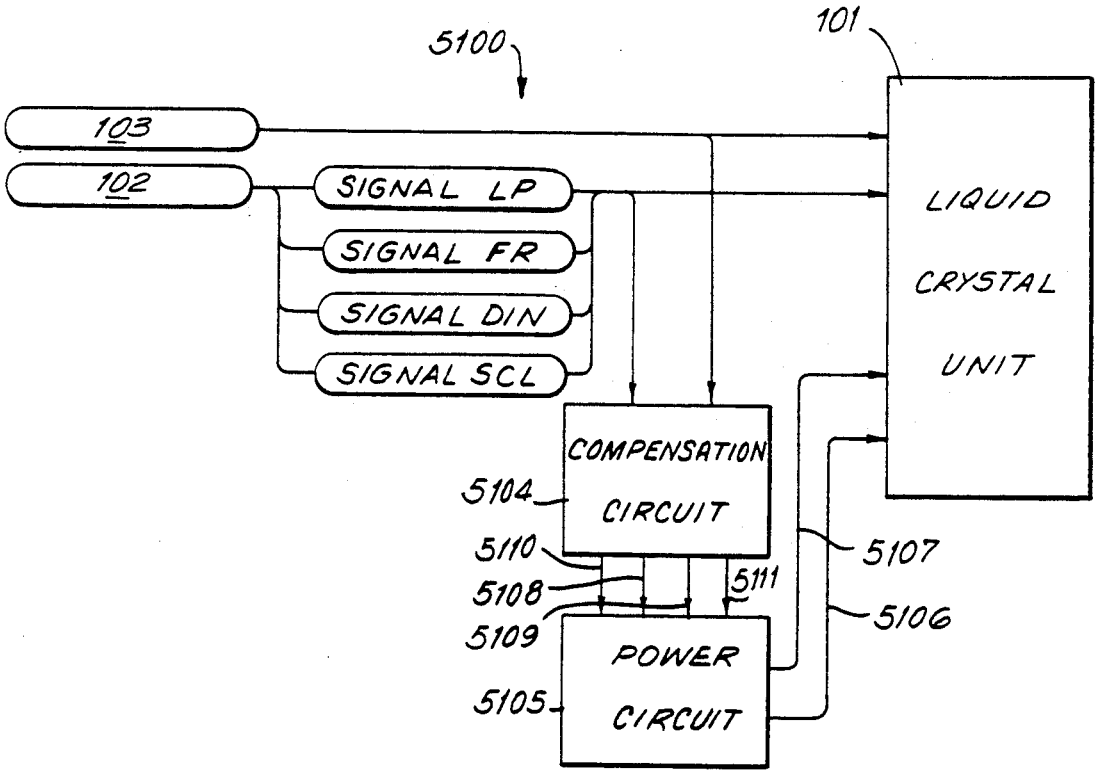
FIG. 77 is a block diagram of a liquid crystal display device constructed in accordance with a sixteenth embodiment of the invention.

Additionally, it is also possible to combine several of the above embodiments to simultaneously prevent several kinds of cross-talk. Reference is now made to FIG. 77 in which a block diagram of a sixteenth embodiment of an LCD, generally indicated as 5100, for preventing all four modes of crosstalk is provided. To prevent zebra crosstalk, the time base compensation of non-selected voltage is carried out according to the value I. To prevent horizontal crosstalk, the time base compensation of the selected voltage is carried out in accordance with the value Z. To prevent vertical crosstalk, the voltage base compensation of the non-selected voltage is carried out in accordance with the value T. To prevent inversion crosstalk, the time base compensation is carried out in accordance with the value of F.

LCD 5100 includes a compensation circuit 5104 and a power circuit 5105. Compensation circuit 5104 receives data signal 103 and control signal 102 and generates a Y power source 5106 and an X power source 5107. The sign signal 5108, a first strength signal 5109, a second strength signal 5110, and a third strength signal 5111. Power circuit 5105 receives each of the outputs of compensation circuit 5105 and produces a Y power source 5106 and an X power source 5107.

Compensation circuit 5104 counts the value I, outputs the sign (plus or minus) of I, and outputs a signal which is active for a period corresponding to the absolute value of I as first strength signal 5109, in synchronism with signal LP of control signal 102. However, when signal FR changes, strength signal 5109 is not output. Further, when FR signal changes, compensation circuit 5104 functions to count the value F, output the sign of F as sign signal 5108 and output a signal which is active for the period predetermine by the absolute value of F as first strength signal 5109, in synchronism with signal LP of control signal 102. Additionally, compensation circuit 5104 simultaneously functions to count the value T, and output the counted value as second strength signal 5110. Furthermore, compensation circuit 5104 functions to count the value Z, and output a signal which is active for the period corresponding to the value Z as third strength signal 5111, in synchronism with signal LP of control signal 102.

Power circuit 5105 functions to change at least one of Y power source 5106 and X power source 5107 in accordance with the first, the second and the third strength signals 5109 through 5111 and sign signal 5108, thereby making it possible to eliminate any crosstalk.

Figure 78:
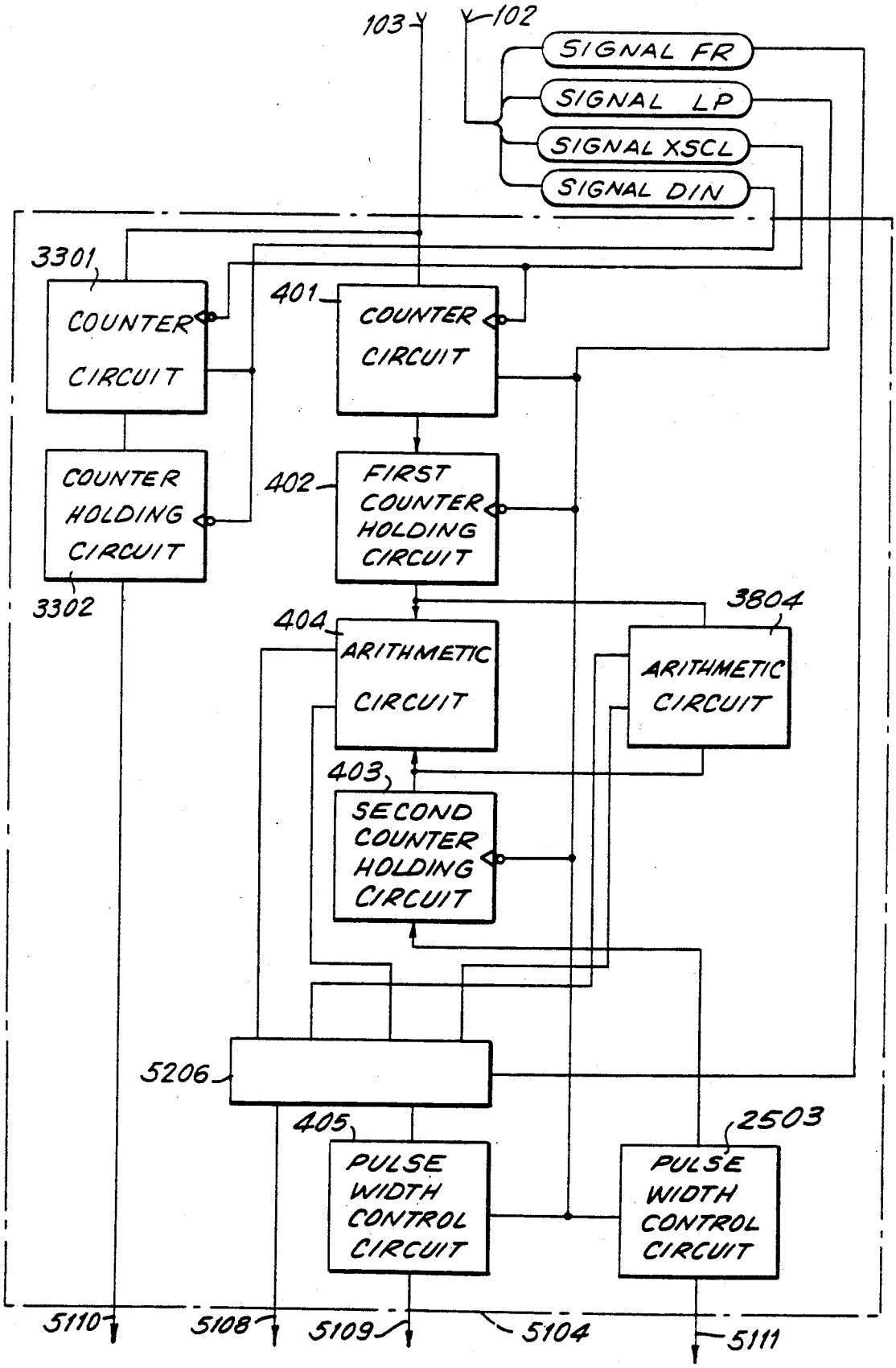
FIG. 78 is a block diagram of a compensation circuit constructed in accordance with the sixteenth embodiment of the invention.

Reference is now made to FIG. 78 in which a block diagram of compensation circuit 5109 is provided. Compensation circuit 5109 includes a counter circuit 401, a first counter holding circuit 402, a second counter holding circuit 403 and an operative circuit 404 which all function in the same manner as in compensation circuit 104. Counter circuit 401 counts the number of ON dots, first counter holding circuit 402 stores the value MON and the second counter holding circuit 403 stores the value NON. Operative circuit 404 calculates the value I.

An arithmetic circuit 3804 counts the value F from the value $M_{ON}$ stored in first counter holding circuit 402 and the value $N_{ON}$ stored in the second counter holding circuit 403. A switching circuit 5206 receives the output of operative circuit 404 and arithmetic circuit 3804 and functions to pick up the sign of the value and the absolute value of the value which is generated from either the arithmetic circuit 404 or arithmetic circuit 3804. When signal FR of control signal 102 has not changed, switching circuit 5206 functions to select the value I of arithmetic circuit 404. When signal FR is changed, switching circuit 5206 functions to select the value F of arithmetic circuit 3804.

Switching circuit 5206 outputs the sign of I or F as sign signal 5108 and to output the value of I or F to a pulse width control circuit 405. Pulse width control circuit 405 function in the same way as in compensation circuit 104; that is, functions to output a signal which is active for a period corresponding to the absolute value of I or F as first strength signal 5109. Therefore, sign signal 5108 and first strength signal 5109 indicate the amount of the compensated voltage to prevent zebra and inversion crosstalk.

A counter circuit 3301 and a counter holding circuit 3302 are provided and operate in the same manner as in compensation circuit 3204. Counter circuit 3301 functions to count the value T and to output the counted value to holding circuit 3302. Holding circuit 3302 then outputs the value as second strength signal 5110. Therefore, second strength signal 5110 indicates the amount of the compensated voltage to prevent vertical crosstalk.

A pulse width control circuit 2503 receives an input from second holding circuit 403 and functions in the same way as in compensation circuit 2404. Pulse width holding circuit outputs a signal which is active for a period corresponding to the value $M_{ON}$ of first counter holding circuit 402, that is, the value Z, as third strength signal 5111. Therefore, third strength signal 5111 indicates the amount of the compensated voltage to be output to prevent horizontal crosstalk. Accordingly, since compensation circuit 5109 has the above mentioned construction, the respective amount of compensated voltage necessary to prevent the respective crosstalks are output as respective compensated signals.

Figure 79:
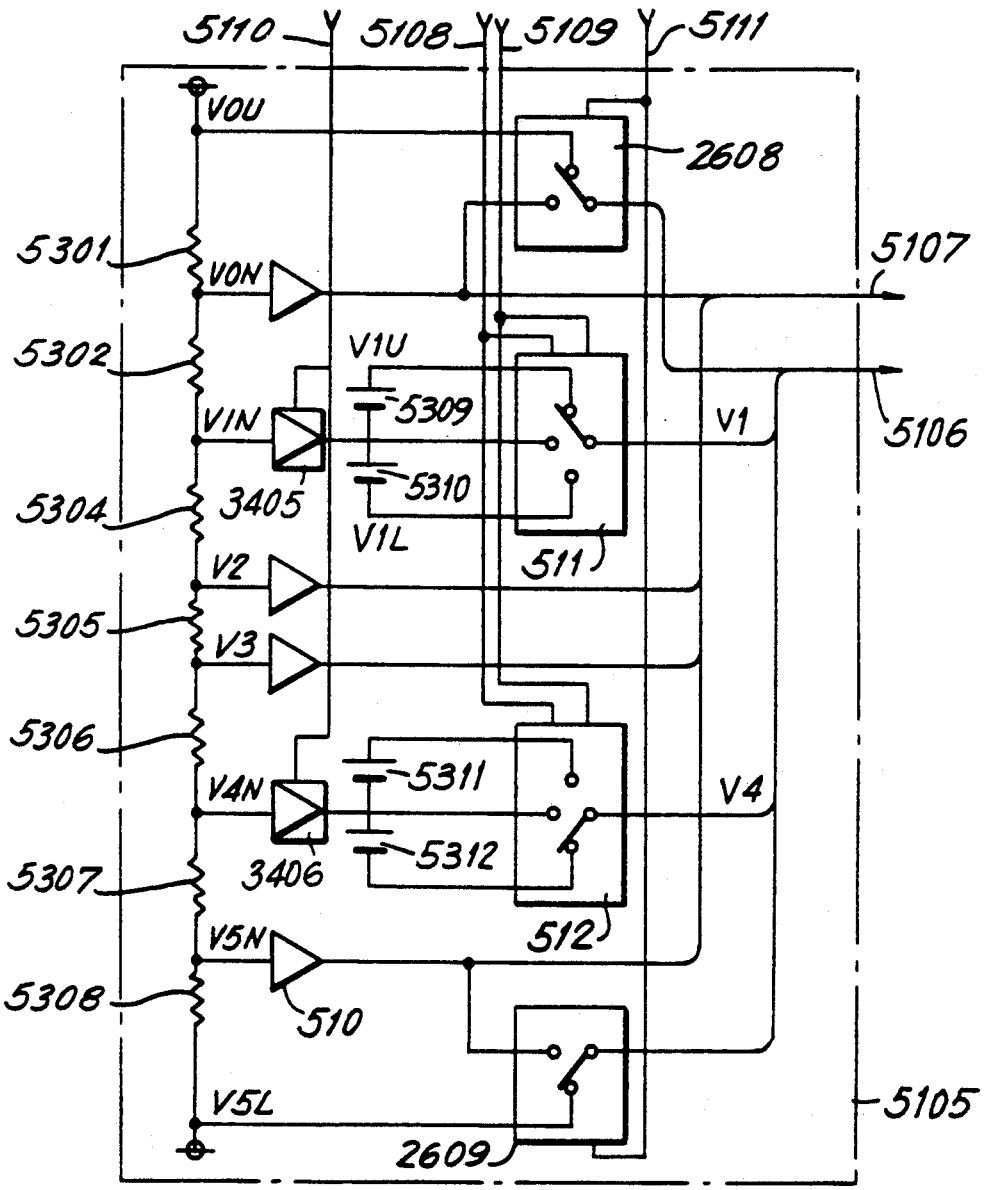
FIG. 79 is a circuit diagram of a power circuit constructed in accordance with the sixteenth embodiment of the invention.

Reference is now made to FIG. 79 wherein a circuit diagram for circuit 5105 is provided. Power circuit 5105 includes a plurality of resistors 5301 through 5308 connected serially. Voltages V0U and V5L are applied across both ends of the series of resistors creating voltage dividers at each resistors creating voltage dividers at each resistor junction.

Voltage V0U, V0N, V1, V2, V3, V4N, V5N, V5L represent the voltages provided at the respective terminals of resistors 5301 through 5308. The respective voltage values are predetermined and may be formulated as follows:

$$V0N - V1N = V1N - V2 = V3 - V4N = V4N - V5N = (V2 - V3)/(n - 4)$$

($n$ is a constant).

Further, $$(V0U - V0N)/(V0N - V1N) = (V5N - V5L)/(V4N - V5N)$$

Furthermore, the voltages V0N, V2, V3 and V5N are stabilized by a voltage stabilizing circuit 510. Voltage generating circuits 3405 and 3406 are provided at V1N and V4N and function in the same way as those of power circuit 3305 and the voltage generated from the voltage generating circuits 3405 and 3406 are changed by the second strength signal 5110.

Reference voltages 5309 and 5310 receive the output of voltage generator 3405 while reference voltages 5311 and 5312 receive the output of voltage generator 3406. The absolute value of reference voltage 5309 is the same as that of the reference voltage 5312. These reference voltages have opposite signs on the basis of the voltages V1N and V4N, respectively. Similarly, reference voltages 5310 and 5311 have the same absolute values, and have the opposing signs (plus or minus) on the basis of voltages V1N and V4N. Voltages 5310 and 5311 are defined as V1L and V4L. A pair of switches 511 and 512 function in the same way as those in power circuit 105 and are switched by sign signal 5108 and first strength signal 5109. Namely, one of the voltages V1U, V1N and V1L is selected by switch 511, and one of the voltages V4U, V4N and V4L is selected by switch 512. The voltages generated from switches 511 and 512 are defined as the voltages V1 and V4, respectively. A second pair of switches 2608 and 2609 function in the same say as those of power circuit 2405 and are switched by third strength signal 5111. One of the voltages V0U and V0N is selected by switch 2608 and one of the voltage V5U and V5N is selected by switch 2609. The voltages generated from the switches 2608 and 2609 are defined as the voltages V0, V5 respectively.

The selected voltage of Y power source 5106 is changed by third strength signal 5111, and the non-selected voltage is changed by sign signal 5108, first strength signal 5109 and second strength signal 5110.

The selected/non-selected voltage of Y power source 5106 is changed by compensating signals comprising the sign signal, the first strength signal, second strength signal and third strength signals for the above mentioned respective compensations. Herein, any zebra crosstalk is compensated by the non-selected voltage when signal FR of control signal 102 is not changed. Any inversion crosstalk is compensated by the non-selected voltage when signal FR is changed. Any horizontal crosstalk is compensated by the selected voltages. Any vertical crosstalk is compensated by changing the voltages V1N and V4N of the non-selected voltage. Therefore, the means of compensating the respective crosstalks are substantially independent and can be easily combined.

LCD 5100, the period of the applied voltages are compensated according to the values I, Z and F. However, in addition to the means of compensating the voltage waveforms described in connection with LCD 5100, when the other compensating means of the other embodiments are combined, the same effects can be obtained.

When the degree of a crosstalk is small in LCD 5100, it is possible in a seventeenth embodiment to omit the means for compensating the voltage waveforms and simplify the construction of the circuits. For example, when the degree of vertical crosstalk is so small as to not affect the display quality, to simplify the construction of the circuits it is possible to omit counter circuit 3301 and counter holding circuit 3302 so as not to generate second strength signal 5110 and substitute voltage generating circuits 3405 and 3406 for stabilizing circuit 510.

The preceding embodiments are given by way of example and hence the present invention is not limited to these embodiments. The present invention in an eighteenth embodiment is also applicable to a liquid crystal display device performing any other display such as gray scale display wherein the voltage applied to the segment electrodes is switched to ON/OFF voltages for a period when the segment electrodes are selected. In this case, the same effects can be obtained.

As mentioned above, according to the liquid crystal display device of the present invention, at least one of the voltage waveforms of the common electrodes and the voltage waveforms of the segment electrodes is compensated, based upon the conversion of the display patterns of drawings or characters into a quantized value, thereby making it possible to provide a remarkably improved display quality without crosstalk.

It will thus be seen that the objects set forth above, among those made apparent from the preceding description, are efficiently attained and, since certain changes may be made in carrying out the above method and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A matrix liquid crystal display device for displaying characters or a pattern comprising:

a first substrate;

a plurality of common electrodes being formed on said first substrate;

a second substrate;

a plurality of segment electrodes being formed on said second substrate;

a liquid crystal layer sandwiched between said first substrate and said second substrate, each of the plurality of common electrodes intersecting each of the plurality of segment electrodes on the single liquid crystal display layer when viewed in plan;

multiplex driving means for providing a common voltage waveform including a selected voltage or a non-selected voltage to said plurality of common electrodes and providing a segment voltage waveform including an ON voltage or an OFF voltage to said plurality of segment electrodes; and compensation means for reducing crosstalk caused by variations in the inherent resistance and capacitance of said liquid crystal display in turn caused by said pattern or said characters to be displayed by compensating at least one of said common voltage waveform or said segment voltage waveform based upon said pattern or said characters to be displayed in said liquid crystal display device, such compensation being effected when the portion of said liquid crystal sandwiched layer at an intersection of said segment electrodes and said common electrodes is to be displayed and without the use of a thin film transistor at said intersection.

2. The matrix liquid crystal display device of claim 1, wherein the common electrodes intersect with the segment electrodes to define a matrix having a dot at each intersection, the dots having either an ON state or an OFF state depending on the voltage supplied to the intersecting common and segment electrodes, said multiplex driving means sequentially switching the selected voltage among the common electrodes, the compensation means receiving a data signal representative of the character or pattern to be displayed and producing a strength signal in response thereto.

* * * * *